US010029473B2

(12) United States Patent
Yamamoto et al.

(10) Patent No.: US 10,029,473 B2
(45) Date of Patent: Jul. 24, 2018

(54) LIQUID DISCHARGE HEAD AND RECORDING APPARATUS

(71) Applicant: CANON KABUSHIKI KAISHA, Tokyo (JP)

(72) Inventors: Akira Yamamoto, Yokohama (JP); Shuzo Iwanaga, Kawasaki (JP); Seiichiro Karita, Saitama (JP); Kazuhiro Yamada, Yokohama (JP); Takatsuna Aoki, Yokohama (JP); Shingo Okushima, Kawasaki (JP); Akio Saito, Machida (JP); Zentaro Tamenaga, Sagamihara (JP); Noriyasu Nagai, Tokyo (JP); Tatsurou Mori, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/389,323

(22) Filed: Dec. 22, 2016

(65) Prior Publication Data

US 2017/0197435 A1 Jul. 13, 2017

(30) Foreign Application Priority Data

Jan. 8, 2016 (JP) ..... 2016-002952
Dec. 6, 2016 (JP) ..... 2016-236638

(51) Int. Cl.
*B41J 2/18* (2006.01)
*B41J 2/14* (2006.01)
*B41J 2/175* (2006.01)

(52) U.S. Cl.
CPC ..... *B41J 2/18* (2013.01); *B41J 2/1433* (2013.01); *B41J 2/175* (2013.01); *B41J 2/17563* (2013.01)

(58) Field of Classification Search
CPC ... B41J 2/18; B41J 2/1433; B41J 2/175; B41J 2/17563
See application file for complete search history.

(56) References Cited

U.S. PATENT DOCUMENTS 9,358,779 B2 * 6/2016 Miyazaki ..... B41J 2/2139
9,919,521 B2 * 3/2018 Nakamura ..... B41J 2/14233

FOREIGN PATENT DOCUMENTS

JP 4851310 B2 1/2012

* cited by examiner

*Primary Examiner* — Lamson Nguyen
(74) *Attorney, Agent, or Firm* — Canon USA, Inc. IP Division

(57) ABSTRACT

A liquid discharge head includes: a plurality of recording element boards each having a plurality each of discharge orifices configured to discharge liquid, liquid supply channels configured to supply liquid to the discharge orifices, and liquid recovery channels configured to recover liquid supplied from the liquid supply channels; a common supply channel communicating with at least one liquid supply channel of the recording element boards and configured to supply liquid to the plurality of recording element boards; and a common recovery channel communicating with at least one liquid recovery channel of the recording element boards and configured to recover liquid from the plurality of recording element boards.

22 Claims, 41 Drawing Sheets

LIQUID DISCHARGE HEAD AND RECORDING APPARATUS

BACKGROUND OF THE INVENTION

Field of the Invention

The present invention relates to a liquid discharge head and a recording apparatus.

Description of the Related Art

In recording apparatuses that discharge liquid such as ink from discharge orifices to record on a recording medium, increasing the number of discharge orifices enables the amount of ink discharged at one time to be increased, thereby enabling high-speed recording. Particularly, full-line recording apparatuses that discharge liquid while continuously conveying a recording medium use a liquid discharge head having long discharge orifice rows of which the length is equal to the transverse width of the recording medium or longer. Such liquid discharge heads use an array of multiple recording element boards that have discharge orifices and discharge elements that generate discharge energy to discharge ink from the discharge orifices.

However, when recording using such liquid discharge heads, there are cases where some recording element boards are used more than others depending on the recording data, and some of the recording element boards may not be used for a long time. In such a case, moisture in the liquid may evaporate near the discharge orifices of the recording element boards that were not used, leading to thickening of the ink, and defective discharge may occur. This defective discharge means cases where ink is not discharged at all, the discharged ink droplet is larger or smaller than the intended size, or the direction in which the ink is discharged is deviated from the intended direction, resulting in the droplet landing position of ink on the recording medium is deviated from the intended position.

A configuration has been proposed to circulate liquid within pressure chambers, to reduce occurrence of such defective discharge. Circulating the liquid keeps liquid from stagnating, so evaporation of moisture from the liquid occurs less readily. Japanese Patent No. 4851310 discloses a recording apparatus having such a configuration to circulate liquid. This recording apparatus has a first common channel and a second common channel that communicate with the discharge orifices formed in the recording element board, and a flow of liquid is generated near the discharge orifices by creating pressure difference within these channels.

However, there has been a possibility with the image forming apparatus described in Japanese Patent No. 4851310 that differential pressure (pressure difference) might occur among the multiple recording element boards, causing variation to occur in the circulatory flows in the pressure chambers. In this case, defective discharge, such different amounts of liquid being discharged at each recording element board, may occur.

SUMMARY OF THE INVENTION

It has been found desirable to reduce variance in circulatory flow of liquid through pressure chambers among recording element boards in a liquid discharge head having multiple recording element boards.

A page-wide liquid discharge head that discharges liquid includes: a plurality of recording element boards including a plurality of discharge orifice rows arrayed in parallel in a second direction that intersects a first direction, in which direction the discharge orifice rows have discharge orifices configured to discharge liquid arrayed, a plurality of recording elements configured to generate energy used to discharge liquid, a plurality of pressure chambers having the recording elements within, supply openings configured to supply liquid to the pressure chamber, and recovery openings configured to recover liquid from the pressure chamber; and a support member configured to support the plurality of recording element boards, the plurality of recording element boards being arrayed on the support member, the support member including a common supply channel extending in the first direction and configured to supply liquid to the supply openings of the plurality of recording element boards, and a common recovery channel extending in the first direction and configured to recover liquid from the recovery openings of the plurality of recording element boards.

Further features of the present invention will become apparent from the following description of exemplary embodiments with reference to the attached drawings.

DESCRIPTION OF THE EMBODIMENTS

Embodiments of the present invention will be described below with reference to the drawings. It should be understood that the description that follows does not restrict the scope of the present invention. As one example, a thermal system that discharges liquid by generating bubbles by a heat-generating element has been employed in the embodiments, but the present invention can be applied to liquid discharge heads employing piezoelectric and various other liquid discharge systems. The liquid discharge head according to the present invention that discharges liquid such as ink, and the liquid discharge apparatus having the liquid discharge head, are applicable to apparatuses such as printers, photocopiers, facsimile devices having communication systems, word processors having printer units, and so forth, and further to industrial recording apparatuses combined in a complex manner with various types of processing devices. For example, the present invention can be used in fabricating biochips, printing electronic circuits, fabricating semiconductor substrates, and other such usages.

Although the embodiments relate to an inkjet recording apparatus (or simply "recording apparatus") of a form where a liquid such as ink or the like is circulated between a tank and liquid discharge head, other forms may be used as well. For example, a form may be employed where, instead of circulating ink, two tanks are provided, one at the upstream side of the liquid discharge head and the other on the downstream side, and ink within the pressure chamber is caused to flow by running ink from one tank to the other. Also, the embodiments relate to a so-called line (page-wide) head that has a length corresponding to the width of the recording medium, but the present invention can also be a so-called serial liquid discharge head that records while scanning over the recording medium. An example of a serial liquid discharge head is one that has one recording element board each for recording black ink and for recording color ink, but this is not restrictive. An example of a serial liquid discharge head may be an arrangement where short line heads that are shorter than the width of the recording medium are formed, with multiple recording element boards arrayed so that orifices overlap in the discharge orifice row direction, these being scanned over the recording medium.

First Embodiment

Description of Inkjet Recording Apparatus

Figure 1:
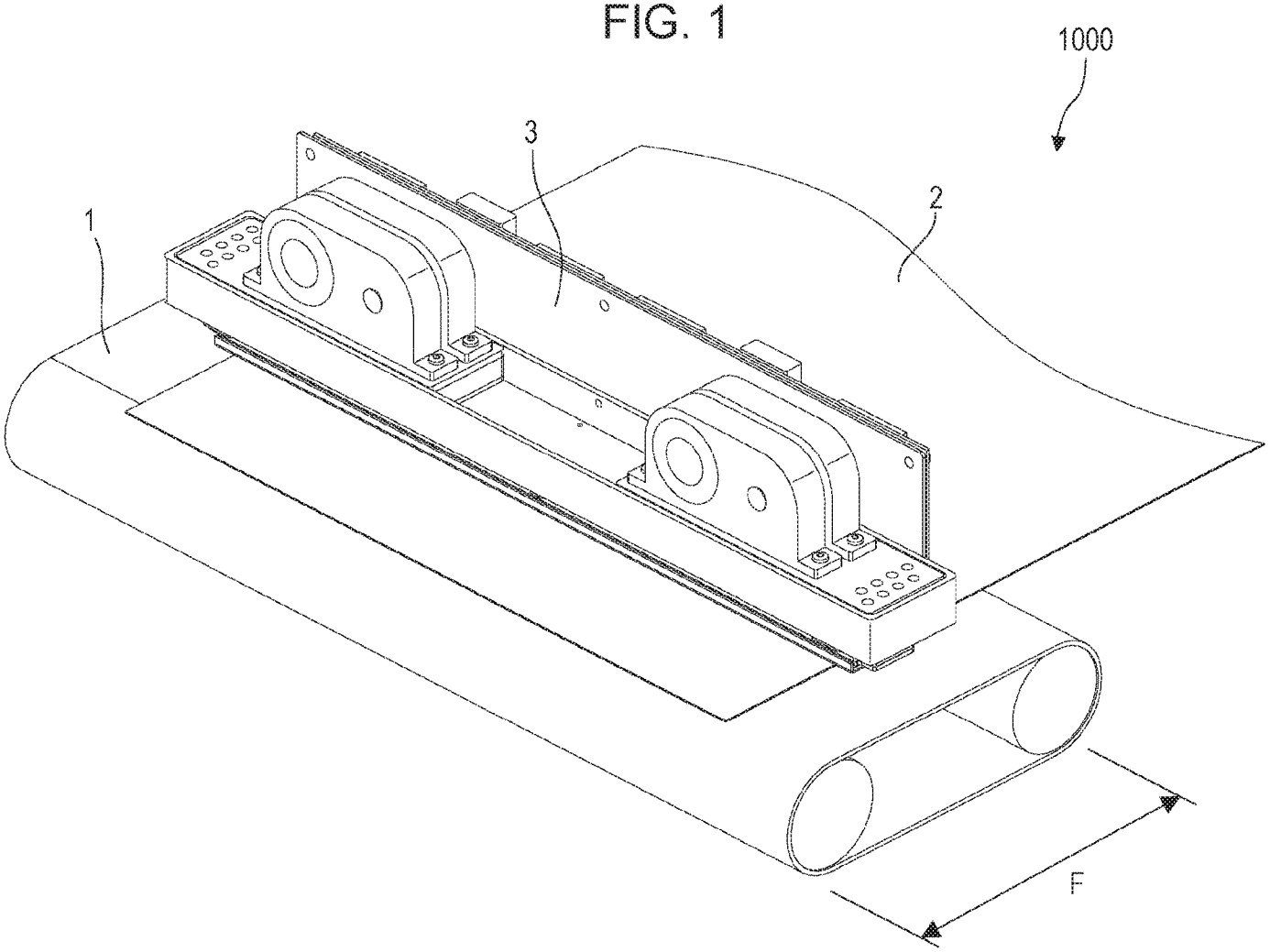
FIG. 1 is a diagram illustrating a schematic configuration of a recording apparatus according to a first embodiment of the present invention.

FIG. 1 illustrates a schematic configuration of a device that discharges liquid, and more particularly an inkjet recording apparatus 1000 (hereinafter also referred to simply as "recording apparatus") that performs recording by discharging ink. The recording apparatus 1000 has a conveyance unit 1 that conveys a recording medium 2, and a line type (page-wide) liquid discharge head 3 disposed generally orthogonal to the conveyance direction of the recording medium 2, and is a recording apparatus that performs single-pass continuous recording while continuously or intermittently conveying multiple recording mediums 2. The recording medium 2 is not restricted to cut sheets, and may be continuous roll sheets. The liquid discharge head 3 is capable of full-color printing by cyan, magenta, yellow, and black (acronym "CMYK") ink. Accordingly, a recording region F can be made smaller in comparison with a case where four liquid discharge heads that discharge monochrome ink are arrayed and used. Thus, the size of the recording apparatus 1000 can be reduced, and the probability of trouble occurring where the recording medium 2 deforms and interferes with the liquid discharge head 3 can be reduced. Also, the liquid discharge head 3 can discharge ink of multiple types, so there is no need to accurately array the relative positions among liquid discharge heads, which is necessary in a case of arraying four liquid discharge heads that discharge monochrome ink. The liquid discharge head 3 has a liquid supply unit serving as a supply path that supplies ink to the liquid discharge head 3, a main tank, and a buffer tank (see FIG. 2) connected by fluid connection, which will be described later. The liquid discharge head 3 is also electrically connected to an electric control unit that transmits electric power and discharge control signals to the liquid discharge head 3. Liquid paths and electric signal paths within the discharge head 3 will be described later.

Description of First Circulation Path

Figure 2:
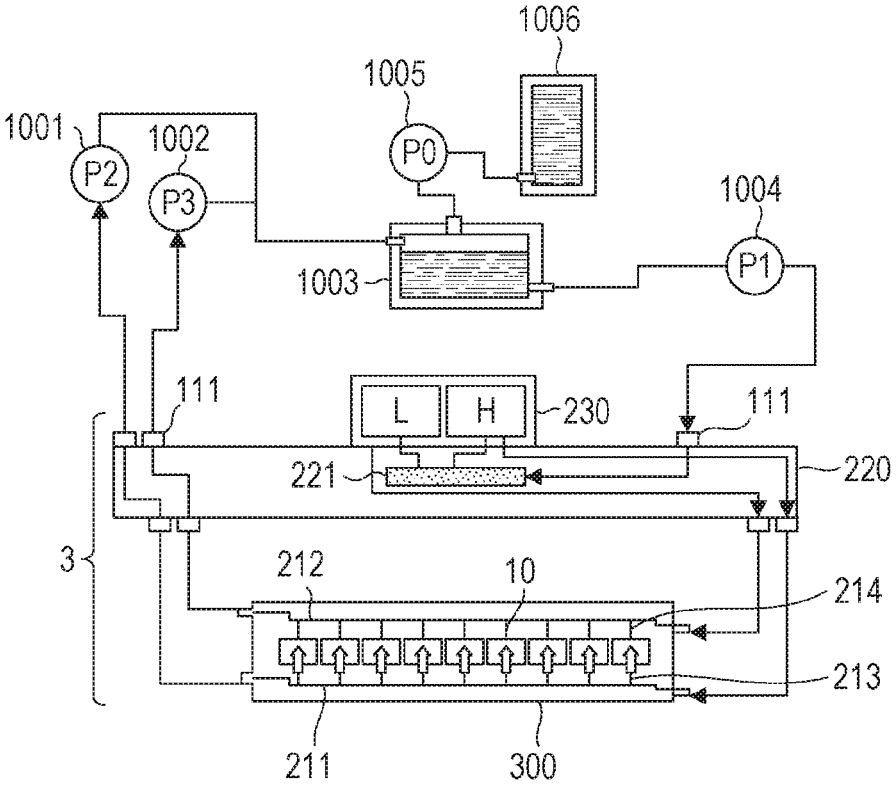
FIG. 2 is a diagram illustrating a first circulation path over which liquid circulates in the recording apparatus.

FIG. 2 is a schematic diagram illustrating a first circulation path that is a first form of a circulation path applied to the recording apparatus of the present embodiment. FIG. 2 is a diagram illustrating the liquid discharge head 3 connected to a first circulation pump (high-pressure side) 1001, a first circulation pump (low-pressure side) 1002 and a buffer tank 1003 and the like by fluid connection. Although FIG. 2 only illustrates the paths over which one color ink out of the CMYK ink flows, for the sake of brevity of description, in reality there are four colors worth of circulation paths provided to the liquid discharge head 3 and the recording apparatus main unit. The buffer tank 1003, serving as a sub-tank that is connected to a main tank 1006, has an atmosphere communication opening (omitted from illustration) whereby the inside and the outside of the tank communicate, and bubbles within the ink can be discharged externally. The buffer tank 1003 is also connected to a replenishing pump 1005. When ink is consumed at the liquid discharge head 3, the replenishing pump 1005 acts to send ink of an amount the same as that has been consumed from the main tank 1006 to the buffer tank 1003. Ink is consumed at the liquid discharge head 3 when discharging (ejecting) ink from the discharge orifices of the liquid discharge head 3, by discharging ink to perform recording, suction recovery, or the like, for example.

The two first circulation pumps 1001 and 1002 serving as a liquid supply unit act to extract ink from a fluid connector 111 of the liquid discharge head 3 and flow the ink to the buffer tank 1003. The first circulation pumps 1001 and 1002 preferably are positive-displacement pumps that have quantitative fluid sending capabilities. Specific examples may include tube pumps, gear pumps, diaphragm pumps, syringe pumps, and so forth. An arrangement may also be used where a constant flow is ensured by disposing a common-use constant-flow value and relief valve at the outlet of the pump, for example. When the liquid discharge head 3 is being driven, the first circulation pump (high-pressure side) 1001 and first circulation pump (low-pressure side) 1002 cause a constant amount of ink to flow through a common supply channel 211 and a common recovery channel 212. The amount of flow is preferably set to a level where temperature difference among recording element boards 10 of the liquid discharge head 3 does not influence recording image quality, or higher. On the other hand, if the flow rate is set excessively high, the effects of pressure drop in the channels within a liquid discharge unit 300 causes excessively large difference in negative pressure among the recording element boards 10, resulting in unevenness in density in the image. Accordingly, the flow rate is preferably set taking into consideration temperature difference and negative pressure difference among the recording element boards 10.

A negative pressure control unit 230 is provided between paths of a second circulation pump 1004 and the liquid discharge unit 300. Accordingly, the negative pressure control unit 230 functions such that the pressure downstream from the negative pressure control unit 230 (i.e., at the liquid discharge unit 300 side) can be maintained at a present constant pressure even in cases where the flow rate of the circulation system fluctuates due to difference in duty when recording. Any mechanism may be used as two pressure adjustment mechanisms making up the negative pressure control unit 230, as long as pressure downstream from itself can be controlled to fluctuation within a constant range or smaller that is centered on a desired set pressure. As one example, a mechanism equivalent to a so-called "pressure-reducing regulator" can be employed. In a case of using a pressure-reducing regulator, the upstream side of the negative pressure control unit 230 is preferably pressurized by the second circulation pump 1004 via a liquid supply unit 220, as illustrated in FIG. 2. This enables the effects of water head pressure as to the liquid discharge head 3 of the buffer tank 1003 to be suppressed, giving broader freedom in the layout of the buffer tank 1003 in the recording apparatus 1000. It is sufficient that the second circulation pump 1004 have a certain lift pressure or greater, within the range of the circulatory flow pressure of ink used when driving the liquid discharge head 3, and turbo pumps, positive-displacement pumps, and the like can be used. Specifically, diaphragm pumps or the like can be used. Alternatively, a water head tank disposed with a certain water head difference as to the negative pressure control unit 230, for example, may be used instead of the second circulation pump 1004.

As illustrated in FIG. 2, the negative pressure control unit 230 has two pressure adjustment mechanisms, with different control pressure from each other having been set. Of the two negative pressure adjustment mechanisms, the relatively high-pressure setting side (denoted by H in FIG. 2) and the relatively low-pressure setting side (denoted by L in FIG. 2) are respectively connected to the common supply channel 211 and the common recovery channel 212 within the liquid discharge unit 300 via the liquid supply unit 220. Provided to the liquid discharge unit 300 are individual supply channels 213 and individual recovery channels 214 communicating between the common supply channel 211, common recovery channel 212, and the recording element boards 10. Due to the individual supply channels 213 and 214 communicating with the common supply channel 211 and common recovery channel 212, flows occur where part of the ink flows from the common supply channel 211 through internal channels in the recording element board 10 and to the common recovery channel 212 (indicated by the arrows in FIG. 2). The reason is that the pressure adjustment mechanism H is connected to the common supply channel 211, and the pressure adjustment mechanism L to the common recovery channel 212, so a pressure difference is generated between the two common channels.

Thus, flows occur within the liquid discharge unit 300 where a part of the ink passes through the recording element boards 10 while ink flows through each of the common supply channel 211 and common recovery channel 212. Accordingly, heat generated at the recording element boards 10 can be externally discharged from the recording element boards 10 by the flows through the common supply channel 211 and common recovery channel 212. This configuration also enables ink flows to be generated at discharge orifices and pressure chambers not being used for recording while recording is being performed by the liquid discharge head 3, so thickening of the ink at such portions can be suppressed. Further, thickened ink and foreign substances in the ink can be discharged to the common recovery channel 212. Accordingly, the liquid discharge head 3 according to the present embodiment can record at high speed with high image quality.

Description of Second Circulation Path

Figure 3:
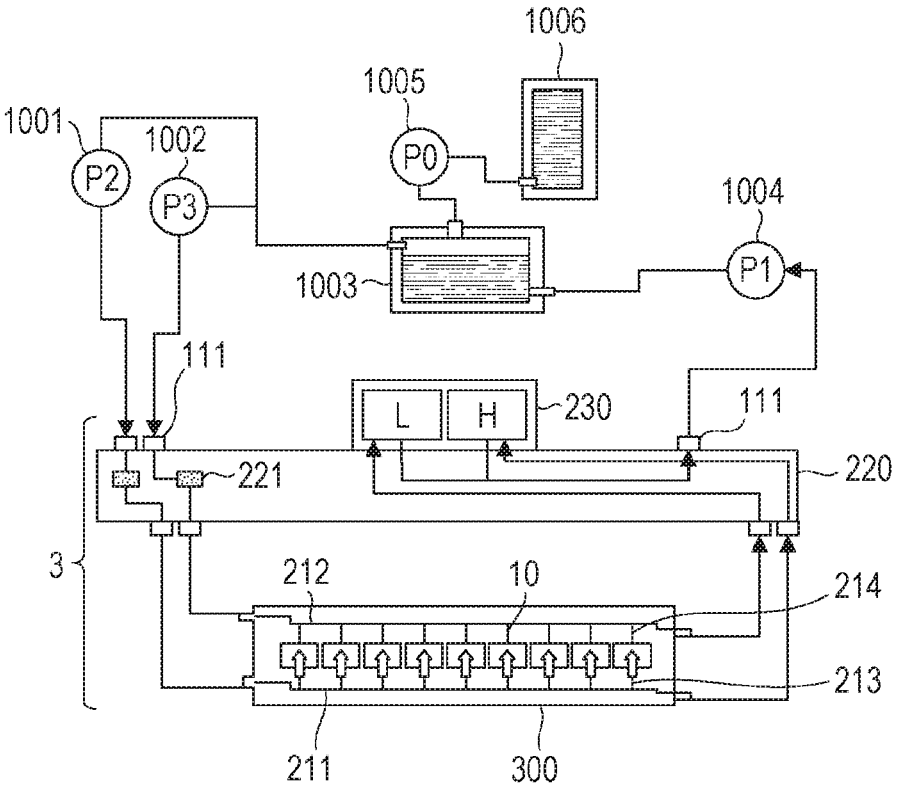
FIG. 3 is a diagram illustrating a second circulation path in the recording apparatus.

FIG. 3 is a schematic diagram illustrating, of circulation paths applied to the recording apparatus according to the present embodiment, a second circulation path that is a different circulation path from the above-described first circulation path. The primary points of difference as to the above-described first circulation path are as follows. First, both of the two pressure adjustment mechanisms making up the negative pressure control unit 230 have a mechanism (a mechanism part having operations equivalent to a so-called "backpressure regulator") to control pressure at the upstream side from the negative pressure control unit 230 to fluctuation within a constant range that is centered on a desired set pressure. The second circulation pump 1004 acts as a negative pressure source to depressurize the downstream side from the negative pressure control unit 230. Further, the first circulation pump (high-pressure side) 1001 and first circulation pump (low-pressure side) 1002 are disposed on the upstream side of the liquid discharge head 3, and the negative pressure control unit 230 is disposed on the downstream side of the liquid discharge head 3.

The negative pressure control unit 230 according to the second embodiment acts to maintain pressure fluctuation on the upstream side of itself (i.e., at the liquid discharge unit 300 side) within a constant range, even in cases where the flow rate fluctuates due to difference in recording duty when recording with the liquid discharge head 3. Pressure fluctuation is maintained within a constant range centered on a preset pressure, for example. The downstream side of the negative pressure control unit 230 is preferably pressurized by the second circulation pump 1004 via the liquid supply unit 220, as illustrated in FIG. 3. This enables the effects of water head pressure of the buffer tank 1003 as to the liquid discharge head 3 to be suppressed, giving a broader range of selection for the layout of the buffer tank 1003 in the recording apparatus 1000. Alternatively, a water head tank disposed with a certain water head difference as to the negative pressure control unit 230, for example, may be used instead of the second circulation pump 1004.

The negative pressure control unit 230 illustrated in FIG. 3 has two pressure adjustment mechanisms, with different control pressure from each other having been set, in the same way as the first embodiment. Of the two negative pressure adjustment mechanisms, the relatively high-pressure setting side (denoted by H in FIG. 3) and the relatively low-pressure setting side (denoted by L in FIG. 3) are respectively connected to the common supply channel 211 and the common recovery channel 212 within the liquid discharge unit 300 via the liquid supply unit 220. The pressure of the common supply channel 211 is made to be relatively higher than the pressure of the common recovery channel 212 by the two negative pressure adjustment mechanisms. According to this configuration, flows occur where ink flows from the common supply channel 211 through individual channels 213 and 214 and internal channels in the recording element board 10 to the common recovery channel 212 (indicated by the arrows in FIG. 3). The second circulation path thus yields an ink flow state the same as that of the first circulation path within the liquid discharge unit 300, but has two advantages that are different from the case of the first circulation path.

One advantage is that, with the second circulation path, the negative pressure control unit 230 is disposed on the downstream side of the liquid discharge head 3, so there is little danger that dust and foreign substances generated at the negative pressure control unit 230 will flow into the head. A second advantage is that the maximum value of the necessary flow rate supplied from the buffer tank 1003 to the liquid discharge head 3 can be smaller in the second circulation path as compared to the case of the first circulation path. The reason is as follows. The total flow rate within the common supply channel 211 and common recovery channel 212 when circulating during recording standby will be represented by A. The value of A is defined as the smallest flow rate necessary to maintain the temperature difference in the liquid discharge unit 300 within a desired range in a case where temperature adjustment of the liquid discharge head 3 is performed during recording standby. Also, the discharge flow rate in a case of discharging ink from all discharge orifices of the liquid discharge unit 300 (full discharge) is defined as F. Accordingly, in the case of the first circulation path (FIG. 2), the set flow rate of the first circulation pump (high-pressure side) 1001 and the first circulation pump (low-pressure side) 1002 is A, so the maximum value of the liquid supply amount to the liquid discharge head 3 necessary for full discharge is A+F.

On the other hand, in the case of the second circulation path (FIG. 3), the liquid supply amount to the liquid discharge head 3 necessary at the time of recording standby is flow rate A. This means that the supply amount to the liquid discharge head 3 that is to the liquid discharge head 3 necessary for full discharge is flow rate F. Accordingly, in the case of the second circulation path, the total value of the set flow rate of the first circulation pump (high-pressure side) 1001 and the first circulation pump (low-pressure side) 1002, i.e., the maximum value of the necessary supply amount, is the larger value of A and F. Thus, the maximum value of the necessary supply amount in the second circulation path (A or F) is always smaller than the maximum value of the necessary supply amount in the first circulation path (A+F), as long as the liquid discharge unit 300 of the same configuration is used. Consequently, the degree of freedom regarding circulatory pumps that can be applied is higher in the case of the second circulation path. This is advantageous in that, for example, low-cost circulatory pumps having simple structure can be used, the load on a cooler (omitted from illustration) disposed on the main unit side path can be reduced, thereby reducing costs of the recording apparatus main unit. This advantage is more pronounced with line heads where the values of A or F are relatively great, and is more useful the longer the length of the line head is in the longitudinal direction.

However, on the other hand, there are points where the first circulation path is more advantageous than the second circulation path. That is to say, with the second circulation path, the flow rate flowing through the liquid discharge unit 300 at the time of recording standby is maximum, so the lower the recording duty of the image is, the greater a negative pressure is applied to the nozzles. Accordingly, particularly in a case where the channel widths of the common supply channel 211 and common recovery channel 212 (the length in a direction orthogonal to the direction of flow of ink) is reduced to reduce the head width (the length of the liquid discharge head in the transverse direction), high negative pressure is applied to the nozzles in low-duty images where unevenness is conspicuous. This may result in more influence of satellite droplets. On the other hand, high negative pressure is applied to the nozzles when forming high-duty images in the case of the first circulation path, so any generated satellites are less conspicuous, which is advantageous in that influence on the image quality is small. Which of these two circulation paths is more preferable can be selected in light of the specifications of the liquid discharge head and recording apparatus main unit (discharge flow rate F, smallest circulatory flow rate A, and channel resistance within the head).

Description of Third Circulation Path

Figure 30:
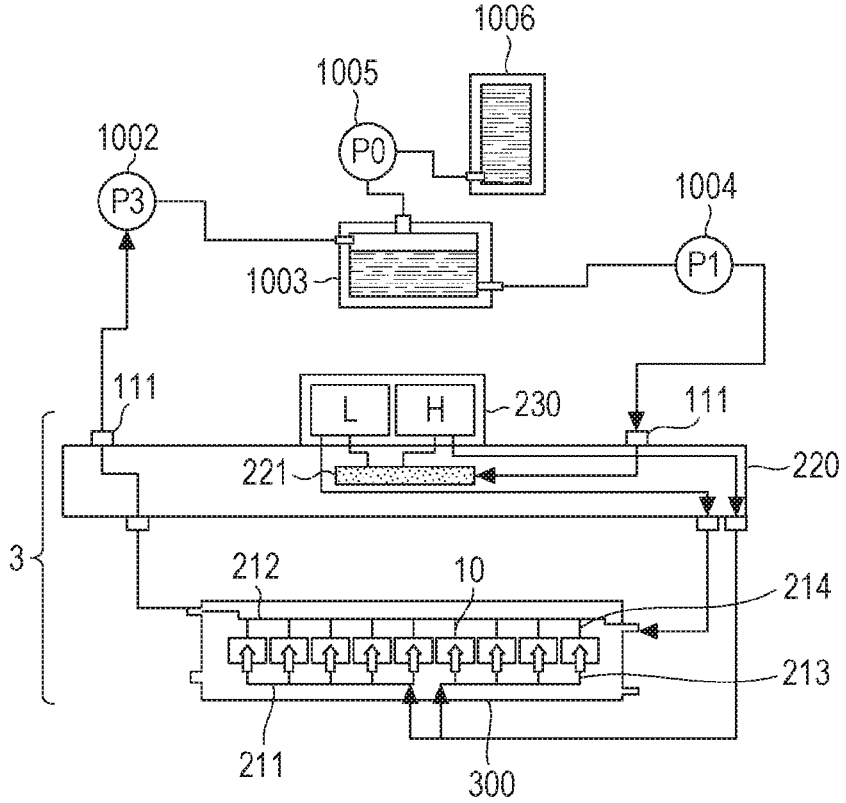
FIG. 30 is a diagram illustrating a third circulation path.

FIG. 30 is a schematic diagram illustrating a third circulation path that is a first form of a circulation path applied to the recording apparatus according to the present invention. Description of functions and configurations the same as the above-described first and second circulation paths will be omitted, and description is be made primarily regarding points of difference.

Liquid is supplied to inside of the liquid discharge head 3 from two places at the middle of the liquid discharge head 3, and one end side of the liquid discharge head 3, for a total of three places. The liquid passes from the common supply channel 211 through pressure chambers 23 then recovered by the common recovery channel 212, and thereafter is externally recovered from a recovery opening at the other end of the liquid discharge head 3. Individual channels 213 and 214 communicate with the common supply channel 211 and common recovery channel 212, with the recording element boards 10 and the pressure chambers 23 disposed within the recording element boards 10 being provided on the paths of the individual channels 213 and 214. Accordingly, flows occur where part of the liquid which the first circulation pump 1002 pumps flows from the common supply channel 211 through pressure chambers 23 in the recording element boards 10 and to the common recovery channel 212 (indicated by the arrows in FIG. 30). The reason is that pressure difference is formed between the pressure adjustment mechanism H connected to the common supply channel 211, and the pressure adjustment mechanism L to the common recovery channel 212, and the first circulation pump 1002 is connected to just the common recovery channel 212.

Thus, a flow of liquid that passes through the common recovery channel 212, and a flow that passes from the common supply channel 211 through the pressure chambers 23 in the recording element boards 10 and flows to the common recovery channel 212, are formed in the liquid discharge unit 300. Accordingly, heat generated at the recording element boards 10 can be externally discharged from the recording element boards 10 by the flow from the common supply channel 211 to the common recovery channel 212, while suppressing increase of pressure loss. Also, according to the present circulation path, the number of pumps serving as liquid conveyance units can be reduced as compared with the first and second circulation paths described above.

Description of Configuration of Liquid Discharge Head

Figure 4A:
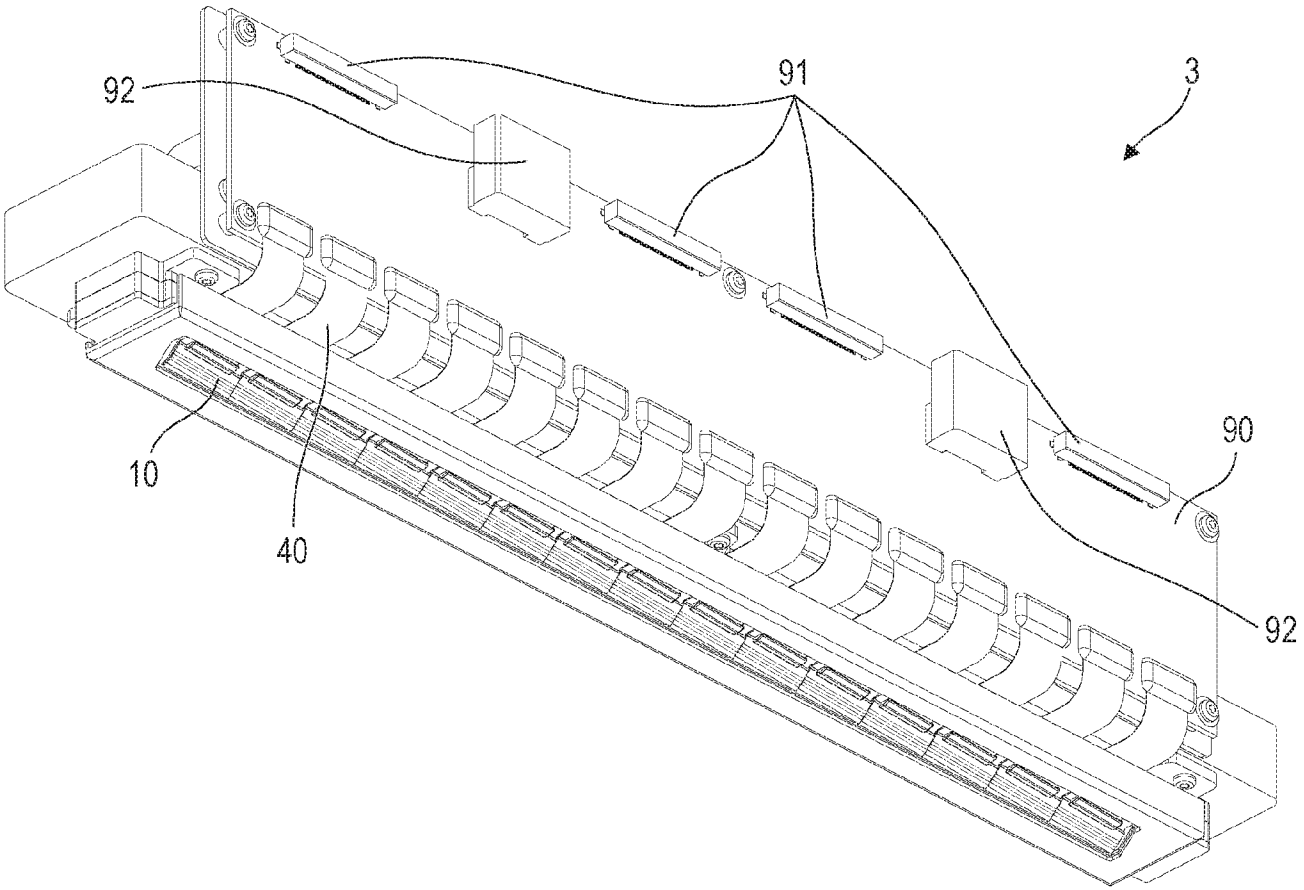
FIGS. 4A and 4B are perspective diagrams of a liquid discharge head according to the first embodiment of the present invention.
Figure 4B:
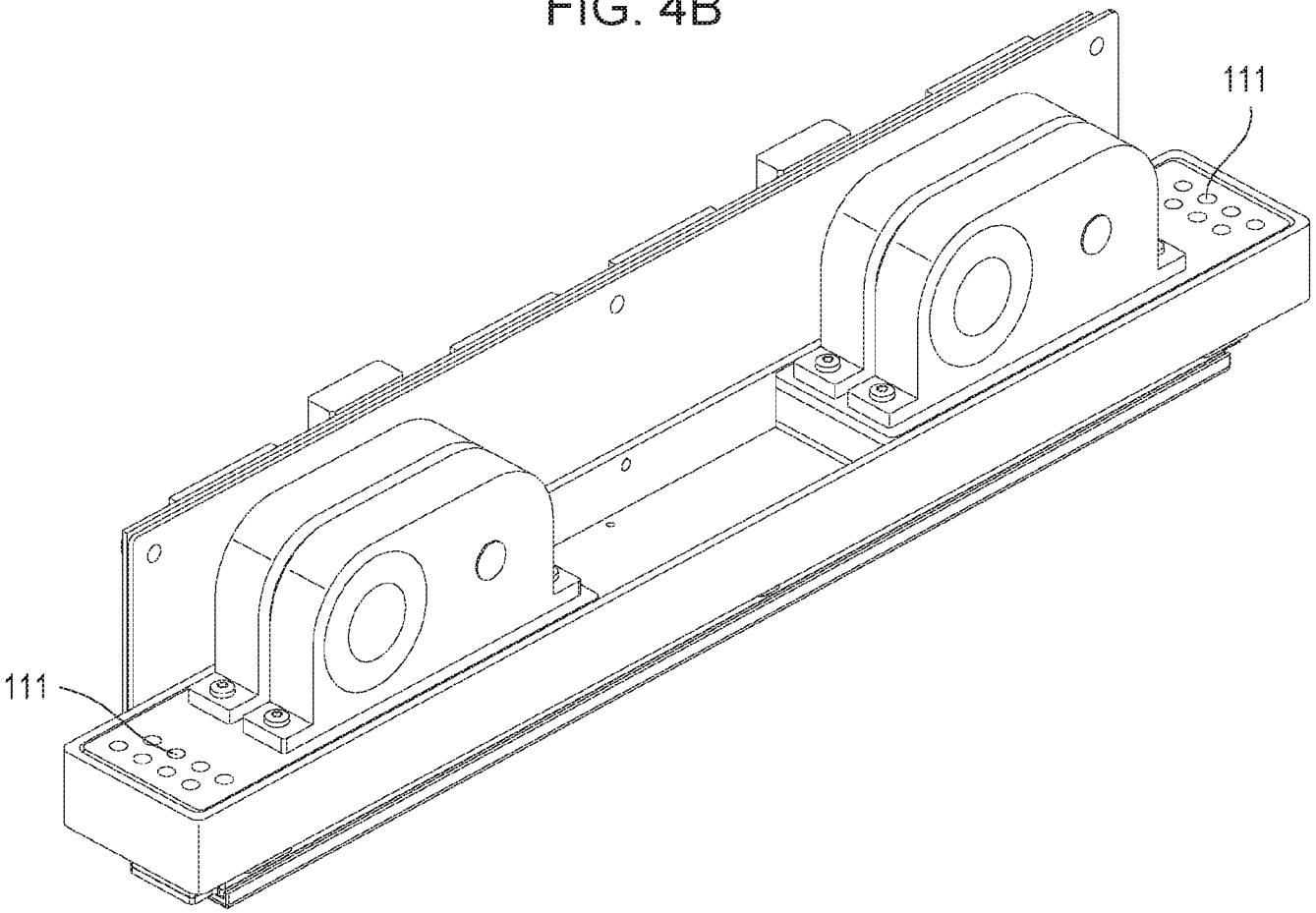

The configuration of the liquid discharge head 3 according to the first embodiment will be described. FIGS. 4A and 4B are perspective views of the liquid discharge head 3 according to the present embodiment. The liquid discharge head 3 is a line-type liquid discharge head where fifteen recording element boards 10 capable of discharging ink of the four colors of C, M, Y, and K are arrayed on a straight line (inline layout). The liquid discharge head 3 includes the recording element boards 10, and signal input terminals 91 and power supply terminals 92 that are electrically connected via flexible printed circuit boards 40 and an electric wiring board 90, as illustrated in FIG. 4A. The electric wiring board 90 receives image data for recording and electric power necessary for driving from the recording apparatus 1000, and supplies to the recording element boards 10. The electric wiring board 90 has multiple layers of circuits formed on a substrate of glass epoxy or the like. The electric wiring board 90 has connection terminals 93 for electric connection to the terminals 42 of the flexible printed circuit boards 40. The terminals are connected by wire bonding or outer lead bonding (OLD) or the like, and the connected portions are sealed by a sealant. The connection terminals 93 and signal input terminals 91 or power supply terminals 92 are connected by wiring within the board. Circuit design is performed such that the number of signal input terminals 91 or power supply terminals 92 is smaller than the total number of connection terminals 93, to facilitate ease of work when mounting or detaching the liquid discharge head 3. The signal input terminals 91 and power supply terminals 92 are electrically connected to a control unit of the recording apparatus 1000, and each supply the recording element boards 10 with discharge drive signals and electric power necessary for discharge. Consolidating wiring by electric circuits in the electric wiring board 90 enables the number of signal input terminals 91 and power supply terminals 92 to be reduced in comparison with the number of recording element boards 10. This enables reducing the number of electric connection portions that need to be removed when assembling the liquid discharge head 3 to the recording apparatus 1000 or when exchanging the liquid discharge head 3. Liquid connection portions 111 provided to both ends of the liquid discharge head 3 are connected with the liquid supply system of the recording apparatus 1000, as illustrated in FIG. 4B. Thus, ink of the four colors of CMYK is supplied to the liquid discharge head 3, and ink that has passed through the liquid discharge head 3 is recovered to the supply system of the recording apparatus 1000. In this way, ink of each color can circulate over the path of the recording apparatus 1000 and the path of the liquid discharge head 3.

Figure 5:
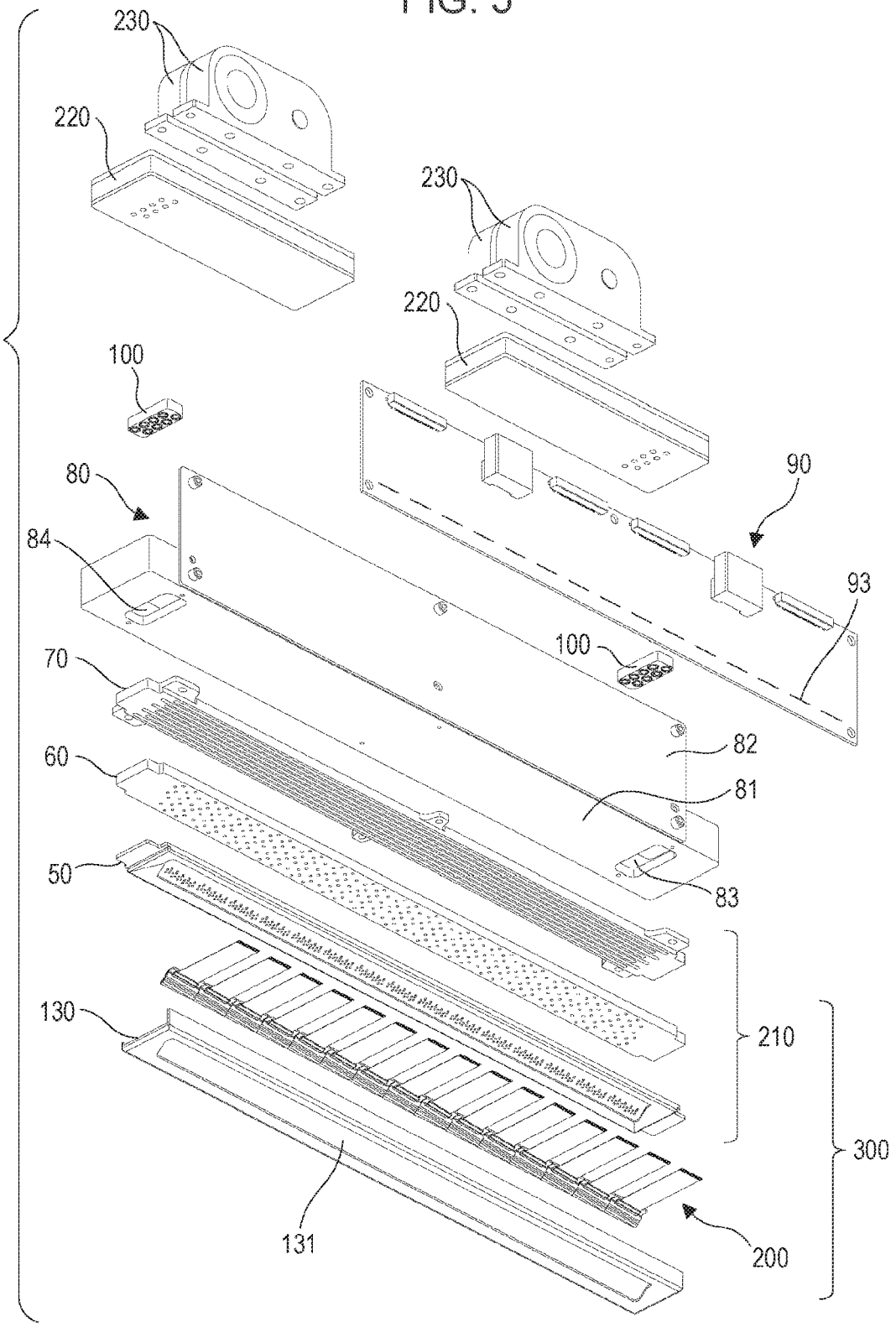
FIG. 5 is a disassembled perspective view of the liquid discharge head in FIGS. 4A and 4B.

FIG. 5 illustrates a disassembled perspective view of parts and units making up the liquid discharge head 3. The liquid discharge unit 300, liquid supply units 220, and electric wiring board 90 are attached to a case 80. The liquid connection portions 111 (FIG. 3) are provided to the liquid supply unit 220, and filters 221 (FIGS. 2 and 3) for each color, that communicate with each opening of the liquid connection portions 111 to remove foreign substances in the supplied ink, are provided inside the liquid supply units 220. Two liquid supply units 220 are each provided with filters 221 for two colors. The inks that have passed through the filters 221 are supplied to the respective negative pressure control units 230 provided on the corresponding liquid supply units 220. Each negative pressure control unit 230 is a unit made up of a pressure adjustment valve for its respective color. The negative pressure control units 230 markedly attenuate change in pressure drop in the supply system of the recording apparatus 1000 (supply system on the upstream side of the liquid discharge head 3) occurring due to fluctuation in the flow rate of ink, by the operations of valve and spring members and the like provided therein. Accordingly, the negative pressure control units 230 are capable of stabilizing change of negative pressure at the downstream side from themselves (liquid discharge unit 300 side) within a certain range. Each negative pressure control unit 230 for each color has two pressure adjustment values built in, as described in FIG. 2. These pressure adjustment valves are each set to different control pressures, and communicate with the liquid supply unit 220 via the common supply channel 211 in the liquid discharge unit 300 in the case of the high-pressure side and via the common recovery channel 212 in the case of the low-pressure side.

The case 80 is configured including a liquid discharge unit support member 81 and electric wiring board support member 82, and supports the liquid discharge unit 300 and electric wiring board 90 as well as securing rigidity of the liquid discharge head 3. The electric wiring board support member 82 is for supporting the electric wiring board 90, and is fixed by being screwed to the liquid discharge unit support member 81. The liquid discharge unit support member 81 serves to correct warping and deformation of the liquid discharge unit 300, and thus secure relative positional accuracy of the multiple recording element boards 10, thereby suppressing unevenness in the recorded article. Accordingly, the liquid discharge unit support member 81 preferably has sufficient rigidity. Examples of suitable materials include metal materials such as stainless steel and aluminum, ceramics such as alumina, and resin material to which an inorganic filler has been added. The liquid discharge unit support member 81 has openings 83 and 84 into which joint rubber members 100 are inserted. Ink supplied from a liquid supply unit 220 passes through a joint rubber member 100 and is guided to a third channel member 70 which is a part making up the liquid discharge unit 300.

The liquid discharge unit 300 is made up of multiple discharge modules 200 and a channel member 210, and a cover member 130 is attached to the face of the liquid discharge unit 300 that faces the recording medium. The cover member 130 is a member having a frame-shaped surface where a long opening 131 is provided as illustrated in FIG. 5, and is formed of metal such as stainless steel or aluminum or the like, or of a resin material or the like. The recording element boards 10 included in the discharge module 200 and a sealing member 110 (FIG. 9A) are exposed from the opening 131. The frame portion on the perimeter of the opening 131 functions as a contact surface for a cap member that caps off the liquid discharge head 3 when in recording standby. Accordingly, a closed space is preferably formed when capping, by coating the perimeter of the opening 131 with an adhesive agent, sealant, filling member, or the like, to fill in roughness and gaps on the discharge orifice face of the liquid discharge unit 300.

Next, description will be made regarding the configuration of the channel member 210 included in the liquid discharge unit 300. The channel member 210 is an article formed by laminating a first channel member 50, a second channel member 60, and the third channel member 70, and is a support member that supports multiple recording element boards 10 (common support member). The channel member 210 distributes the ink supplied from the liquid supply unit 220 to each of the discharge modules 200, and returns ink recirculating from the discharge modules 200 to the liquid supply unit 220. The channel member 210 is fixed to the liquid discharge unit support member 81 by screws. This suppresses warping and deformation of the channel member 210 by attaching to the rigid case 80, so flatness of the face joining to the discharge module 200 can be ensured. This makes leaks and the like less likely to occur at the joint, so the members can be enjoined with a high level of reliability. Increased flatness also enables the discharge orifice forming faces of the discharge module 200 to be made uniform more easily. Accordingly, variance in landing positions of droplets discharged when recording can be suppressed, and high image quality recording can be realized.

Figure 6A:
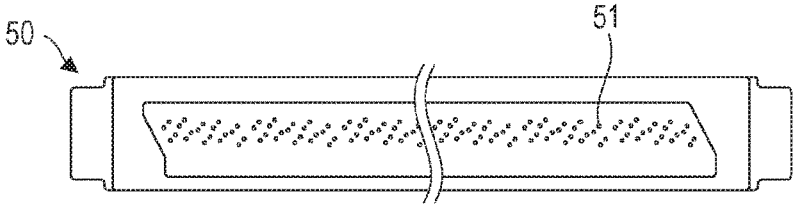
FIGS. 6A through 6F are diagrams illustrating the configuration of first through third channel members making up a channel member that the liquid discharge head in FIGS. 4A and 4B has.
Figure 6B:
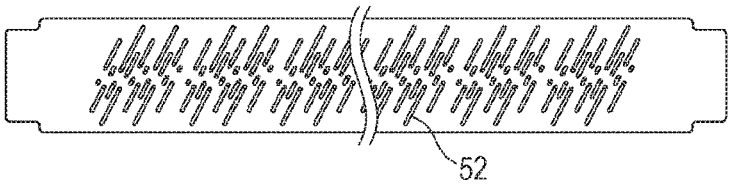
Figure 6C:
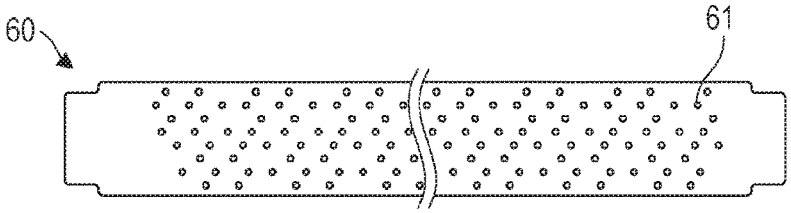
Figure 6D:
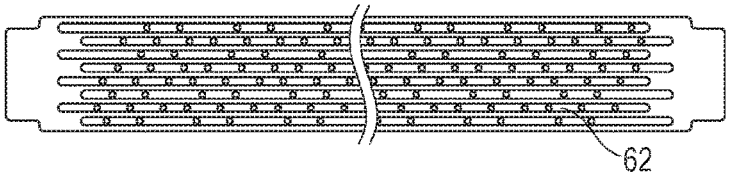
Figure 6E:
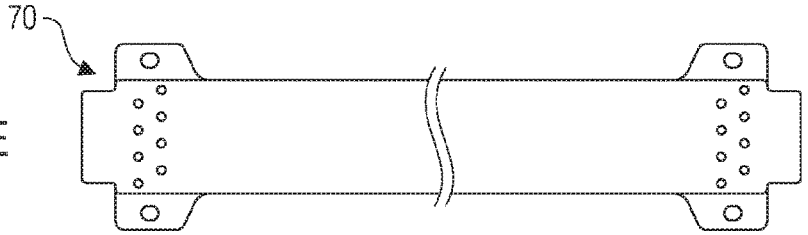
Figure 6F:
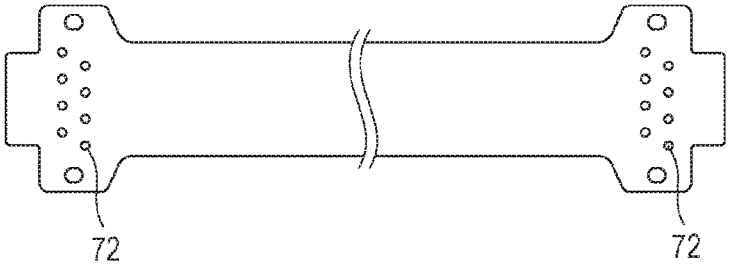
Figure 7:
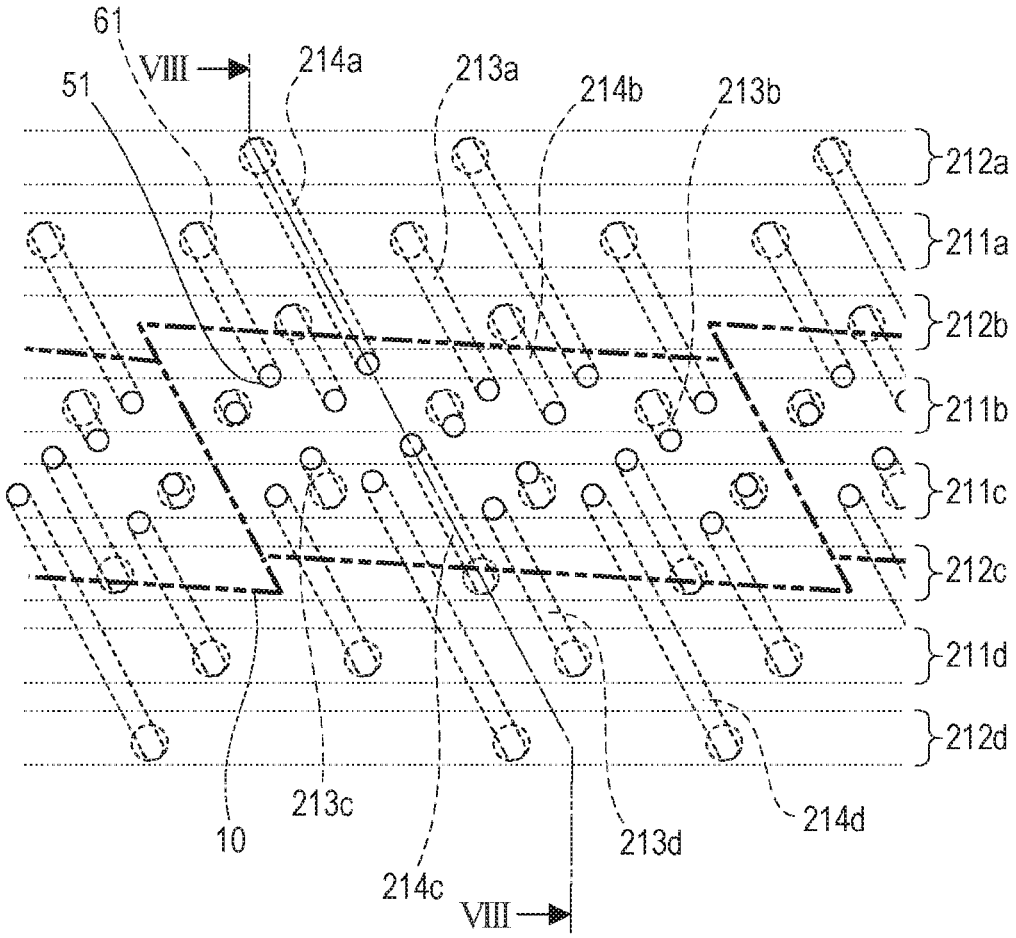
FIG. 7 is a diagram for describing connection relationships between channels within the channel member.

FIGS. 6A through 6F are diagrams illustrating the front and rear sides of the channel members making up the first through third channel members. FIG. 6A illustrates the side of the first channel member 50 on which the discharge modules 200 are mounted, and FIG. 6F illustrates the face of the third channel member 70 that comes in contact with the liquid discharge unit support member 81. The first channel member 50 and second channel member 60 have mutually adjoining channel member contact faces, illustrated in FIGS. 6B and 6C respectively, as do the second channel member 60 and third channel member 70 as illustrated in FIGS. 6D and 6E. The adjoining second channel member 60 and third channel member 70 have formed thereupon common channel grooves 62, when facing each other, form eight common channels extending in the longitudinal direction of the channel members. This forms a set of common supply channels 211 and common recovery channels 212 for each of the colors within the channel member 210 (FIG. 7). Communication ports 72 of the third channel member 70 communicate with the holes in the joint rubber members 100, so as to communicate with the liquid supply unit 220 by fluid connection. Multiple communication ports 61 are formed on the bottom face of the common channel grooves 62 of the second channel member 60, communicating with one end of individual channel grooves 52 of the first channel member 50. Communication ports 51 are formed at the other end of the individual channel grooves 52 of the first channel member 50 so as to communicate with the multiple discharge modules 200 by fluid connection via the communication ports 51. These individual channel grooves 52 allow the channels to be consolidated at the middle of the channel member.

The first through third channel members preferably are corrosion-resistant as to the ink, and formed from a material having a low linear expansion coefficient for joining to the support member 30. Examples suitable materials include polyphenyl sulfide (PPS), denatured polyphenylene ether (PPE), liquid crystal polymer (LCP), and composite materials where inorganic filler such as silica or glass or the like has been added to a base material such as polysulfone (PSF) or denatured polyphenylene ether (PPE). The first through third channel members may be molded by injection modulating using these materials. The first through third channel members may be resin molded members (resin members). The channel member 210 may be formed by laminating the three channel members and adhering using an adhesive agent, or in a case of selecting a composite material for the material, the three channel members may be joined by fusing. A case where the materials of the first through third channel members is the same is preferable, since there is almost no stress on the joining portion due to difference in linear thermal expansion coefficient, so reliability of joining can be improved. In a case where the materials of the first through third channel members are not the same, the reliability of the joining can be maintained by using materials which have linear thermal expansion properties that are about the same. To say that the linear thermal expansion properties that are about the same means that the values of linear thermal expansion properties are within a range of give or take 10%. Although the channel member 210 has been described as being formed by joining multiple parts, the present invention is not restricted to this example. For example, the channel member 210 may be formed of alumina where green sheets are layered and integrated.

Next, the connection relationship of the channels within the channel member 210 will be described with reference to FIG. 7. FIG. 7 is a partially enlarged transparent view of channels within the channel member 210 formed by joining the first through third channel members, as viewed from the side of the first channel member 50 on which the discharge modules 200 are mounted. The channel member 210 has, for each color, common supply channels 211 (211*a*, 211*b*, 211*c*, and 211*d*) and common recovery channels 212 (212*a*, 212*b*, 212*c*, and 212*d*) extending on the longitudinal direction of the liquid discharge head 3. Multiple individual supply channels 213 (213*a*, 213*b*, 213*c*, and 213*d*) formed of the individual channel grooves 52 are connected to the common supply channels 211 of each color via the communication ports 61. Multiple individual recovery channels 214 (214*a*, 214*b*, 214*c*, and 214*d*) formed of the individual channel grooves 52 are connected to the common recovery channels 212 of each color via the communication ports 61. This channel configuration enables ink to be consolidated at the recording element boards 10 situated at the middle of the channel members, from the common supply channels 211 via the individual supply channels 213. Ink can also be recovered from the recording element boards 10 to the common recovery channels 212 via the individual recovery channels 214.

Figure 8:
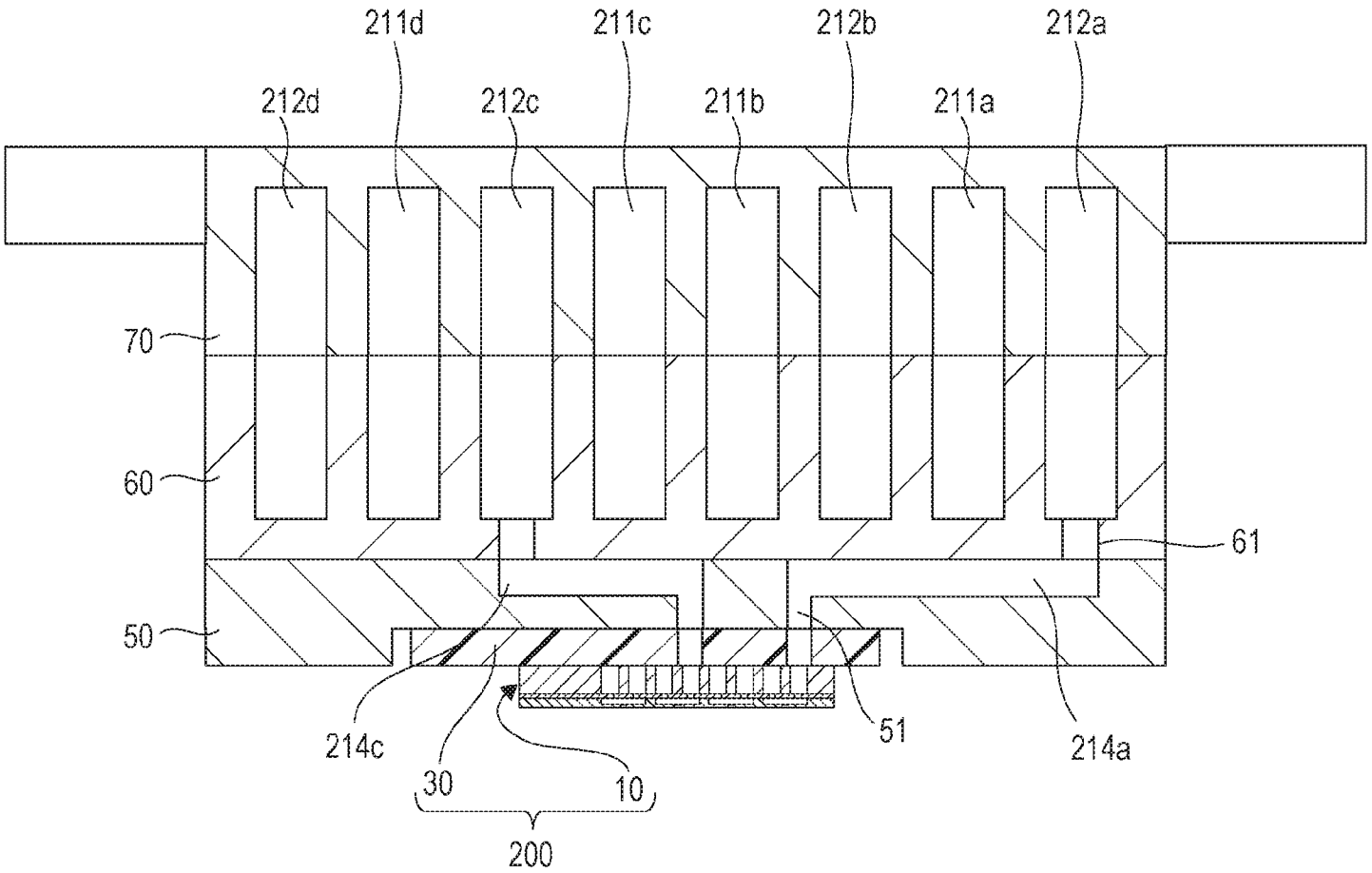
FIG. 8 is a cross-sectional view taken along line VIII-VIII in FIG. 7.

FIG. 8 is a cross-sectional view taken along line VIII-VIII in FIG. 7, illustrating that individual recovery channels (214*a* and 214*c*) communicate with the discharge module 200 via the communication ports 51. Although FIG. 8 only illustrates the individual recovery channels (214*a* and 214*c*), the individual supply channels 213 and the discharge module 200 communicate at a different cross-section, as illustrated in FIG. 7. Channels for supplying ink from the first channel member 50 to recording elements 15 (FIG. 10B), provided to the recording element board 10, are formed in a support member 30 included in the discharge module 200 and the recording element boards 10. Further, channels for recovering (recirculating) part or all of the ink supplied to the recording elements 15 to the first channel member 50 are formed in the support member 30 and recording element boards 10. The common supply channels 211 of each color is connected to the negative pressure control unit 230 (high-pressure side) of the corresponding color via its liquid supply unit 220, and the common recovery channels 212 are connected to the negative pressure control units 230 (low-pressure side) via the liquid supply units 220. The negative pressure control units 230 generate pressure difference between the common supply channels 211 and common recovery channels 212. Accordingly, a flow occurs for each color in the liquid discharge head 3 according to the present embodiment where the channels are connected as illustrated in FIGS. 7 and 8, in the order of common supply channel 211→individual supply channels 213→recording element board 10→individual recovery channels 214→common recovery channel 212. In the recording element board 10, the ink flows from a liquid supply channel 18 to near the discharge orifices 13 and to the liquid recovery channel 19.

Description of Discharge Module

Figure 9A:
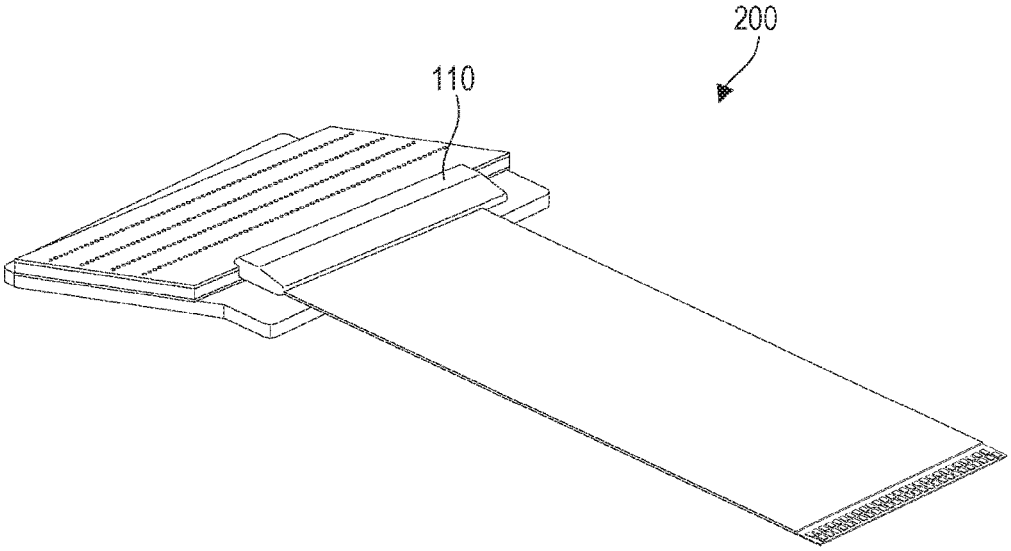
FIGS. 9A and 9B are diagrams illustrating a discharge module, FIG. 9A being a perspective view and FIG. 9B a disassembled view.
Figure 9B:
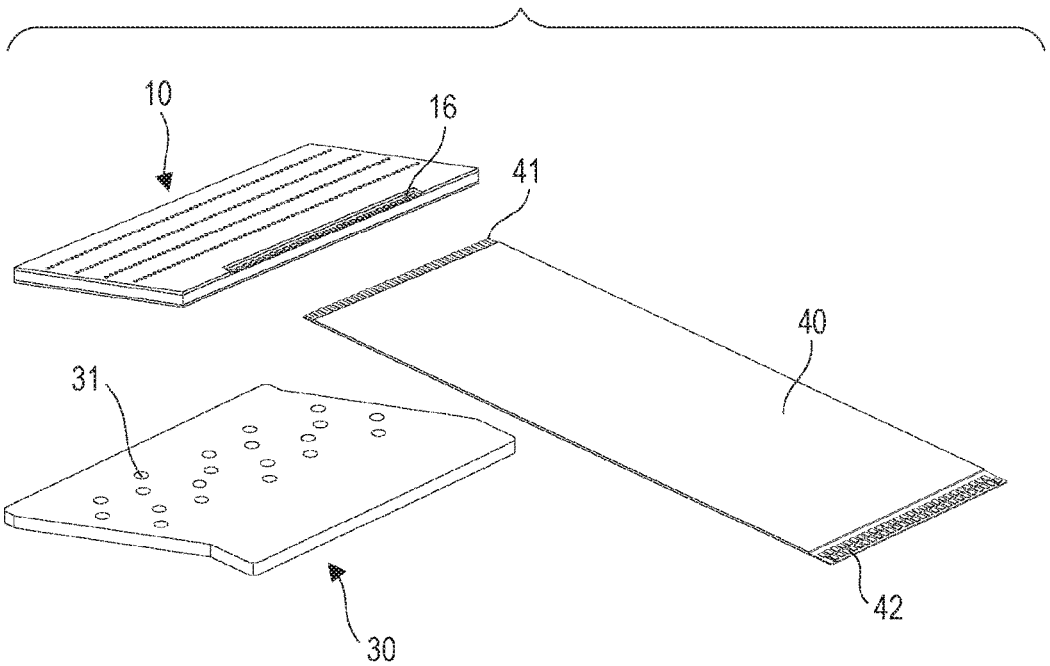

FIG. 9A illustrates a perspective view of one discharge module 200, and FIG. 9B illustrates a disassembled view thereof. The method of manufacturing the discharge module 200 is as follows. First, a recording element board 10 and flexible printed circuit board 40 are adhered to a support member 30 (individual support member) in which liquid communication ports 31 have been formed beforehand. Subsequently, terminals 16 on the recording element board 10 are electrically connected to terminals 41 on the flexible printed circuit board 40 by wire bonding, following which the wire-bonded portion (electric connection portion) is covered by a sealant to form the sealant 110. Terminals 42 at the other end of the flexible printed circuit board 40 from the recording element board 10 are electrically connected to connection terminals 93 (FIG. 5) of the electric wiring board 90. The flexible printed circuit boards 40 are wiring members that supply drive signals and drive power sent from the recording apparatus 1000 to the recording element board 10, with wires formed on a resin film of polyimide or the like. Terminals 41 that connect to the recording element board 10 and terminals 42 that connect to the electric wiring board 90 are provided on the ends of the flexible printed circuit boards 40. The support member 30 is a support member that supports the recording element board 10, and also is a channel member communicating between the recording element board 10 and the channel member 210 by fluid connection. Accordingly, the support member 30 should have a high degree of flatness, and also should be able to be joined to the recording element board 10 with a high degree of reliability. Examples of suitable materials include alumina and resin materials.

The printing width of the liquid discharge head 3 can be set to a desired width by arraying and joining multiple discharge modules 200 on the channel member 210. Also, arraying multiple channel members 210 enables electric connection inspection to be performed for each discharge module 200 where only good articles are selected and used in products, so yield can be improved over a case where an integrated article is manufactured. 15 discharge modules 200 are used in the present embodiment, arrayed in a straight line (inline), thereby forming a liquid discharge head 3 that has an overall printing width of 12 inches.

Description of Structure of Recording Element Board

Figure 10A:
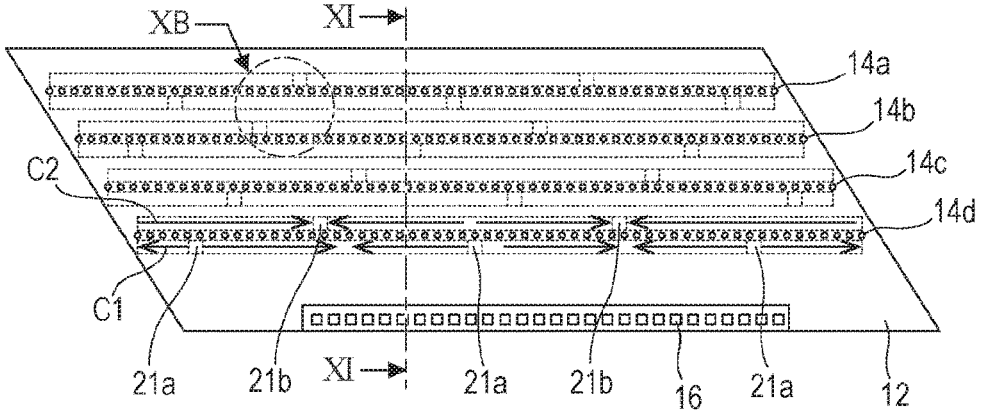
FIGS. 10A through 10C are diagrams illustrating the configuration of a recording element board.
Figure 10B:
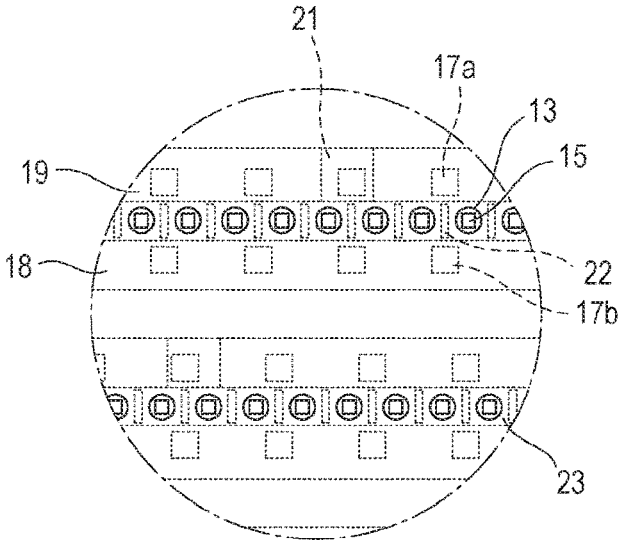
Figure 10C:
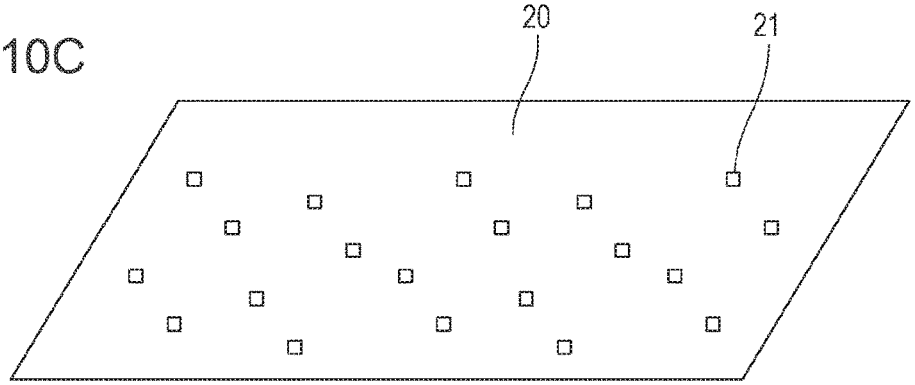

The configuration of the recording element board 10 according to the embodiment will be described. FIG. 10A is a plan view of the side of the recording element board 10 on which discharge orifices 13 have been formed, FIG. 10B is an enlarged view of the portion indicated by XB in FIG. 10A, and FIG. 10C is a plan view of the rear face of the recording element board 10 from that in FIG. 10A. The recording element board 10 has a discharge orifice forming member 12, where four discharge orifice rows corresponding to the ink colors are formed, as illustrated in FIG. 10A. The discharge orifices 13 preferably are formed with high precision by photolithography process, using photosensitive resin material or the like for the discharge orifice forming member 12, for accurate landing of ink of the recording medium. Note that hereinafter, the direction in which the discharge orifice rows, where multiple discharge orifices 13 are arrayed, extend, will be referred to as "discharge orifice row" direction.

The recording elements 15 that generate thermal energy used to discharge ink, are disposed at positions corresponding to the discharge orifices 13, as illustrated in FIG. 10B. Pressure chambers 23 that contain the recording elements 15 are sectioned off by partitions 22. The recording elements 15 are electrically connected to the terminals 16 in FIG. 10A by electric wiring (omitted from illustration) provided to the recording element board 10. The recording elements 15 generate heat to cause the ink to boil, based on pulse signals input from a control circuit of the recording apparatus 1000, via the electric wiring board 90 (FIG. 5) and flexible printed circuit board 40 (FIG. 9). The force of bubbling due to this boiling discharges ink from the discharge orifices 13. A liquid supply channel 18 extends along one side of each discharge orifice row, and a liquid recovery channel 19 along the other, as illustrated in FIG. 10B. The liquid supply channels 18 and liquid recovery channels 19 are channels extending in the direction of the discharge orifice rows provided on the recording element board 10, and communicate with the discharge orifices 13 via supply ports 17*a* and recovery ports 17*b*, respectively.

Figure 11:
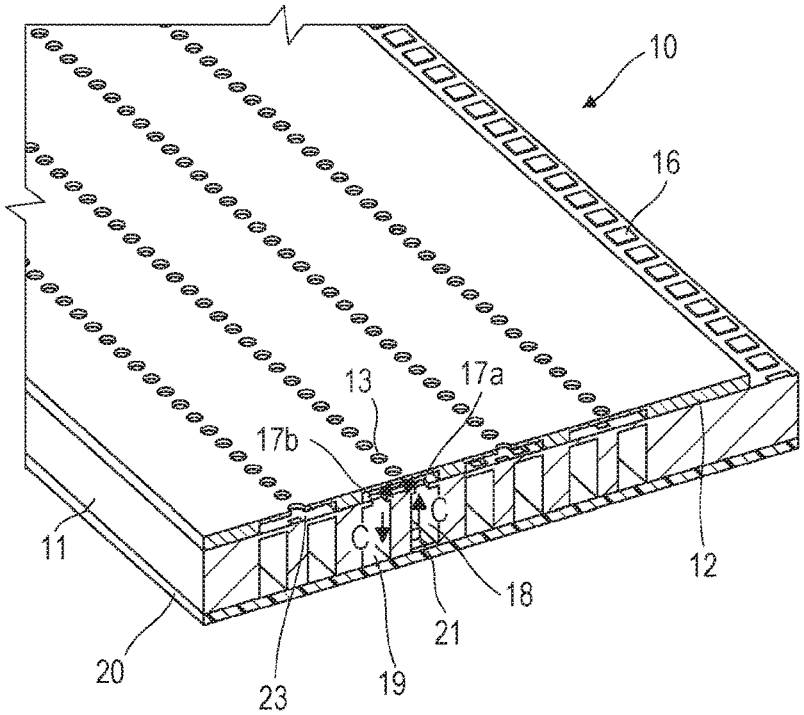
FIG. 11 is a perspective view illustrating the configuration of the recording element board including cross-section XI-XI in FIG. 10A and a cover.

A sheet-shaped cover 20 is laminated on the rear face from the face of the recording element board 10 on which the discharge orifices 13 are formed, the cover 20 having multiple openings 21 communicating with the liquid supply channel 18 and liquid recovery channel 19 which will be described later, as illustrated in FIGS. 10C and 11. The openings 21 include supply openings 21*a* that supply liquid to the liquid supply channel 18, and openings 21*b* that recover liquid from the liquid recovery channel 19. In the embodiment, three openings 21 are provided in the cover 20 for each liquid supply channel 18, and two openings 21 are provided for each liquid recovery channel 19. The openings 21 of the cover 20 communicate with the multiple communication ports 51 illustrated in FIG. 6A, as illustrated in FIG. 10B. The cover 20 functions as a lid of the liquid supply channel 18 and liquid recovery channel 19, by converting grooves formed on the substrate 11 of the recording element board 10 making up part of the liquid supply channel 18 and liquid recovery channel 19, as illustrated in FIG. 11. The cover 20 preferably is sufficiently corrosion-resistant as to the ink, and has to have a high degree of precision regarding the opening shapes of the openings 21 and the positions thereof from the perspective of color mixture prevention. Accordingly, a photosensitive resin material or silicon plate is preferably used as the material for the cover 20, with the openings 21 being formed by photolithography process. The cover 20 thus is for converting the pitch of channels by the openings 21. The cover 20 preferably is thin, taking into consideration pressure drop, and preferably is formed of a photosensitive resin film material.

Next, the flow of ink within the recording element board 10 will be described. FIG. 11 is a perspective view, illustrating a cross-section of the recording element board 10 and cover 20 taken along plane XI-XI in FIG. 10A. The recording element board 10 is formed by laminating the substrate 11 formed of silicon (Si) and the discharge orifice forming member 12 formed of a photosensitive resin, with the cover 20 joined on the rear face of the substrate 11. The recording elements 15 are formed on the other face side of the substrate 11 (FIG. 10B) with the grooves making up the liquid supply channels 18 and liquid recovery channels 19 extending along the discharge orifice rows being formed at the reverse side thereof. The liquid supply channels 18 and liquid recovery channels 19 formed by the substrate 11 and cover 20 are respectively connected to the common supply channels 211 and common recovery channels 212 within the channel member 210 via the individual supply channels 213 and individual recovery channels 214. There is differential pressure between the liquid supply channels 18 and liquid recovery channels 19. Ink is supplied to one discharge orifice row from three supply openings 21*a*, and the ink flows in a direction indicated by arrow C1 in FIG. 10A in the plane direction of the liquid supply channel 18. When recording is performed by discharging ink from the multiple discharge orifices 13 of the liquid discharge head 3, a flow of around several mm/sec to several tens of mm/sec is generated near the discharge orifices 13 not performing discharge operations due to the pressure difference between the liquid supply channels 18 and liquid recovery channels 19. The pressure difference between the liquid supply channels 18 and liquid recovery channels 19 is, for example, several tens of mmAq to several hundreds of mmAq. That is to say, the ink in the liquid supply channel 18 provided within the substrate 11 is the flow indicated by the arrows C in FIG. 11, flowing through the supply port 17*a*, the pressure chamber 23, and the recovery port 17*b*, to the liquid recovery channel 19. The ink that has been recovered to the liquid recovery channel 19 then flows in planar fashion in the direction indicated by the arrow C2 in FIG. 10A, and is recovered through two recovery openings 21*b* to the channel member 210. This flow enables ink that has thickened due to evaporation from the discharge orifices 13, bubbles, foreign substance, and so forth, to be recovered to the liquid recovery channel 19 from the discharge orifices 13 and pressure chambers 23 where recording is not being performed. This also enables thickening of ink at the discharge orifices 13 and pressure chambers 23 to be suppressed. Ink recovered to the liquid recovery channels 19 is recovered in the order of the communication ports 51 in the channel member 210, the individual recovery channels 214, and the common recovery channel 212, via the openings 21 of the cover 20 and the liquid communication ports 31 of the support member 30 (including supply liquid communication ports and recovery liquid communication ports) (see FIG. 9B). This ink is ultimately recovered to the supply path of the recording apparatus 1000.

That is to say, ink supplied from the recording apparatus main unit to the liquid discharge head 3 is supplied and recovered by flowing in the order described below. First, the ink flows from the liquid connection portions 111 of the liquid supply unit 220 into the liquid discharge head 3. The ink then is supplied to the joint rubber members 100, communication ports 72 provided to the third channel member 70, common channel grooves 62 and communication ports 61 provided to the second channel member 60, and individual channel grooves 52 and communication ports 51 provided to the first channel member 50. Thereafter, the ink is supplied to the pressure chambers 23 in the order of the communication ports 31 provided to the support member 30, the openings 21 provided to the cover 20, and the liquid supply channels 18 and supply ports 17*a* provided to the substrate 11. Ink that has been supplied to the pressure chambers 23 but not discharged from the discharge orifices 13 flows in the order of the recovery ports 17*b* and liquid recovery channels 19 provided to the substrate 11, the openings 21 provided to the cover 20, and the communication ports 31 provided to the support member 30. Thereafter, the ink flows in the order of the communication ports 51 and individual channel grooves 52 provided to the first channel member 50, the communication ports 61 and common channel grooves 62 provided to the second channel member 60, the communication ports 72 provided to the third channel member 70, and the joint rubber members 100. The ink further flows outside of the liquid discharge head 3 from the liquid connection portions 111 provided to the liquid supply unit. In the first circulation path illustrated in FIG. 2, ink that has flowed in from the liquid connection portions 111 passes through the negative pressure control unit 230 and then is supplied to the joint rubber members 100. In the second circulation path illustrated in FIG. 3, ink recovered from the pressure chambers 23 passes through the joint rubber members 100, and then flows out of the liquid discharge head 3 from the liquid connection portions 111 via the negative pressure control unit 230.

Also, not all ink flowing in from one end of the common supply channel 211 of the liquid discharge unit 300 is supplied to the pressure chamber 23 via the individual supply channels 213*a*, as illustrated in FIGS. 2 and 3. There is ink that flows from the other end of the common supply channel 211 and through the liquid supply unit 220 without ever entering the individual supply channels 213*a*. Thus, providing channels where ink flows without going through the recording element board 10 enables backflow in the circulatory flow of ink to be suppressed, even in a case where the recording element board 10 has fine channels where the flow resistance is great, as in the case of the present embodiment. Accordingly, the liquid discharge head according to the present embodiment is capable of suppressing thickening of ink in pressure chambers and nearby the discharge orifices, thereby suppressing deviation of discharge from the normal direction and non-discharge of ink, so high image quality recording can be performed as a result.

Description of Positional Relationship Among Recording Element Boards

Figure 12:
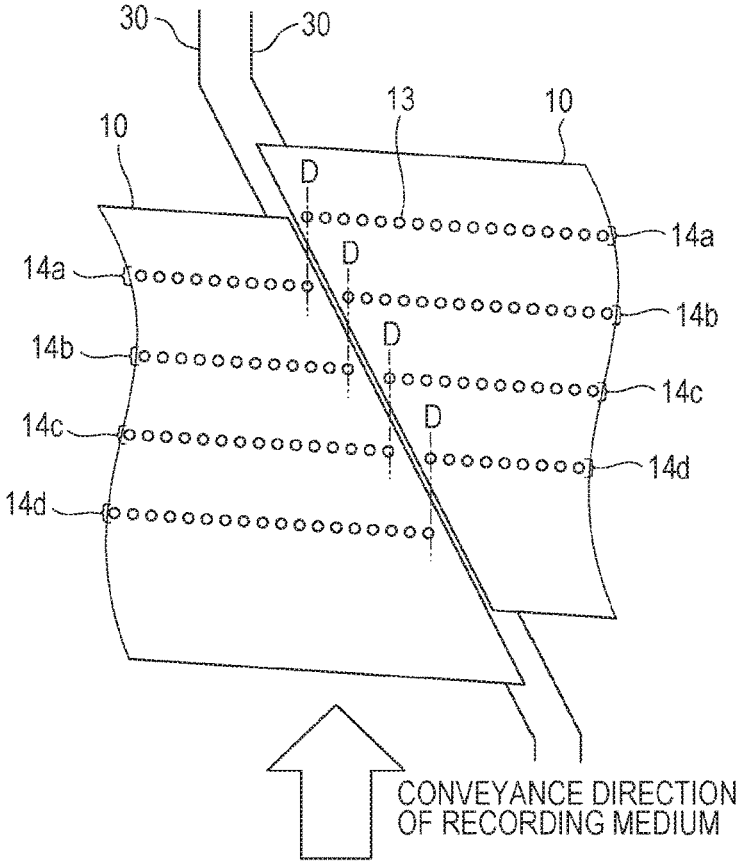
FIG. 12 is a plan view showing a partially enlarged illustration of adjacent portions of recording element boards in two adjacent discharge modules.

FIG. 12 is a plan view illustrating a partial enlargement of adjacent portions of recording element boards 10 for two adjacent discharge modules. The recording element boards 10 according to the present embodiment are shaped as parallelograms, as illustrated in FIGS. 10A through 10C. The discharge orifice rows (14*a* through 14*d*) where discharge orifices 13 are arrayed on the recording element boards 10 are dispose inclined to the conveyance direction of the recording medium by a certain angle, as illustrated in FIG. 12. At least one discharge orifice of discharge orifice rows at adjacent portions of the recording element board 10 is made to overlap in the conveyance direction of the recording medium thereby. In FIG. 12, two discharge orifices on the lines D are in a mutually overlapping relationship. This layout enables black streaks and blank portions in the recorded image to be made less conspicuous by driving control of the overlapping discharge orifices, even in a case where the positions of the recording element board 10 are somewhat deviated from the predetermined position. The configuration illustrated in FIG. 12 can be used even in a case where the multiple recording element boards 10 are laid out in a straight line (inline) instead of in a staggered arrangement. Thus, black streaks and blank portions at overlapping portions between the recording element boards 10 can be handled while suppressing increased length of the liquid discharge head 3 in the conveyance direction of the recording medium. Although the shape of the primary face of the recording element board 10 according to the present discharge orifice row is a parallelogram, this is not restrictive. The configuration of the present invention can be suitably applied even in cases where the shape is a rectangle, a trapezoid, or another shape. The dimensions of the support members 30 are such that the ends thereof are more recessed than the ends of the recording element boards 10. Accordingly, the support members 30 do not interfere when arraying the recording element boards 10 in close proximity. Multiple discharge modules 200 are arrayed at relative positional precision of several microns to several tens of microns, using a mounter device. Accordingly, then the multiple discharge modules 200 are arrayed, the discharge orifice rows 14*a* through 14*d* formed on the recording element boards 10 are precisely arrayed. This enables two or more types of ink to be precisely landed on the recording medium 2, so high image quality recording can be performed.

The liquid supply unit 220 and negative pressure control units 230 are selected into two and attached at both ends of the liquid discharge head 3 in the longitudinal direction, with two negative pressure control units 230 being arrayed in tandem in the transverse direction of the liquid discharge head 3. It can be seen from FIG. 11 that the multiple common supply channels 211 include common supply channels 211 where the direction in which the ink flows is opposite. The ink flows through the negative pressure control units 230 disposed in a separated manner in the longitudinal direction of the liquid discharge head 3, and through the common supply channels 211 formed in the channel member 210, such that ink of two colors flows in one direction and ink of the other two colors flows in the other direction in the present embodiment. Advantages of this configuration are as follows.

Figure 21:
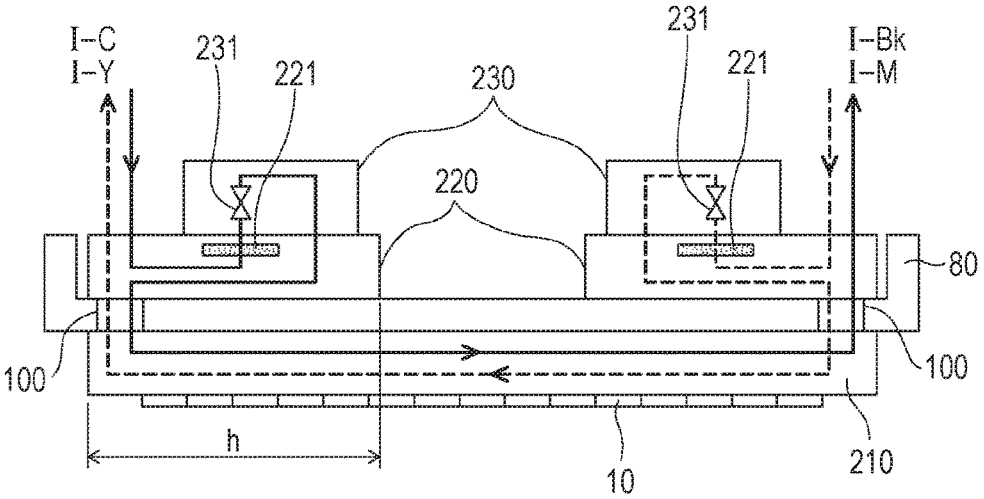
FIG. 21 is a schematic diagram illustrating the flow of ink inside a liquid discharge head.

A first advantage is that the pressure drop in the channels can be reduced. In the arrangement illustrated in FIG. 21 where the liquid supply units 220 and negative pressure control units 230 are disposed on both ends of the liquid discharge head 3, the reciprocal channels through the liquid supply units 220 can be minimized. Accordingly, a large pump does not need to be mounted to the recording apparatus 1000 main unit, and there is no need to enlarge the cross-sectional area of the channels an increase the size of the liquid discharge head 3 in order to reduce pressure drop in the channels.

A second advantage is that the reliability of joining the liquid supply units 220 and case 80 can be improved. The liquid supply unit 220 is formed using resin material, but there are cases where a filter is fused to the liquid supply unit 220, so filler addition preferably is minimal, or not added at all. Accordingly, the linear thermal expansion coefficient of the liquid supply unit 220 is larger than that of the case 80 formed using stainless steel or aluminum or the like. As a result, in a case where the liquid discharge head 3 where these different types of materials have been enjoined is subjected to temperature change, stress acts on the screw fixing portions due to the difference in the linear thermal expansion coefficients. As described above, the liquid supply units 220 and the channel member 210 are fixed to the case 80 by screws, with a seal formed between the two part by the joint rubber 100 interposed therebetween. Accordingly, the sealing reliability between the liquid supply units 220 and the channel member 210 may be lost if the screwed portions between the liquid supply units 220 and the case 80 loosen under stress. Reducing a joining region h by separating the liquid supply units 220 and negative pressure control units 230 into two and placing at different positions in the longitudinal direction of the liquid discharge head 3 enables the stress received under temperature change to be reduced. Accordingly, a liquid discharge head that does not readily leak even under temperature change can be realized.

Description of Modification of Liquid Discharge Head Configuration

Figure 29:
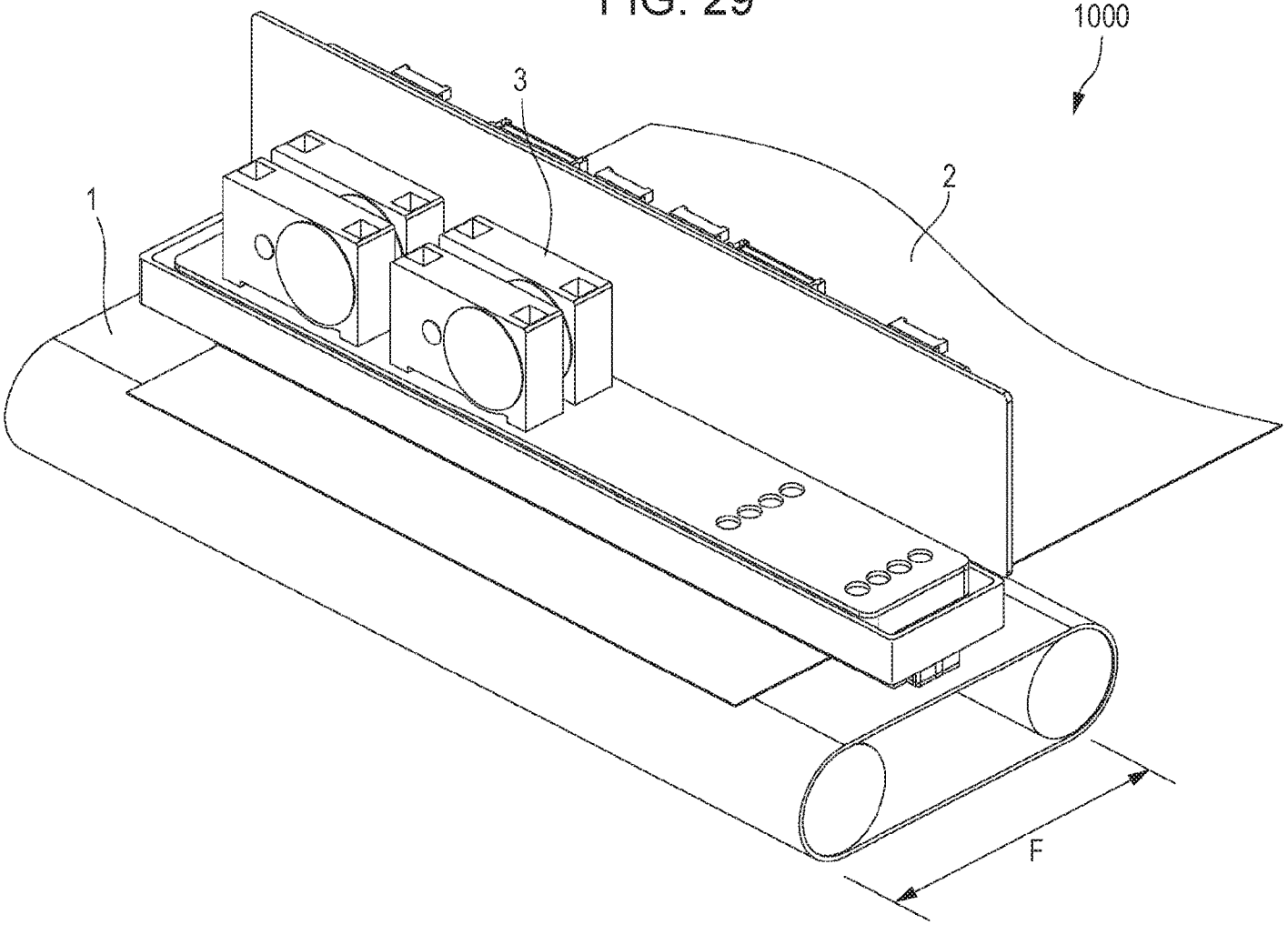
FIG. 29 is a diagram illustrating the recording apparatus according to the first embodiment.
Figure 31A:
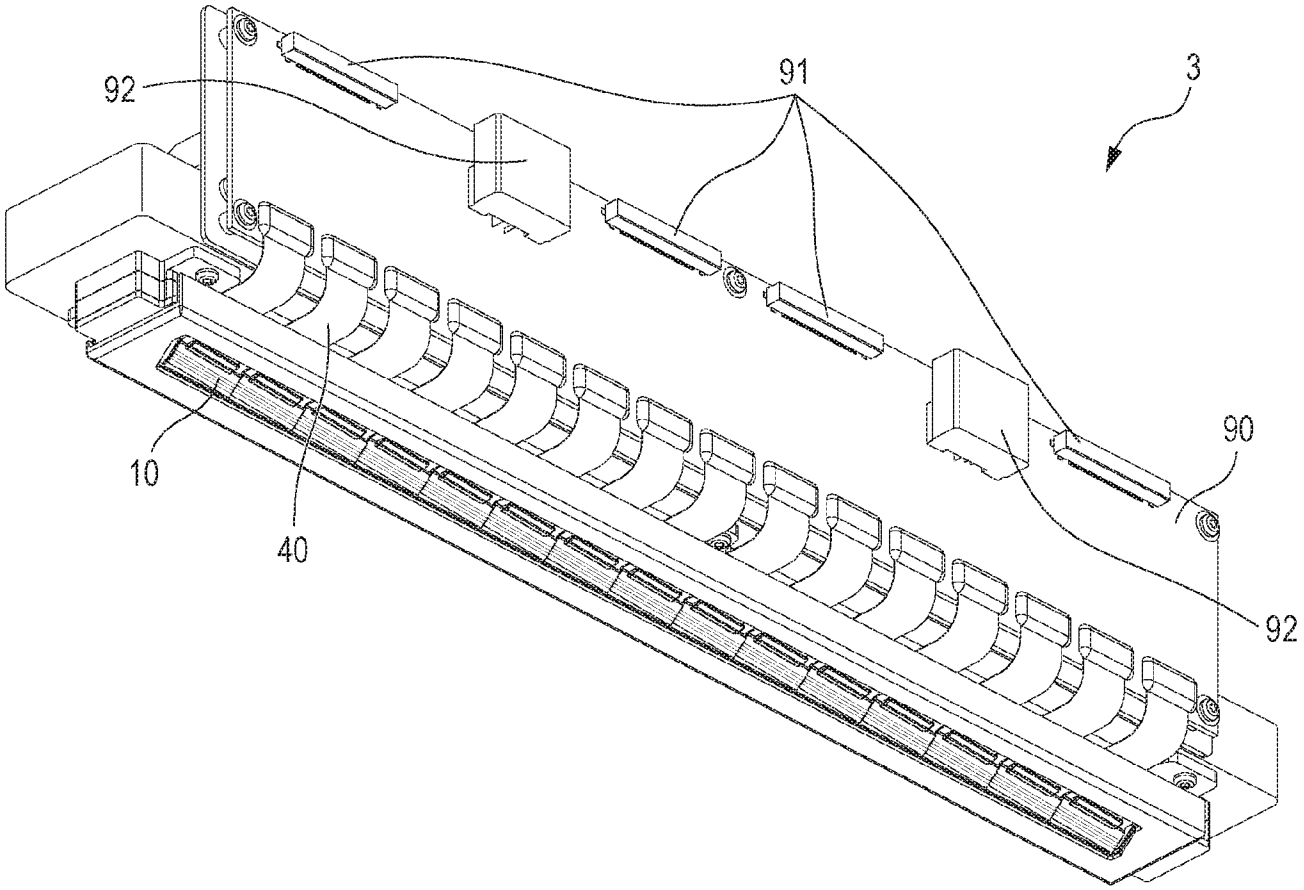
FIGS. 31A and 31B are diagrams illustrating a modification of the liquid discharge head according to the first embodiment.
Figure 31B:
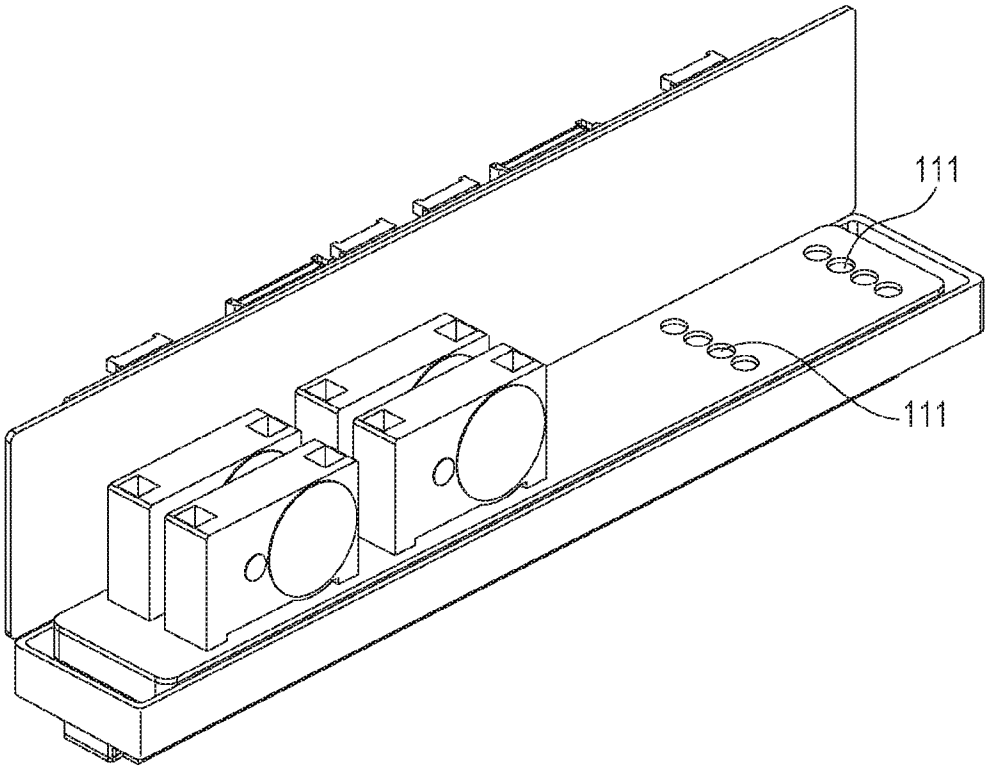
Figure 32:
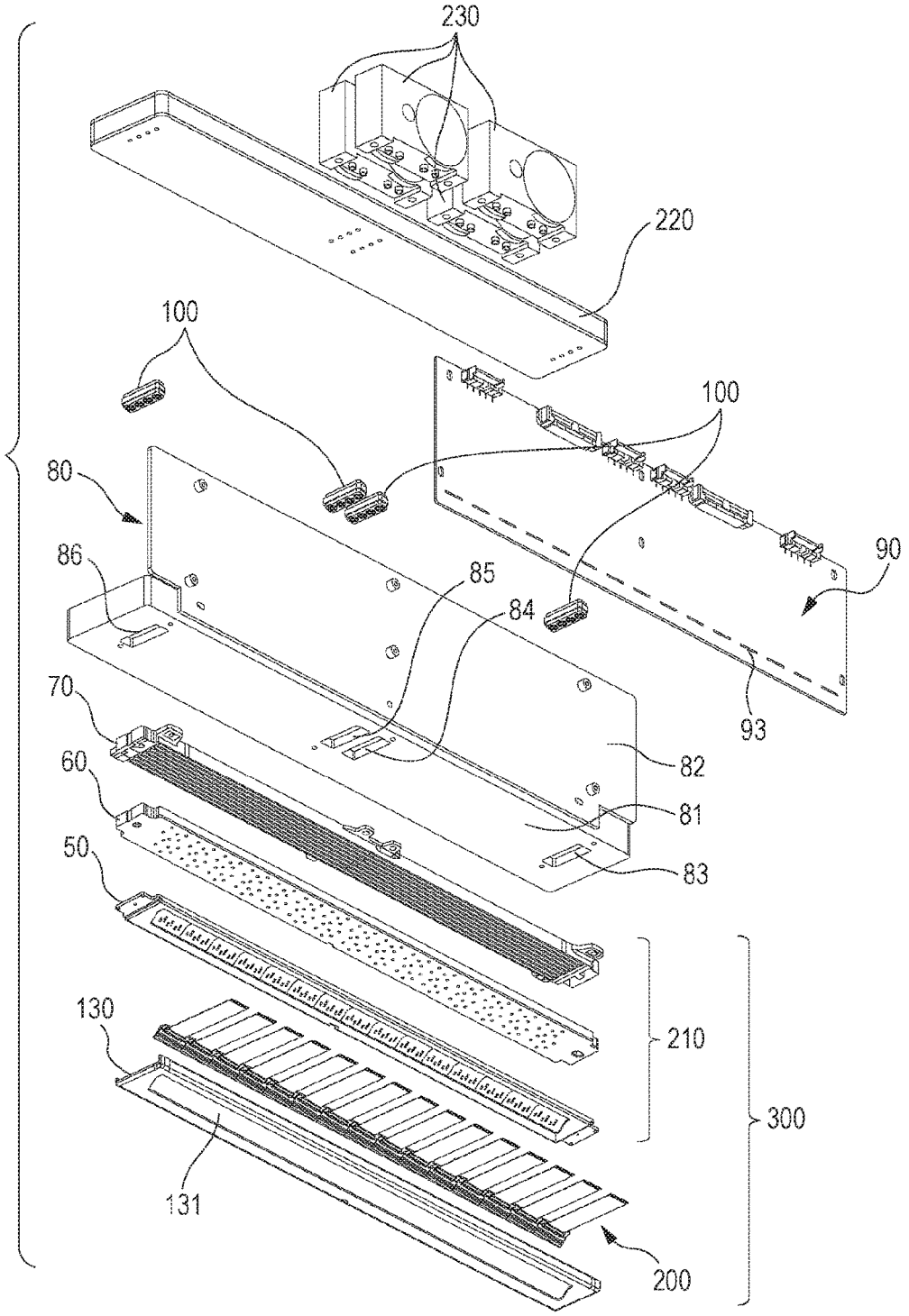
FIG. 32 is a diagram illustrating a modification of the liquid discharge head according to the first embodiment.

A modification of the above-described liquid discharge head configuration will be described with reference to FIGS. 29 and 31A through 33. Configurations and functions that are the same as the above-described example will be omitted from description, and points of difference will primarily be described. In this modification, the multiple liquid connection portions 111 that are connection portions between the outside of the liquid discharge head 3 and the liquid are disposed in a consolidated manner at one end side of the liquid discharge head 3 in the longitudinal direction, as illustrated in FIGS. 29, 31A, and 31B. Multiple negative pressure control units 230 are disposed in a consolidated manner at the other end side of the liquid discharge head 3 (FIG. 32). The liquid supply unit 220 included in the liquid discharge head 3 is configured as a long and slender unit corresponding to the length of the liquid discharge head 3, and has channels and filters 221 corresponding to the liquid of the four colors being supplied. The positions of the openings 83 through 86 provided on the liquid discharge unit support member 81 also are at different positions from the liquid discharge head 3 described above, as illustrated in FIG. 32.

Figure 33:
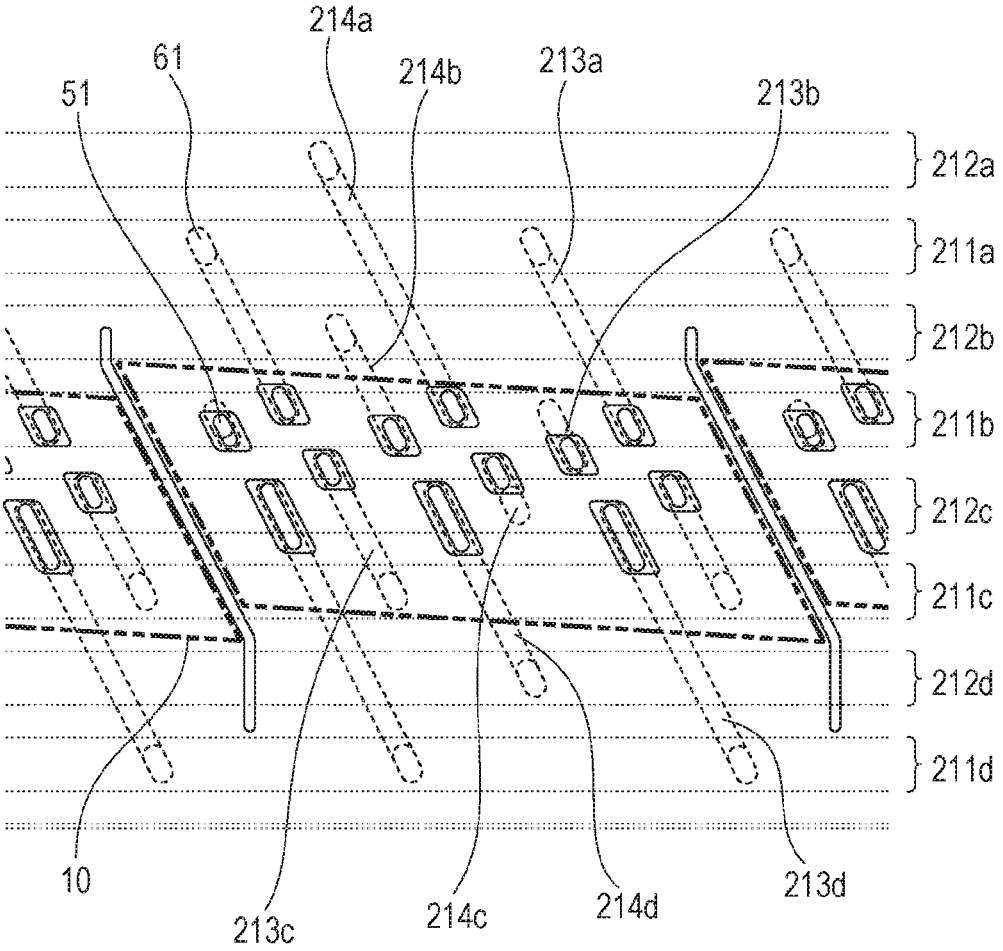
FIG. 33 is a diagram illustrating a modification of the liquid discharge head according to the first embodiment.

FIG. 33 illustrates the laminated states of the channel members 50, 60, and 70. Multiple recording element boards 10 are arrayed in a straight line on the upper face of the first channel member 50 that is the highest layer of the multiple channel members 50, 60, and 70. There are two individual supply channels 213 and one individual recovery channel 214 for each liquid color, as channels communicating with the openings 21 (FIG. 20C) formed on the rear side of each recording element board 10. Corresponding to this, there also are two supply openings 21 and one recovery opening 21 for each liquid color, with regard to the openings 21 formed on the cover 20 provided to the rear face of the recording element boards 10. The common supply channels 211 and common recovery channels 212 extending in the longitudinal direction of the liquid discharge head 3 are arrayed in parallel alternatingly, as illustrated in FIG. 33.

Second Embodiment

The configuration of an inkjet recording apparatus 1000 and liquid discharge head 3 according to a second embodiment of the present invention will be described. Note that portions that differ from the first embodiment will primarily be described, and portions that are the same as the first embodiment will be omitted from description.

Description of Inkjet Recording Apparatus

Figure 13:
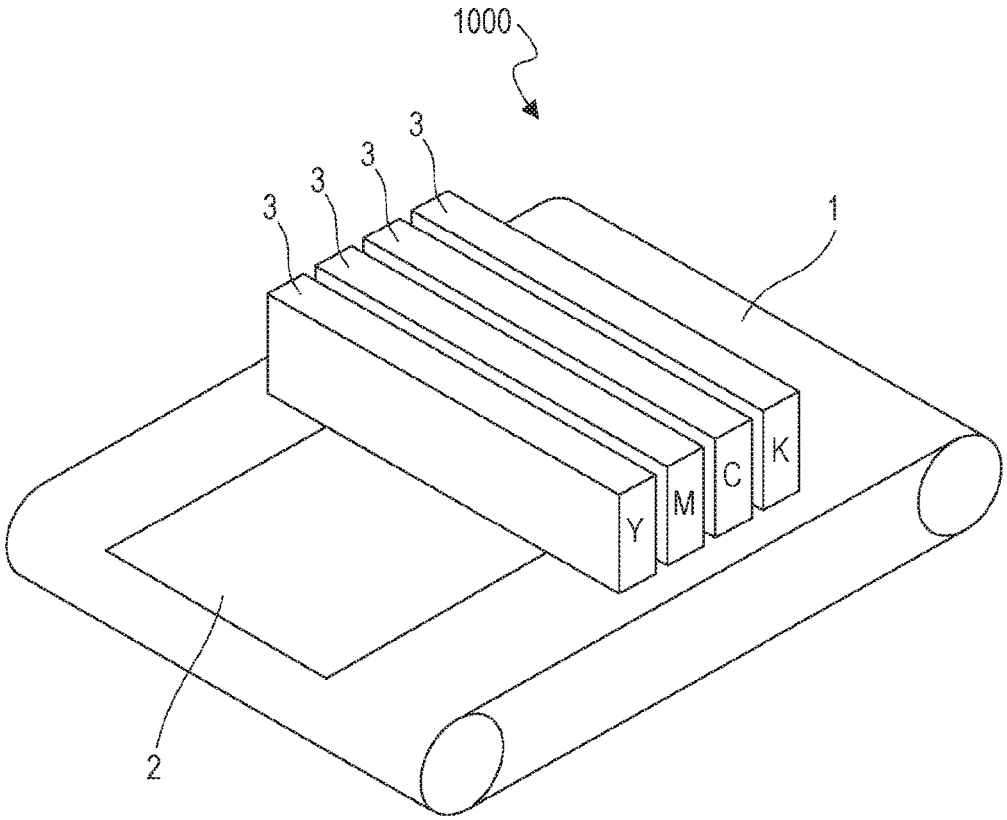
FIG. 13 is a diagram illustrating the configuration of the recording apparatus according to a second embodiment of the present invention.
Figure 20A:
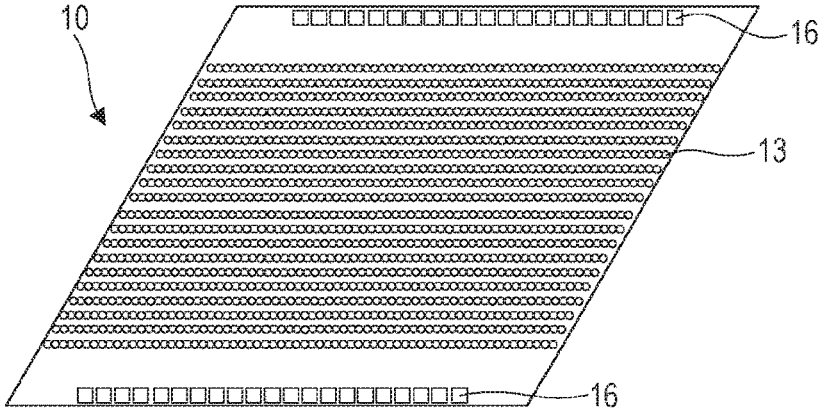
FIGS. 20A through 20C are diagrams illustrating the configuration of the recording element board.

FIG. 13 illustrates an inkjet recording apparatus according to the second embodiment of the present invention. The recording apparatus 1000 according to the second embodiment differs from the first embodiment with regard to the point that full-color recording is performed on the recording medium by arraying in parallel four monochrome liquid discharge heads 3, each corresponding to one of CMYK ink. Although the number of discharge orifice rows usable per color in the first embodiment was one row, the number of discharge orifice rows usable per color in the second embodiment is 20 rows (FIG. 20A). This enables extremely high-speed recording to be performed, by allocating recording data to multiple discharge orifice rows. Even if there are discharge orifices that exhibit ink non-discharge, reliability is improved by a discharge orifice at a corresponding position in the conveyance direction of the recording medium in another row performing discharge in a complementary manner, and accordingly the arrangement is suitable for industrial printing. The supply system of the recording apparatus 1000, the buffer tank 1003, and the main tank 1006 (FIG. 2) are connected to the liquid discharge heads 3 by fluid connection, in the same way as in the first embodiment. Each liquid discharge head 3 is also electrically connected to an electric control unit that transmits electric power and discharge control signals to the liquid discharge head 3.

Description of Circulation Paths

The first and second circulation paths illustrated in FIGS. 2 and 3 can be used as the liquid circulation paths between the recording apparatus 1000 and the liquid discharge heads 3, in the same way as in the first embodiment.

Description of Structure of Liquid Discharge Head

Figure 14A:
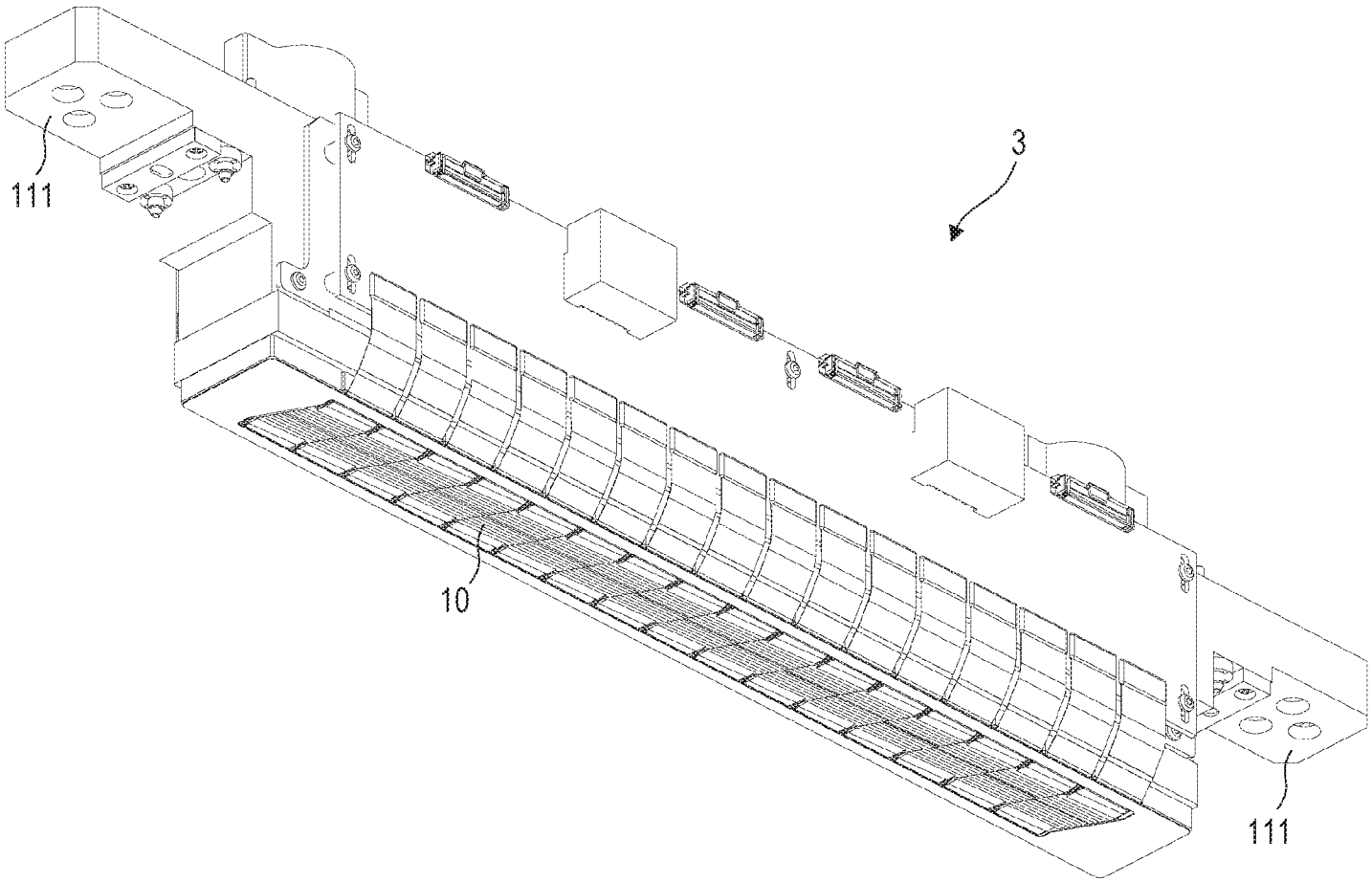
FIGS. 14A and 14B are perspective views of the liquid discharge head according to the second embodiment of the present invention.
Figure 14B:
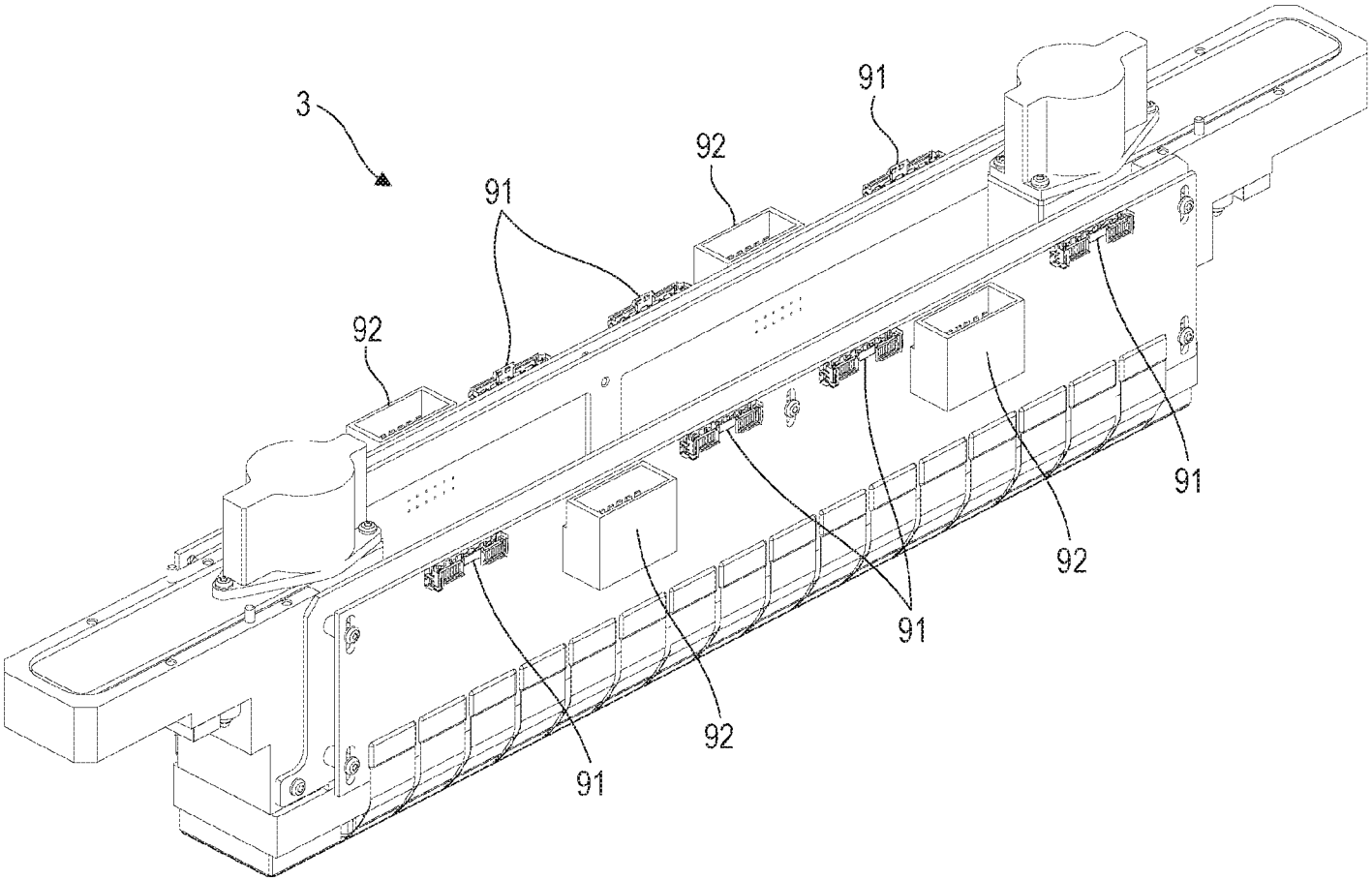

Description will be made regarding the structure of the liquid discharge head 3 according to the second embodiment of the present invention. FIGS. 14A and 14B are perspective diagrams of the liquid discharge head 3 according to the present embodiment. The liquid discharge head 3 has 16 recording element boards 10 arrayed in a straight line in the longitudinal direction of the liquid discharge head 3, and is an inkjet line recording head that can record with ink of one color. The liquid discharge head 3 has the liquid connection portions 111, signal input terminals 91, and power supply terminals 92 in the same way as the first embodiment. The liquid discharge head 3 according to the embodiment differs from the first embodiment in that the input terminals 91 and power supply terminals 92 are disposed on both sides of the liquid discharge head 3, since the number of discharge orifice rows is greater. This is to reduce voltage drop and signal transmission delay that occurs at wiring portions provided to the recording element boards 10.

Figure 15:
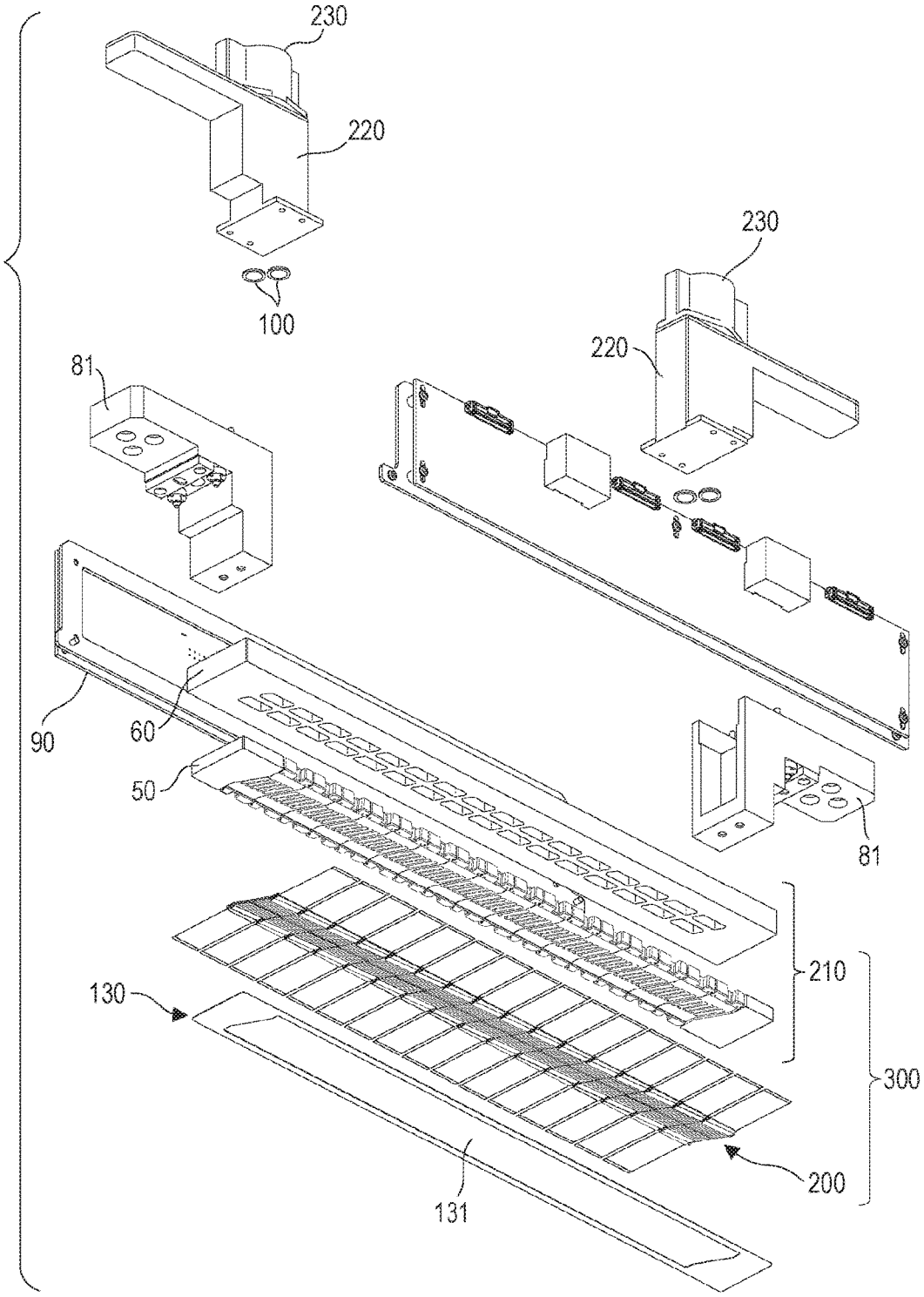
FIG. 15 is a disassembled perspective view of the liquid discharge head in FIGS. 14A and 14B.

FIG. 15 is a disassembled perspective view of the liquid discharge head 3, illustrating each part or unit making up the liquid discharge head 3 disassembled according to function. The roles of the units and members, and the order of liquid flow through the liquid discharge head, are basically the same as in the first embodiment, but the function by which the rigidity of the liquid discharge head is guaranteed is different. The rigidity of the liquid discharge head was primarily guaranteed in the first embodiment by the liquid discharge unit support member 81, but the rigidity of the liquid discharge head is guaranteed in the second embodiment by the second channel member 60 included in the liquid discharge unit 300. There are liquid discharge unit support members 81 connected to both ends of the second channel member 60 in the present embodiment. This liquid discharge unit 300 is mechanically enjoined to a carriage of the recording apparatus 1000, whereby the liquid discharge head 3 is positioned. Liquid supply units 220 having negative pressure control units 230, and the electric wiring board 90, are joined to the liquid discharge unit support members 81. Filters (omitted from illustration) are built into the two liquid supply units 220. The two negative pressure control units 230 are set to control pressure by high and low negative pressure that relatively differ from each other. When the high-pressure side and low-pressure side negative pressure control units 230 are disposed on the ends of the liquid discharge head 3 as illustrated in FIGS. 14A through 15, the flow of ink on the common supply channel 211 and the common recovery channel 212 that extend in the longitudinal direction of the liquid discharge head 3 are mutually opposite. This promotes heat exchange between the common supply channel 211 and common recovery channel 212, so that the temperature difference between the two common channels can be reduced. This is advantageous in that temperature difference does not readily occur among the multiple recording element boards 10 disposed along the common channels, and accordingly unevenness in recording due to temperature difference does not readily occur.

The channel member 210 of the liquid discharge unit 300 will be described in detail next. The channel member 210 is the first channel member 50 and second channel member 60 that have been laminated as illustrated in FIG. 15, and distributes ink supplied from the liquid supply unit 220 to the discharge modules 200. The channel member 210 also serves as a channel member for returning ink recirculating from the discharge modules 200 to the liquid supply unit 220. The second channel member 60 of the channel member 210 is a channel member in which the common supply channel 211 and common recovery channel 212 have been formed, and also primary undertakes the rigidity of the liquid discharge head 3. Accordingly, the material of the second channel member 60 preferably is sufficiently corrosion-resistant as to the ink and has high mechanical strength. Examples of suitably-used materials include stainless steel, titanium (Ti), alumina, or the like.

Figure 16A:
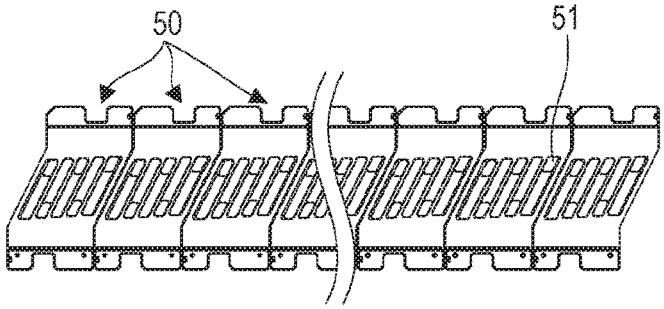
FIGS. 16A through 16E are diagrams illustrating the configuration of first and second flow channel members making up the channel member that the liquid discharge head in FIGS. 14A and 14B has.
Figure 16B:
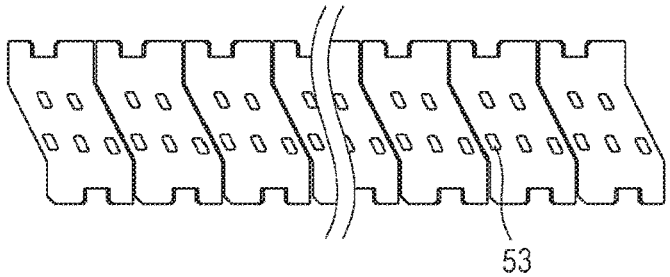
Figure 16C:
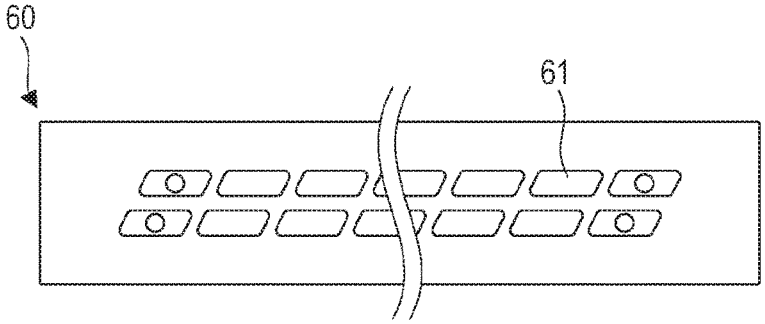
Figure 16D:
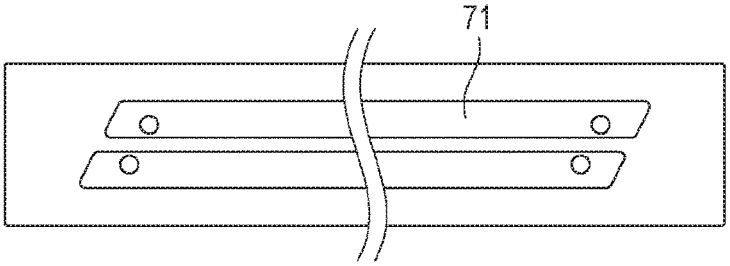
Figure 16E:
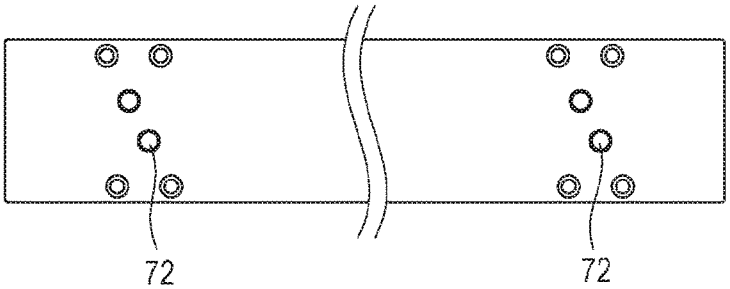

FIG. 16A illustrates the face of the first channel member 50 on the side where the discharge modules 200 are mounted, and FIG. 16B is a diagram illustrating the reverse face therefrom, that comes into contact with the second channel member 60. Unlike the case in the first embodiment, the first channel member 50 according to the second embodiment is an arrangement where multiple members corresponding to the discharge modules 200 are arrayed adjacently. Using this divided structure enables a length corresponding to the length of the liquid discharge head to be realized, and accordingly can particularly be suitably used in relatively long-scale liquid discharge heads corresponding to sheets of B2 size and even larger, for example. The communication ports 51 of the first channel member 50 communicate with the discharge modules 200 by fluid connection as illustrated in FIG. 16A, and individual communication ports 53 of the first channel member 50 communicate with the communication ports 61 of the second channel member 60 by fluid connection. FIG. 16C illustrates the face of the second channel member 60 that comes in contact with the first channel member 50, FIG. 16D illustrates a cross-section of the middle portion of the second channel member 60 taken in the thickness direction, and FIG. 16E is a diagram illustrating the face of the second channel member 60 that comes into contact with the liquid supply unit 220. The functions of the channels and communication ports of the second channel member 60 are the same as in with one color worth in the first embodiment. Unlike the case in the first embodiment, the longitudinal directions of ink for the common supply channel 211 and common recovery channel 212 are mutually opposite directions.

Figure 17:
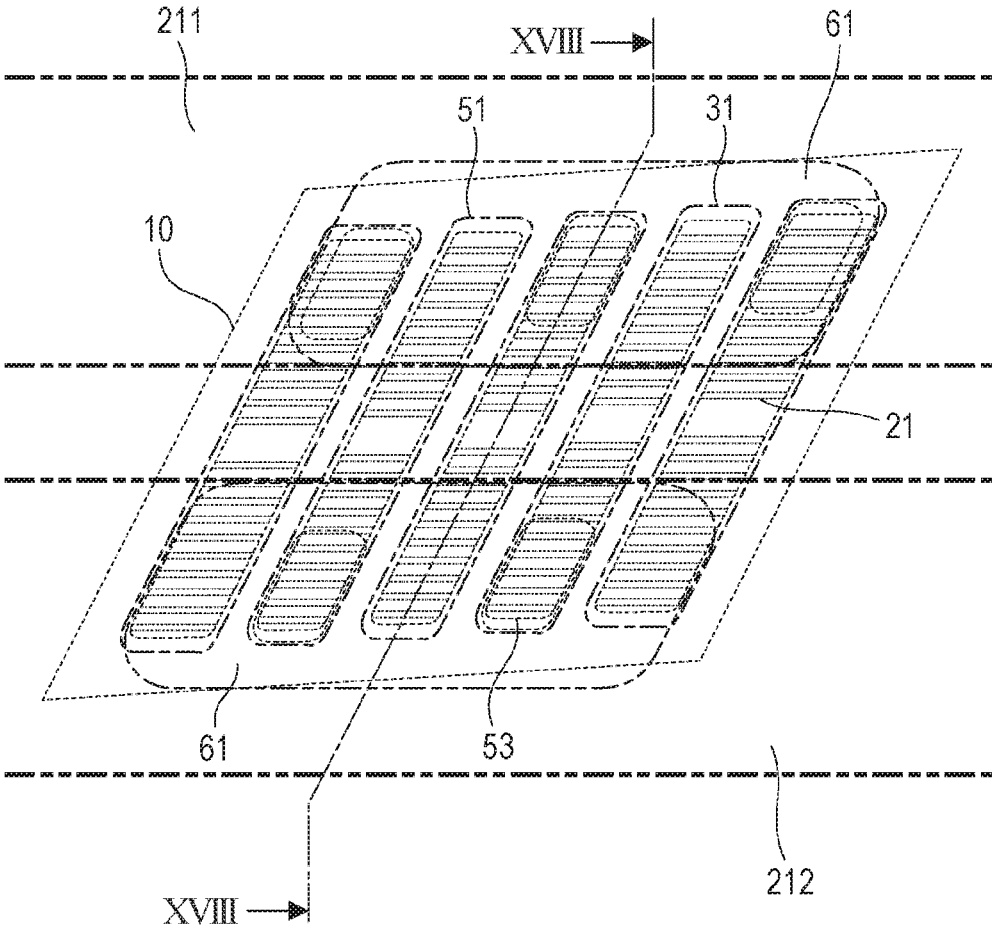
FIG. 17 is a diagram for describing connection relationships of liquid in the recording element board and channel member.

FIG. 17 is a transparent view illustrating the connection relationship regarding ink between the recording element boards 10 and the channel member 210. The set of the common supply channel 211 and common recovery channel 212 extending in the longitudinal direction of the liquid discharge head 3 is provided within the channel member 210, as illustrated in FIG. 17. The communication ports 61 of the second channel member 60 are each positioned with and connected to the individual communication ports 53 of the first channel member 50, thereby forming a liquid supply path from the communication ports 72 of the second channel member 60 to the communication ports 51 of the first channel member 50 via the common supply channel 211. In the same way, a liquid supply path from the communication ports 72 of the second channel member 60 to the communication ports 51 of the first channel member 50 via the common recovery channel 212 is also formed.

Figure 18:
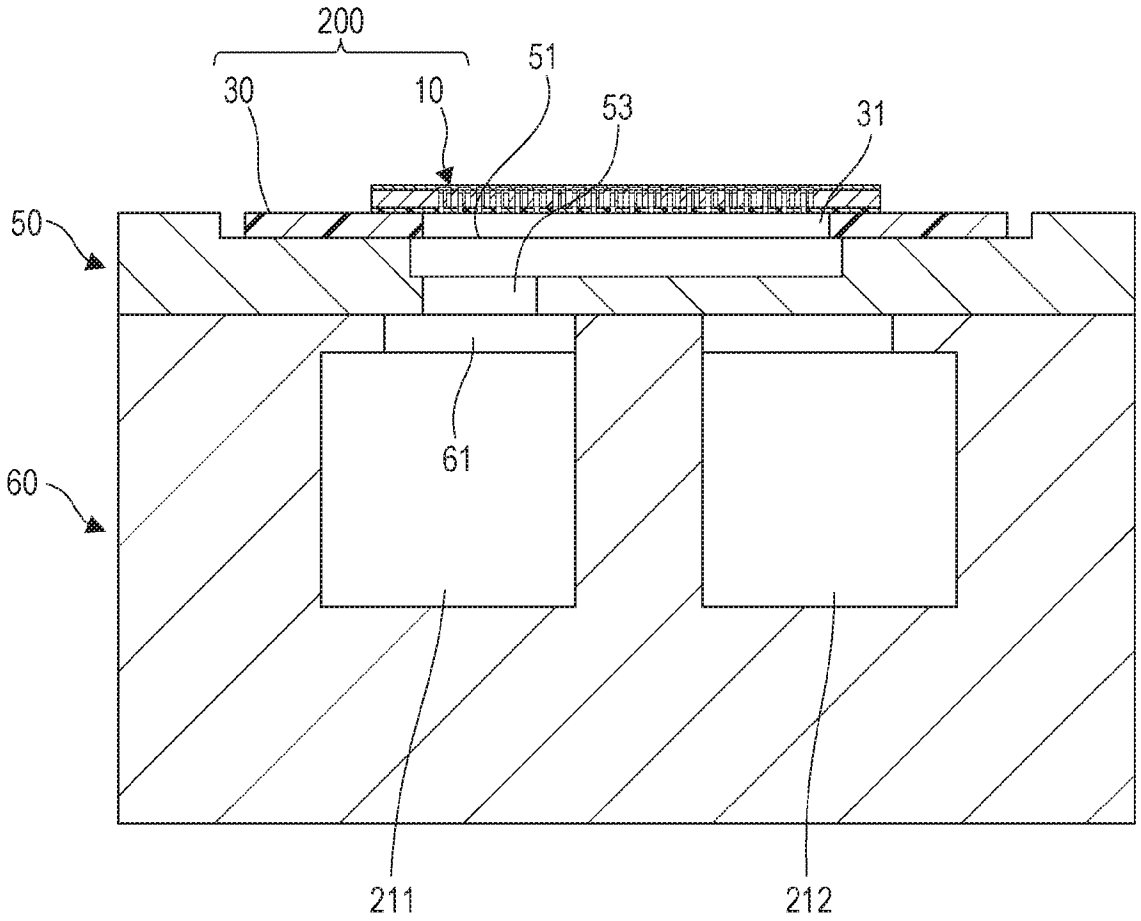
FIG. 18 is a cross-sectional view taken along line XVIII-XVIII in FIG. 17.

FIG. 18 is a diagram illustrating a cross-section taken along XVIII-XVIII in FIG. 17. FIG. 18 shows how the common supply channel 211 connects to the discharge module 200 through the communication port 61, individual communication port 53, and communication port 51. Although omitted from illustration in FIG. 18, it can be clearly seen from FIG. 17 that another cross-section would show an individual recovery channel 214 connected to the discharge module 200 through a similar path. Channels are formed on the discharge modules 200 and recording element boards 10 to communicate with the discharge orifices 13, and part or all of the supplied ink recirculates through the discharge orifices 13 (pressure chambers 23) that are not performing discharging operations, in the same way as in the first embodiment. The common supply channel 211 is connected to the negative pressure control unit 230 (high-pressure side), and the common recovery channel 212 to the negative pressure control unit 230 (low-pressure side), via the liquid supply unit 220, in the same way as in the first embodiment. Accordingly, a flow is generated by the differential pressure thereof, that flows from the common supply channel 211 through the discharge orifices 13 (pressure chambers 23) of the recording element board 10 to the common recovery channel 212.

Description of Discharge Module

Figure 19A:
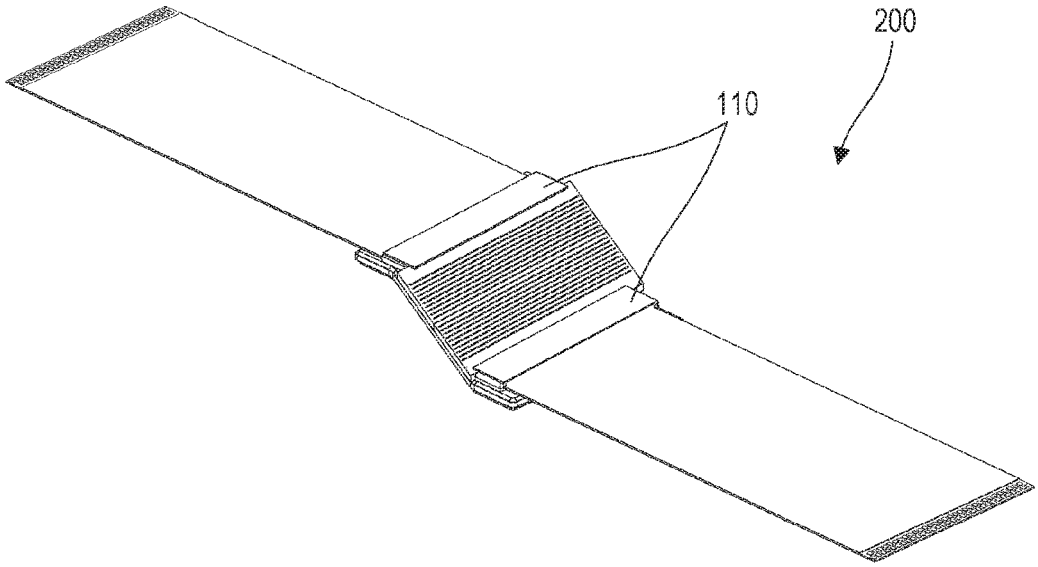
FIGS. 19A and 19B are diagrams illustrating a discharge module, FIG. 19A being a perspective view and FIG. 19B a disassembled view.
Figure 19B:
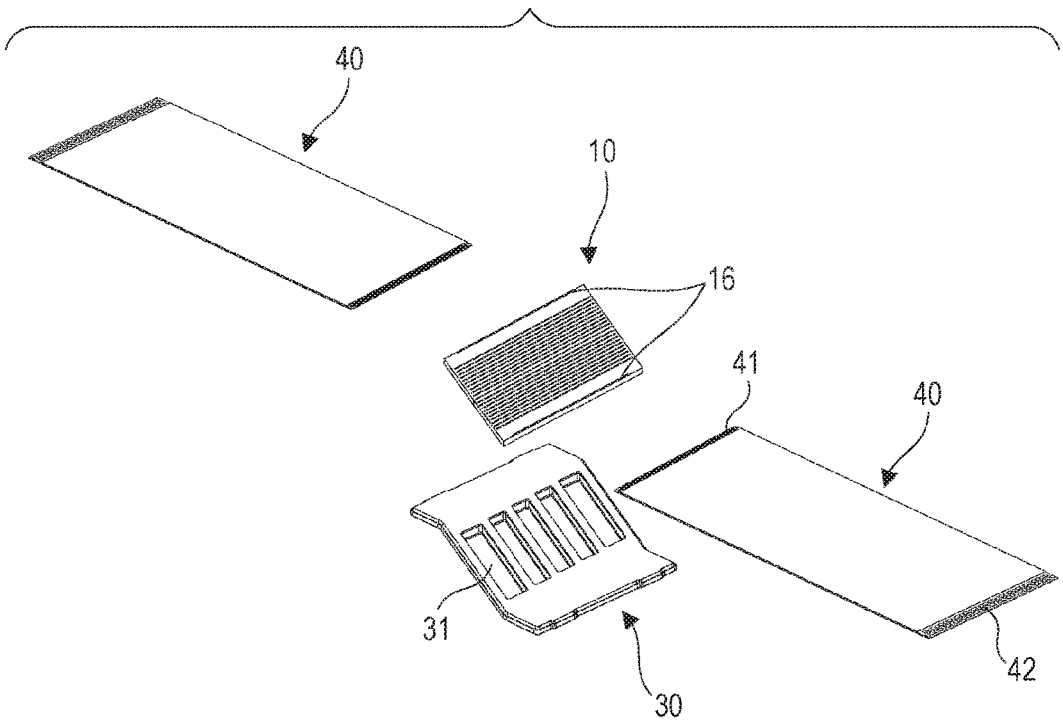

FIG. 19A is a perspective view of one discharge module 200, and FIG. 19B is a disassembled view thereof. The difference as to the first embodiment is the point that multiple terminals 16 are disposed arrayed on both sides (the long side portions of the recording element board 10) following the direction of the multiple discharge orifice rows of the recording element board 10. Another point is that two flexible printed circuit boards 40 are provided to one recording element board 10 and are electrically connected to the terminals 16. The reason is that the number of discharge orifice rows provided on the recording element board 10 is 20 rows, which is a great increase over the eight rows in the first embodiment. The object thereof is to keep the maximum distance from the terminals 16 to the recording elements 15 provided corresponding to the discharge orifice row short, hereby reducing voltage drop and signal transmission delay that occurs at wiring portions provided to the recording element board 10. Liquid communication ports 31 of the support member 30 are provided to the recording element board 10, and are opened so as to span all discharge orifice rows. Other points are the same as in the first embodiment.

Description of Structure of Recording Element Board

Figure 20B:
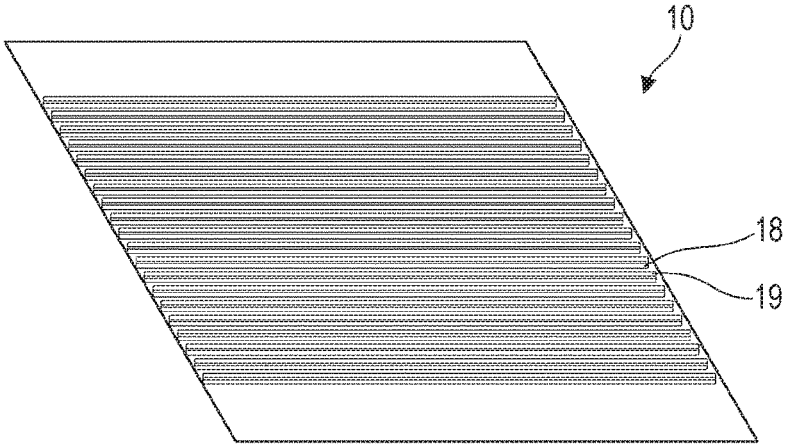
Figure 20C:
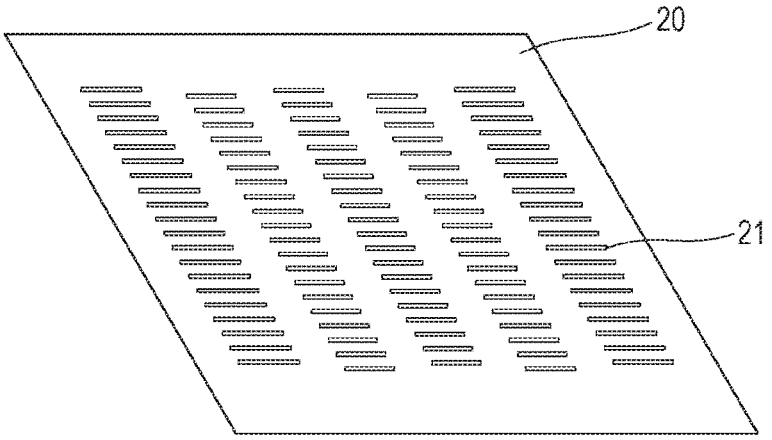

FIG. 20A is a schematic diagram illustrating the face of the recording element board 10 on the side where the discharge orifices 13 are disposed, and FIG. 20C is a schematic diagram illustrating the reverse face of that illustrated in FIG. 20A. FIG. 20B is a schematic diagram illustrating the face of the recording element board 10 in a case where the cover 20 provided on the rear face side of the recording element board 10 is removed in FIG. 20C. Liquid supply channels 18 and liquid recovery channels 19 are alternately provided on the rear face of the recording element board 10 following the discharge orifice row direction, as illustrated in FIG. 20B. Despite the number of discharge orifice rows being much greater than that in the first embodiment, a substantial difference from the first embodiment is that the terminals 16 are disposed on both side portions of the recording element board 10 following the discharge orifice row direction, as described above. The basic configuration is the same as that in the first embodiment, such as one set of a liquid supply channel 18 and liquid recovery channel 19 being provided for each discharge orifice row, openings 21 that communicate with the liquid communication ports 31 of the support member 30 being provided to the cover 20, and so forth.

Third Embodiment

The configuration of an inkjet recording apparatus 1000 and liquid discharge head 3 according to a third embodiment will be described. The liquid discharge head 3 according to the third embodiment is a page-wide head that records a B2 size recording medium sheet with a single scan. The third embodiment is similar to the second embodiment with regard to many points, so points of difference as to the second embodiment will primarily be described below, and portions that are the same as the second embodiment will be omitted from description.

Description of Inkjet Recording Apparatus

Figure 34:
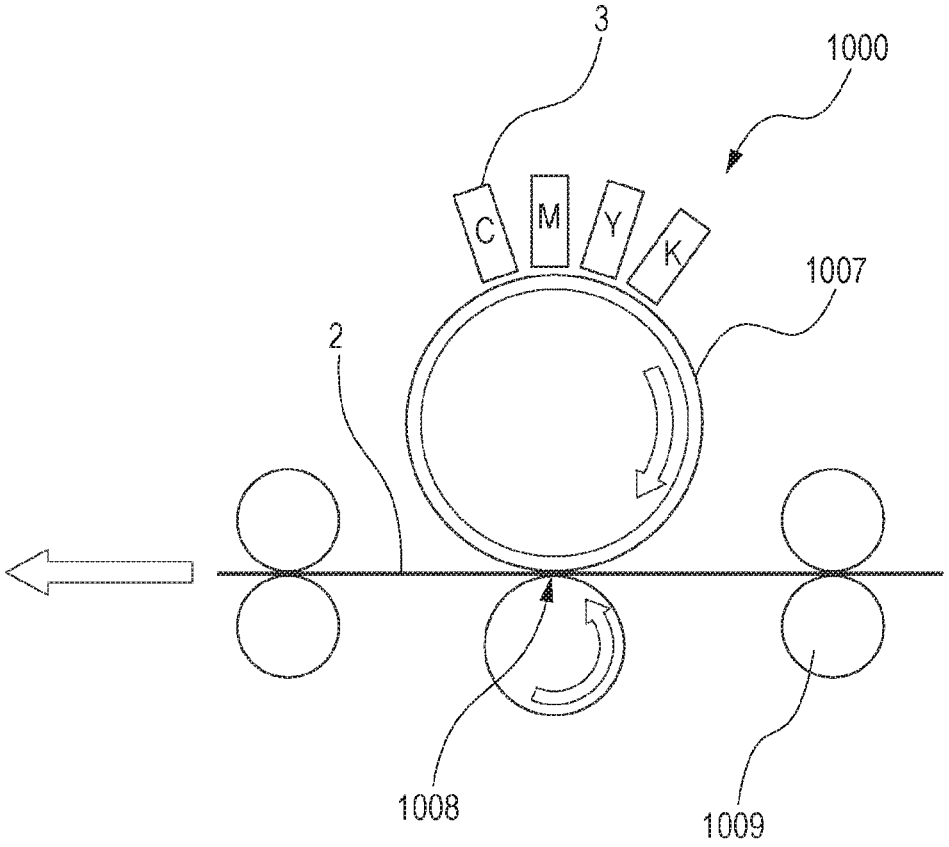
FIG. 34 is a diagram illustrating a recording apparatus according to a third embodiment.

FIG. 34 is a schematic diagram of an inkjet recording apparatus according to the present embodiment. The recording apparatus 1000 is of a configuration that does not directly record on the recording medium from the liquid discharge head 3, but rather discharges liquid on an intermediate transfer member (intermediate transfer drum 1007) and forms an image, following which the image is transferred onto the recording medium 2. The recording apparatus 1000 has four monochrome liquid discharge heads 3 corresponding to the four types of ink of CMYK, disposed in an arc following the intermediate transfer drum 1007. Thus, full-color recording is performed on the intermediate transfer member, the recorded image is dried to a suitable state on the intermediate transfer member, and then transferred by a transfer unit 1008 onto the recording medium 2 conveyed by a sheet conveyance roller 1009. Whereas the sheet conveyance system in the second embodiment was horizontal conveyance with the intent of primarily conveying cut sheets, the present embodiment is capable of handling continuous sheets supplied from a main roll (omitted from illustration). This sort of drum conveyance system can easily convey sheets with a certain tension applied, so there is less conveyance jamming when performing high-speed recording. Thus, the reliability of the apparatus improves, and is suitable for application to business printing and the like. The supply system of the recording apparatus 1000, the buffer tank 1003, and the main tank 1006 are connected to the liquid discharge heads 3 by fluid connection, in the same way as in the first and second embodiments. Each liquid discharge head 3 is also electrically connected to an electric control unit that transmits electric power and discharge control signals to the liquid discharge head 3.

Description of Fourth Circulation Path

Figure 35:
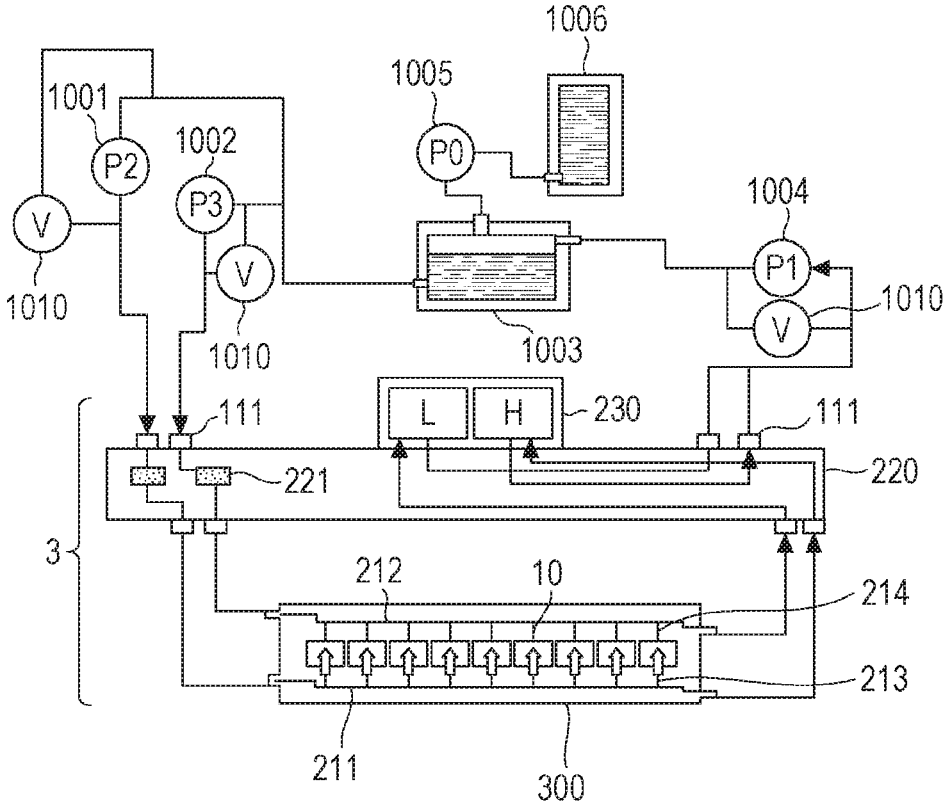
FIG. 35 is a diagram illustrating a fourth circulation path.

Although the first and second circulation paths illustrated in FIGS. 2 and 3 between the tanks of the recording apparatus 1000 and the liquid discharge head 3 are applicable as liquid circulation paths in the same way as in the second embodiment, a circulation path illustrated in FIG. 35 is suitable. A primary difference as to the second circulation path in FIG. 3 is that bypass valves 1010 are added that communicate with channels of each of the first circulation pumps 1001 and 1002 and the second circulation pump 1004. The bypass valves 1010 function to lower pressure at the upstream side of the bypass valve 1010 (first function), due to the valve opening when pressure exceeds a preset pressure. The bypass valves 1010 also function to open and close valves at a predetermined timing by signals from a control board at the recording apparatus main unit (second function).

According to the first function, excessively large or excessively small pressure can be kept from being applied to the channel at the downstream side of the first circulation pumps 1001 and 1002 and the upstream side of the second circulation pump 1004. For example, in a case where the functions of the first circulation pumps 1001 and 1002 malfunction, excessive flow rate or pressure may be applied to the liquid discharge head 3. This may cause liquid to leak from the discharge orifices 13 of the liquid discharge head 3, or joined portions within the liquid discharge head 3 to be damaged. However, in a case where bypass vales are added to the first circulation pumps 1001 and 1002 as in the present embodiment, opening the bypass valves 1010 releases the liquid path to the upstream side of the circulation pumps, so trouble such as that described above can be suppressed, even if excessive pressure occurs.

Also, due to the second function, when stopping circulation operations, all bypass valves 1010 are quickly opened after the first circulation pumps 1001 and 1002 and second circulation pump 1004 stop, based on control signals from the main unit side. This allows the high negative pressure (e.g., several kPa to several tens of kPa) at the downstream portion of the liquid discharge head 3 (between the negative pressure control unit 230 and the second circulation pump 1004) to be released in a short time. In a case of using a positive-displacement pump such as a diaphragm pump as the circulation pump, a check valve usually is built into the pump. However, opening the bypass valves 1010 enables pressure release at the downstream side of the liquid discharge head 3 to be performed from the downstream buffer tank 1003 side as well. Although pressure release of the downstream side of the liquid discharge head 3 can be performed just from the upstream side as well, there is pressure drop in the channels at the upstream side of the liquid discharge head 3 and the channels within the liquid discharge head 3. Accordingly, there is the concern that pressure discharge may take time, the pressure within the common channel within the liquid discharge head 3 may temporarily drop too far, and the meniscus at the discharge orifices may be destroyed. Opening the bypass valves 1010 at the downstream side of the liquid discharge head 3 promotes pressure discharge at the downstream side of the liquid discharge head 3, so the risk of destruction of the meniscus at the discharge orifices is reduced.

Description of Structure of Liquid Discharge Head

Figure 36A:
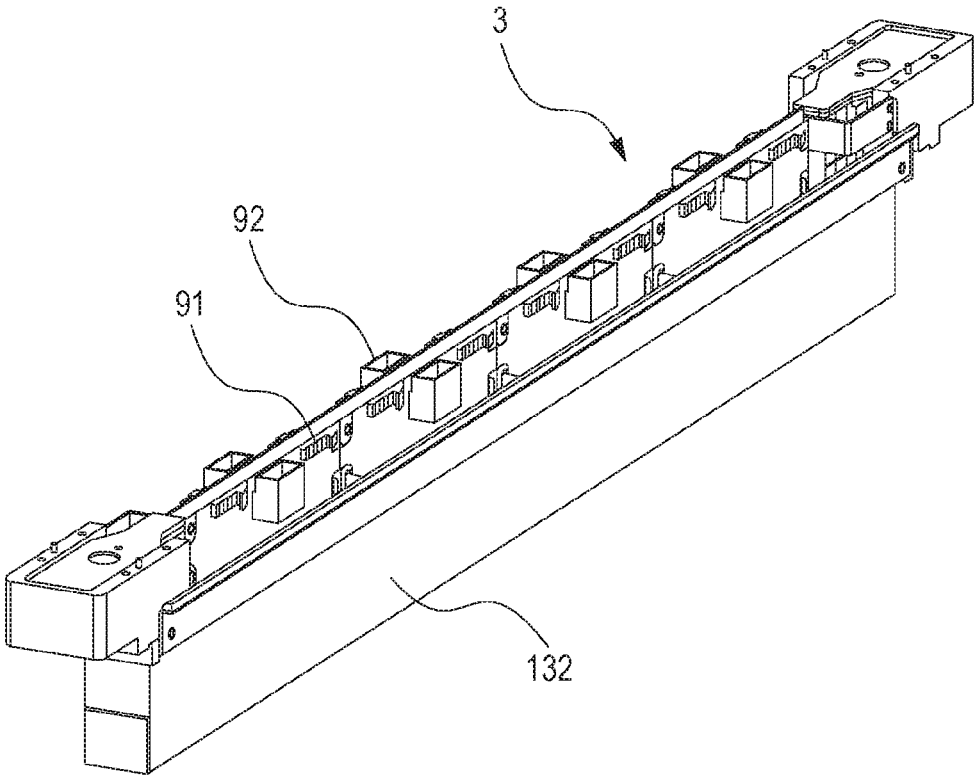
FIGS. 36A and 36B are diagrams illustrating the liquid discharge head according to the third embodiment.
Figure 36B:
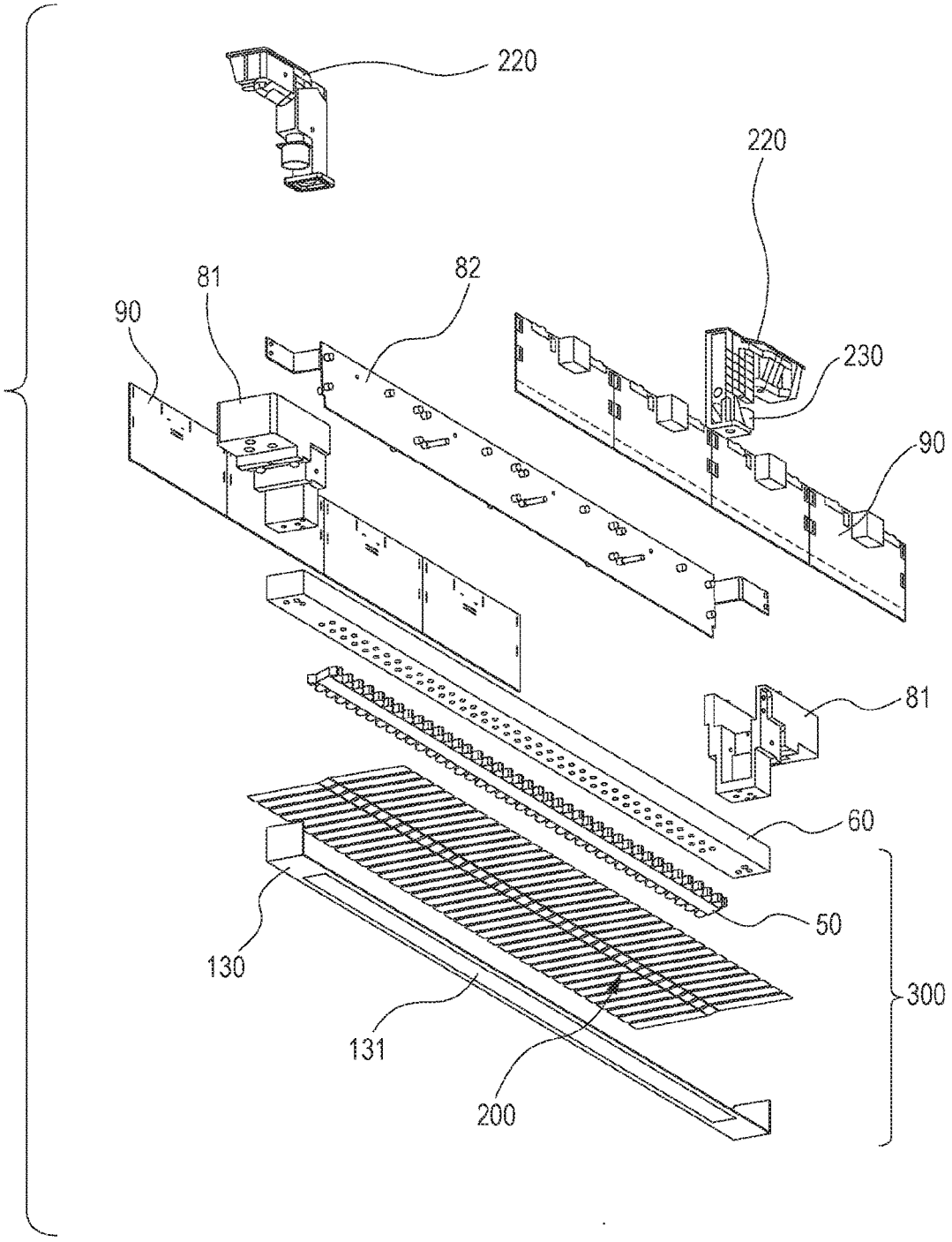

The structure of the liquid discharge head 3 according to the third embodiment of the present invention will be described. FIG. 36A is a perspective view of the liquid discharge head 3 according to the present embodiment, and FIG. 36B is a disassembled perspective view thereof. The liquid discharge head 3 has 36 recording element boards 10 arrayed in a straight line (inline) in the longitudinal direction of the liquid discharge head 3, and is a line type (page-wide) inkjet recording head that records using a single-color liquid. The liquid discharge head 3 has the signal input terminals 91 and power supply terminals 92 in the same way as in the second embodiment, and also is provided with a shield plate 132 to protect the longitudinal side face of the head.

FIG. 36B is a disassembled perspective view of the liquid discharge head 3, illustrating each part or unit making up the liquid discharge head 3 disassembled according to function (the shield plate 132 is omitted from illustration). The roles of the units and members, and the order of liquid flow through the liquid discharge head 3, are basically the same as in the second embodiment. The third embodiment differs from the second embodiment primarily with regard to the points of the electric wiring board 90 being divided into a plurality and disposed, the position of the negative pressure control units 230, and the shape of the first channel member 50. In the case of a liquid discharge head 3 having a length corresponding to a B2 size recording medium for example, as in the case of the present embodiment, eight electric wiring boards 90 are provided since the amount of electric power the liquid discharge head 3 uses is great. Four each of the electric wiring boards 90 are attached to both sides of the slender electric wiring board support member 82 attached to the liquid discharge unit support member 81.

Figure 37A:
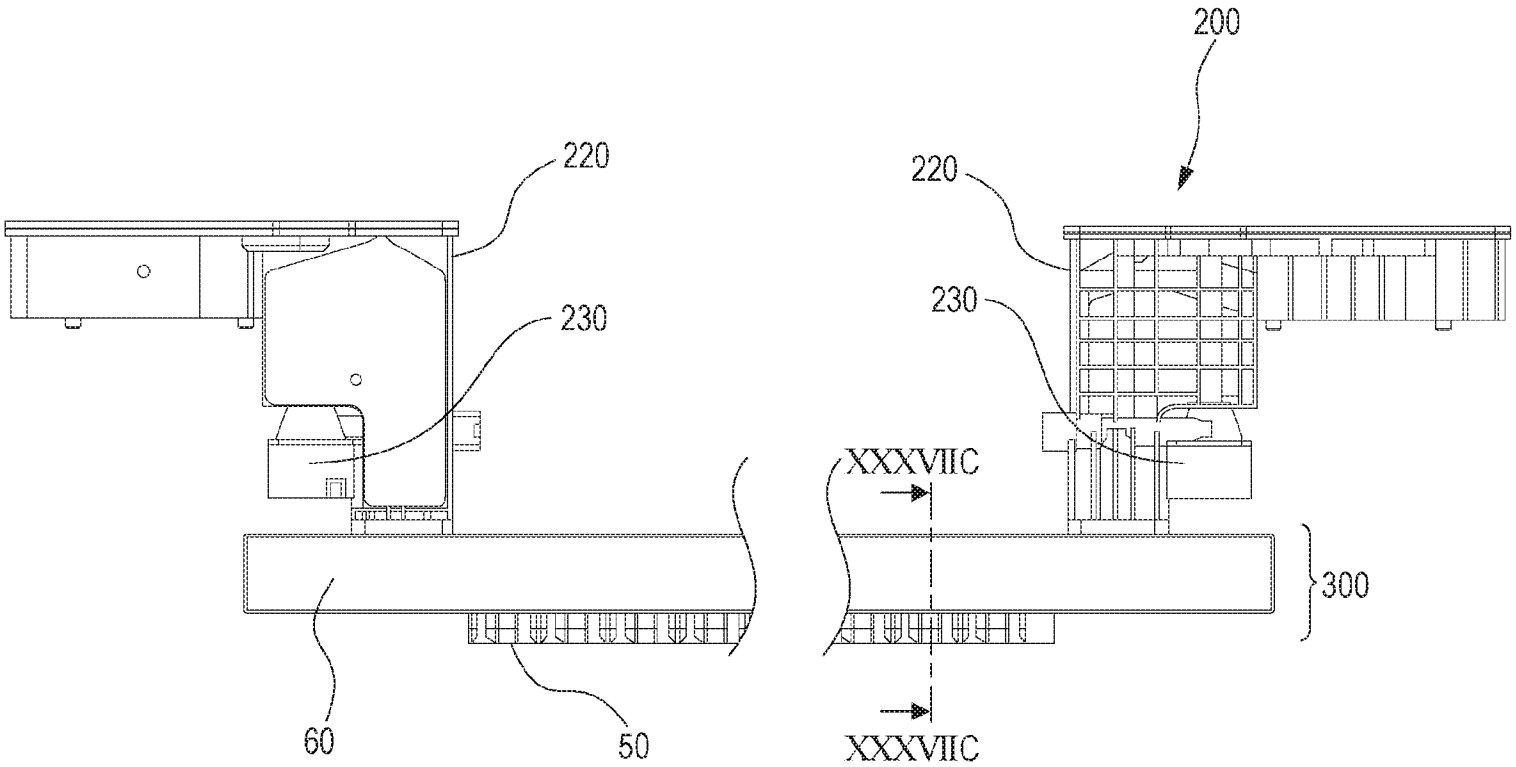
FIGS. 37A through 37C are diagrams illustrating the liquid discharge head according to the third embodiment.
Figure 37B:
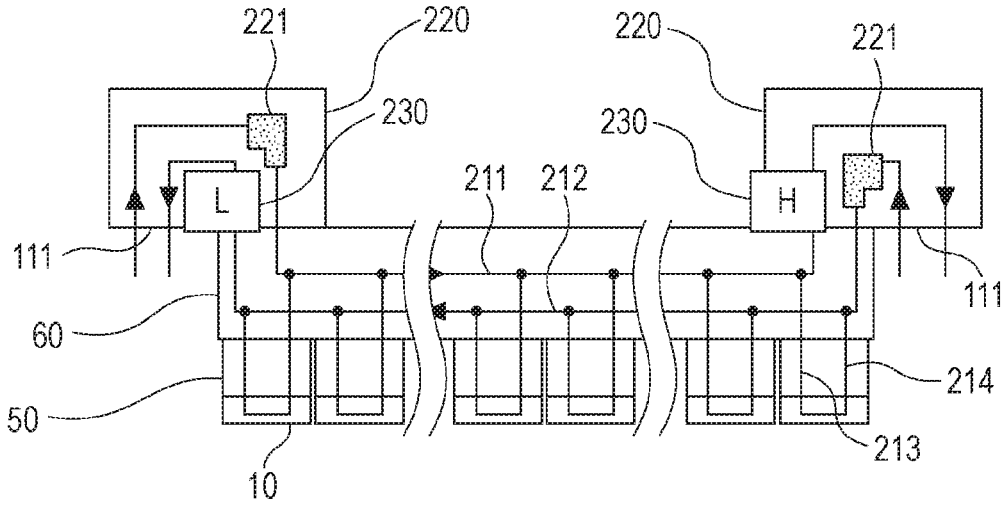
Figure 37C:
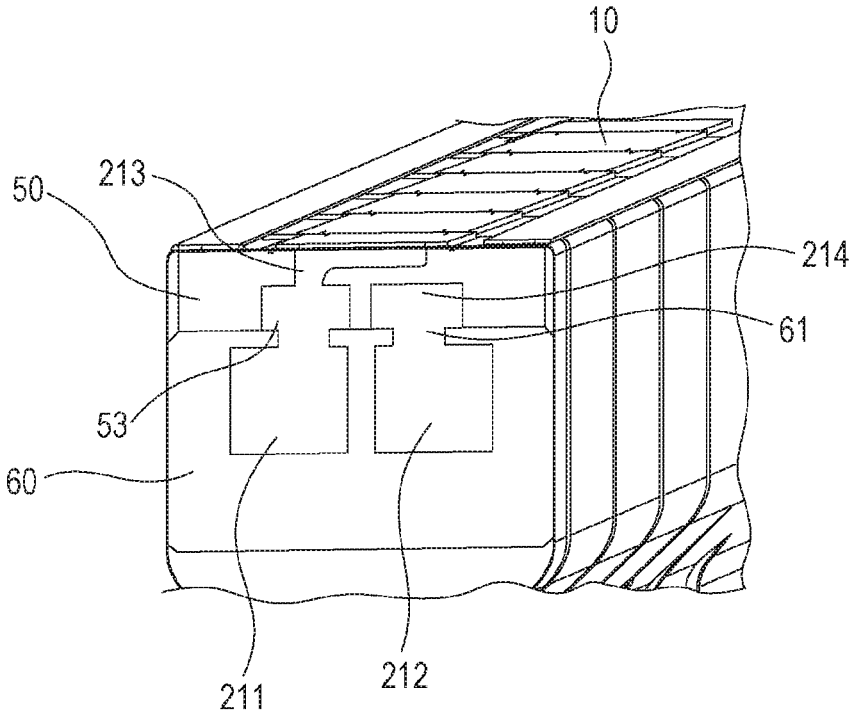

FIG. 37A is a side view of the liquid discharge head 3 that has the liquid discharge unit 300, liquid supply units 220, and negative pressure control units 230, FIG. 37B is a schematic diagram illustrating the flow of liquid, and FIG. 37C is a perspective view illustrating a cross-section taken along line XXXVIIC-XXXVIIC in FIG. 37A. Parts of the configuration have been simplified to facilitate understanding.

The liquid connection portions 111 and filters 221 are provided within the liquid supply units 220, with the negative pressure control units 230 being integrally formed beneath the liquid supply units 220. This enables the distance in the height direction between the negative pressure control units 230 and the recording element boards 10 to be reduced as compared to the second embodiment. This configuration reduces the number of channel connection portions within the liquid supply units 220, and is advantageous not only regarding improved reliability regarding leakage of recording liquid, but also in that the number of parts and assembly processes can be reduced.

Also, the water head difference between the negative pressure control units 230 and the face where the discharge orifices are formed is relatively smaller, and accordingly can be suitably applied to a recording apparatus where the inclination angle of the liquid discharge head 3 differs for each liquid discharge head 3, such as illustrated in FIG. 34. The reason is that the reduced water head difference enables the negative pressure difference applied to the discharge orifices of the respective recording element boards 10 can be reduced even if each of the multiple liquid discharge heads 3 is used at a different inclination angle. Reducing the distance from the negative pressure control units 230 to the recording element boards 10 also reduces the pressure drop difference due to fluctuation in flow of the liquid, since the flow resistance is reduced, and is preferable from the point that more stable negative pressure control can be performed.

FIG. 37B is a schematic diagram illustrating the flow of the recording liquid within the liquid discharge head 3. The circuitry is the same as the circulation path illustrated in FIG. 35, but FIG. 37B illustrates the flow of liquid at each component within the actual liquid discharge head 3. A set of the common supply channel 211 and common recovery channel 212 is provided within the slender second channel member 60, extending in the longitudinal direction of the liquid discharge head 3. The common supply channel 211 and common recovery channel 212 are configured so that the liquid flows in mutually opposite directions, with filters 221 disposed at the upstream side of these channels to trap foreign substances intruding from the connection portions 111 or the like. This arrangement where the liquid flows in mutually opposite directions in the common supply channel 211 and common recovery channel 212 is preferable from the point that the temperature gradient in the longitudinal direction within the liquid discharge head 3 is reduced. The flow direction of the common supply channel 211 and common recovery channel 212 is shown as being in the same direction in FIG. 35 to simplify explanation.

A negative pressure control unit 230 is disposed at the downstream side of each of the common supply channel 211 and common recovery channel 212. The common supply channel 211 has branching portions to multiple individual supply channels 213 along the way, and the common recovery channel 212 has branching portions to multiple individual recovery channels 214 along the way. The individual supply channels 213 and individual recovery channels 214 are formed within multiple first channel members 50. Each of the individual channels communicates with openings 21 (see FIG. 20C) of the cover 20 provided to the reverse face of the recording element boards 10.

The negative pressure control units 230 indicated by H and L in FIG. 37B are high-pressure side (H) and low-pressure side (L) units. The respective negative pressure control units 230 are back-pressure type pressure adjustment mechanisms, set to control the pressure upstream of the negative pressure control units 230 to relatively high (H) and low (L) negative pressures. The common supply channel 211 is connected to the negative pressure control unit 230 (high-pressure side), and the common recovery channel 212 is connected to the negative pressure control unit 230 (low-pressure side). This generates differential pressure between the common supply channel 211 and common recovery channel 212. This differential pressure causes the liquid to flow from the common supply channel 211, through the individual supply channels 213, discharge orifices 13 (pressure chambers 23) within the recording element boards 10, and the individual recovery channels 214 in that order, and to the common recovery channel 212.

FIG. 37C is a perspective view illustrating a cross-section taken along line XXXVIIC-XXXVIIC in FIG. 37A. Each discharge module 200 in the present embodiment is configured including a first channel member 50, recording element boards 10, and flexible printed circuit boards 40. The present embodiment does not have the support member 30 (FIG. 18) described in the second embodiment, with the recording element boards 10 having the cover 20 being directly joined to the first channel member 50. The common supply channel 211 provided to the second channel member 60 supplies liquid from the communication ports 61 provided on the upper face thereof to the individual supply channels 213, via the individual communication ports 53 formed on the lower face of the first channel member 50. Thereafter, the liquid passes through the pressure chambers 23, and is recovered to the common recovery channel 212 via the individual recovery channels 214, individual communication ports 53, and communication ports 61, in that order.

Unlike the arrangement illustrated in the second embodiment illustrated in FIGS. 15A and 15B, the individual communication ports 53 on the lower face of the first channel member 50 (the face toward the second channel member 60) are openings of a sufficient size with regard to the communication ports 61 formed on the upper face of the second channel member 60. According to this configuration, even in a case where there is positional deviation at the time of mounting the discharge module 200 to the second channel member 60, fluid communication can be realized in a sure manner between the first channel member 50 and the second channel member 60, so yield will improve when manufacturing the head, thereby reducing costs.

As described above, the liquid discharge head 3 according to the first and second embodiments has multiple recording element boards 10. Each recording element board 10 has discharge orifices 13, liquid supply channels 18 that supply liquid to the discharge orifices 13, liquid recovery channels 19 that recover liquid supplied from individual supply channels 213, and recording elements 15 that generate energy to discharge the liquid from the discharge orifices 13. This liquid discharge head 3 has a common supply channel 211 that supplies liquid to the multiple recording element boards 10 via individual supply channels 213 communicating with at least one of the multiple liquid supply channels 18 provided to the recording element boards 10. The liquid discharge head 3 further has a common recovery channel 212 that recovers liquid from the multiple recording element boards 10 via the individual recovery channels 214 that communicate with at least one of the multiple liquid recovery channels 19 provided to the recording element boards 10. This configuration enables differential pressure to be maintained the same among channels.

The liquid discharge head 3 according to the first embodiment can discharge ink of multiple types (multiple colors), and the liquid discharge heads 3 according to the second embodiment each discharge ink of one type. In a case where one liquid discharge head 3 is to discharge multiple types of ink, the multiple discharge orifices 13 each discharge ink of different types according to the common supply channel 211 with which they communicate.

The following is a description of feature portions of the present embodiment, by way of examples.

First Example of Liquid Discharge Head 3

The channel configuration within the liquid discharge head 3 will be described in detail. Note that in the first through third examples below, description will be made regarding the configuration where one liquid discharge head 3 discharge multiple types of ink, described above in the first embodiment.

Figure 22:
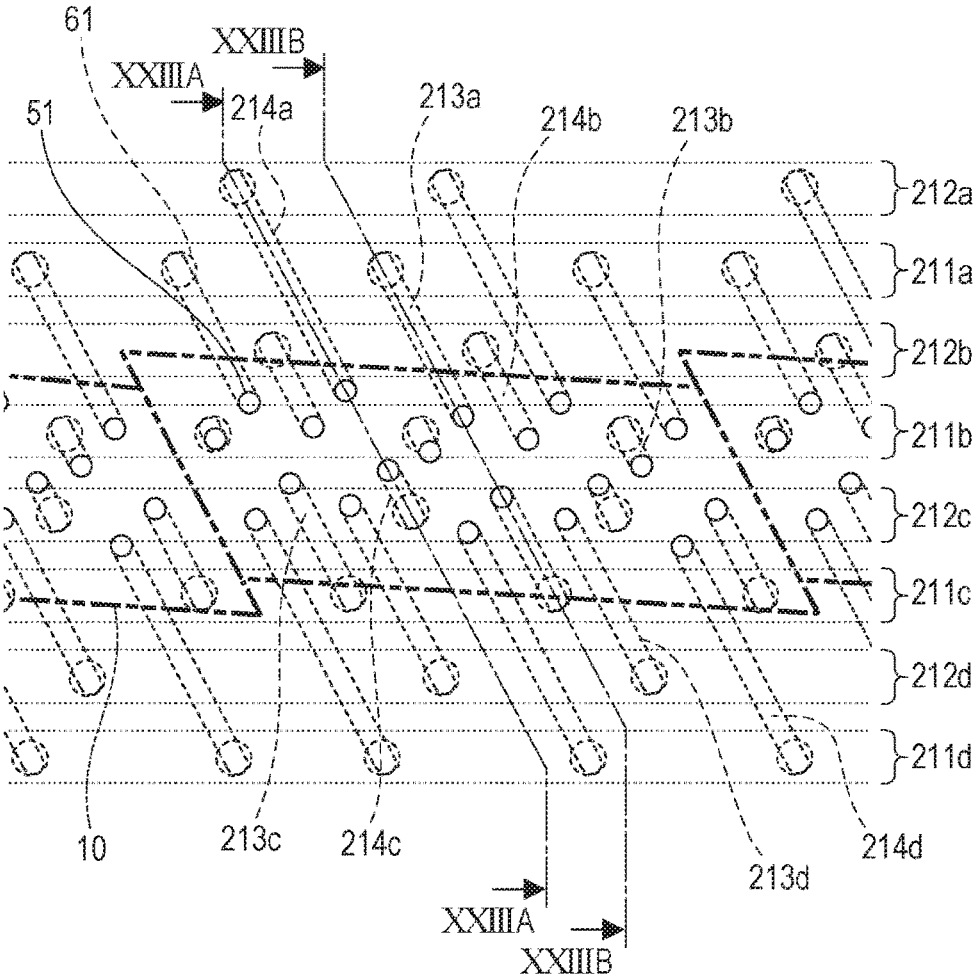
FIG. 22 is a transparent view illustrating channel structures in a first example of a liquid discharge head.

FIG. 22 is a partially enlarged transparent view of channels within the channel member 210 formed by joining the first through third channel members, as viewed from the side of the first channel member 50 on which the discharge modules 200 are mounted. The channel member 210 has, for each color, common supply channels 211 (211*a*, 211*b*, 211*c*, and 211*d*) and common recovery channels 212 (212*a*, 212*b*, 212*c*, and 212*d*) extending on the longitudinal direction of the liquid discharge head 3. Multiple individual supply channels 213 (213*a*, 213*b*, 213*c*, and 213*d*) formed of the individual channel grooves 52 are connected to the common supply channels 211 of each color via the communication ports 61. Multiple individual recovery channels 214 (214*a*, 214*b*, 214*c*, and 214*d*) formed of the individual channel grooves 52 are connected to the common recovery channels 212 of each color via the communication ports 61. This channel configuration enables ink to be consolidated at the recording element boards 10 situated at the middle of the channel members, from the common supply channels 211 via the individual supply channels 213. The internal channel configuration within the recording element board 10 is a described above.

Now, the common supply channels 211 and common recovery channels 212 cross the recording element board 10. However, the rear face of the recording element board 10 is covered with the cover 20 made up of a resin film as described above, and communication with the liquid supply channels 18 and liquid recovery channels 19 is made through the openings 21 at some parts, so circulation paths can be formed without the different colors mixing. In this example, a liquid discharge head having four colors integrated is realized.

Figure 23A:
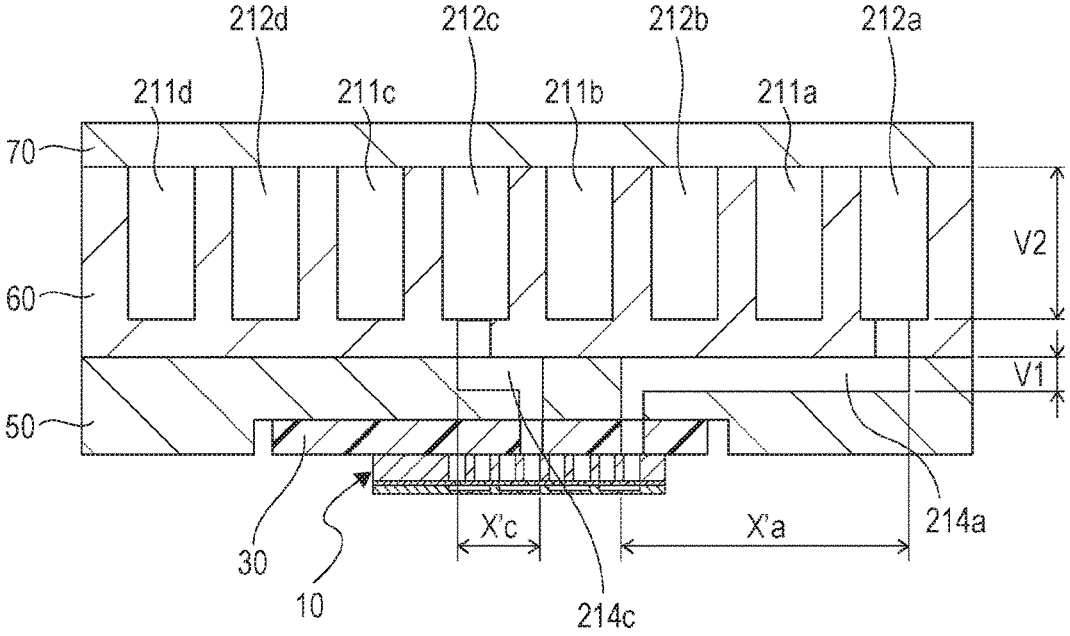
FIGS. 23A and 23B are cross-sectional view illustrating the channel structure of the liquid discharge head in FIG. 22.
Figure 23B:
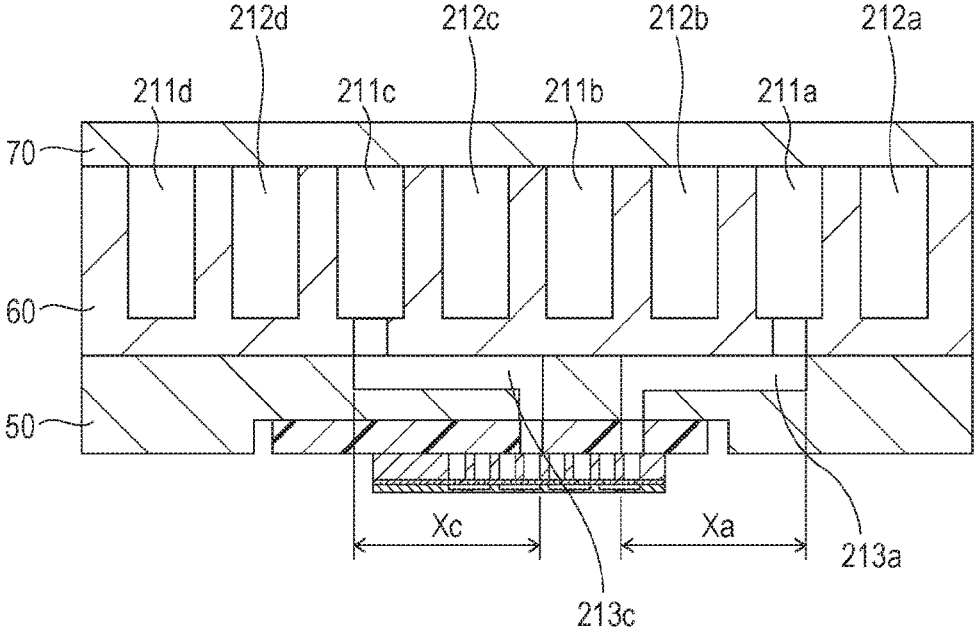

FIG. 23A is a cross-section taken along XXIIIA-XXIIIA in FIG. 22, and FIG. 23B is a cross-section taken along XXIIIB-XXIIIB, schematically illustrating the liquid discharge unit 300. The flexible printed circuit boards are omitted from illustration here, since they are unnecessary for description of the channel configuration.

The common supply channel 211 for each color is connected to the negative pressure control unit 230 (high pressure side) via the liquid supply unit 220 of the corresponding color. The common recovery channel 212 is connected to the negative pressure control unit 230 (low pressure side) via the liquid supply unit 220. The negative pressure control unit 230 generates differential pressure (pressure difference) between the common supply channel 211 and common recovery channel 212. Accordingly, a flow occurs in the order of common supply channels 211→individual supply channels→recording element boards 10→individual recovery channels 214→common recovery channel 212, in each color.

Now, there are cases where the absolute value in pressure differs between the upstream and downstream of the circulation path of the common supply channel 211 and common recovery channel 212, due to pressure drop within the channels. In this case, the differential pressure value will be the same at the upstream and downstream, if the pressure drop at the common supply channel 211 and common recovery channel 212 is substantially the same, and the pressure drop at the individual supply channels 213 and individual recovery channels 214 is substantially the same at the upstream and downstream. That is to say, similar circulation flows are generated at the discharge module situated at the upstream side and at the discharge module situated at the downstream side.

In the present example, common channel grooves 62 (FIG. 6D) that the multiple common supply channels 211 and common recovery channels 212 make up are consolidated on one part, which is the second channel member 60. Accordingly, variance in pressure drop of the common supply channels 211 and common recovery channels 212 can be reduced. That is to say, even if there is manufacturing variation regarding the width and height determining the pressure drop among second channel members 60 manufactured by injection molding, the common supply channels 211 and common recovery channels 212 change in dimensions with the same tendency if being formed as a single part. For example, in most cases, if the dimensions are larger than a specified value, all common supply channels 211 and common recovery channels 212 will be larger, and if the dimensions are smaller than a specified value, all common supply channels 211 and common recovery channels 212 will be smaller. Accordingly, the pressure drop will be about the same for each of the channels, and equivalent differential pressure can be applied to the common channels for each color. This arrangement is particularly suited to application for a configuration such as a page-wide liquid discharge head 3 as in the present example, where the common supply channels 211 and common recovery channels 212 extend from one end in the longitudinal direction of the liquid discharge head 3 to the other end. Filters (221) where pressure drop becomes relatively great are provided on the upstream side of the common supply channels 211 and common recovery channels 212. Accordingly, the variation in pressure loss among the recording element boards 10 can be reduced.

The individual supply channels 213 and individual recovery channels 214 also are consolidated on the first channel member 50, individual channels having approximately the same pressure loss are formed with regard to each discharge module. The common supply channel 211 and common recovery channel 212 supply ink to multiple (15) discharge modules, so there is a need to reduce pressure loss, and further there is a need to reduce the effects of dimensional error of the channels to maintain approximately the same differential pressure at the upstream aside and downstream side of the circulation. To this end, the cross-sectional area of the common supply channel 211 in a cross-section taken in a direction orthogonal to the direction of ink flow is larger than the cross-sectional area of the individual supply channels 213 in the present embodiment by four times or more, e.g., around four to ten times larger. The cross-sectional area of the common recovery channel 212 in a cross-section taken in a direction orthogonal to the direction of ink flow is larger than the cross-sectional area of the individual recovery channels 214 by four times or more, e.g., around four to ten times larger. Thus, the pressure drop of the common supply channel 211 and common recovery channel 212 can be sufficiently reduced.

Particularly, in the direction perpendicular to the recording element board 10 (the thickness direction of the recording element board), the height V2 of the common supply channel 211 is higher than the height V1 of the individual supply channels 213, and the height V2 of the common recovery channel 212 is higher than the height V1 of the individual recovery channels 214. For example, the height V2 of the common supply channel 211 is twice or more (around two to eight times) higher than the height V1 of the individual supply channels 213, and the height V2 of the common recovery channel 212 is twice or more (around two to eight times) higher than the height V1 of the individual recovery channels 214. Accordingly, the cross-sectional area of the common supply channel 211 and common recovery channel 212 can be sufficiently secured without much of an increase in the width of the liquid discharge head 3.

Consequently, a stable circulatory flow that has little differential pressure variation among the recording element boards 10 and discharge modules 200 can be generated in the liquid discharge head 3 according to the present embodiment. In a case where the viscosity of the ink being used is about the same, and the necessary circulatory flow velocity is also about the same, the same pumps of the recording apparatus main unit illustrated in FIG. 2 can be used for multiple colors, thereby reducing the size of the main unit.

In some colors in FIGS. 23A and 23B, the length X of the individual supply channels 213 is made to be shorter than the length X' of the individual recovery channels 214. The pressure drop of a channel is determined by the cross-sectional area and length thereof, so by setting X<X', the pressure loss of the individual supply channels 213 can be made smaller than the individual recovery channels 214. For example, in a case of discharging ink from multiple discharge orifices 13 at the same time, there is a possibility that ink may flow back from the liquid recovery channel 19 to supply (refill) ink to the pressure chambers 23 immediately after having discharged ink. Ink recovered from the pressure chambers 23 to the liquid recovery channel 19 is in a state where the temperature is higher than the temperature within the liquid supply channel 18, due to heat generated by driving of the recording elements 15 having been transmitted thereto. Such high-temperature ink flowing back from the liquid recovery channel 19 may raise the surface of the recording element board 10 (discharge orifice side), reducing ink viscosity, resulting in unevenness in the image due to the liquid droplets becoming larger due to the lower viscosity. Also, backflow of ink may disrupt the circulatory flow near the discharge orifices 13, and discharge performance may suffer. Accordingly, the configuration according to the present embodiment where the pressure drop of the individual supply channels 213 is lower than the individual recovery channels 214 and ink is more readily supplied from the individual supply channels 213 increases stability of circulation, and stable recording can be performed.

Modification of First Example of Liquid Discharge Head 3

Figure 24:
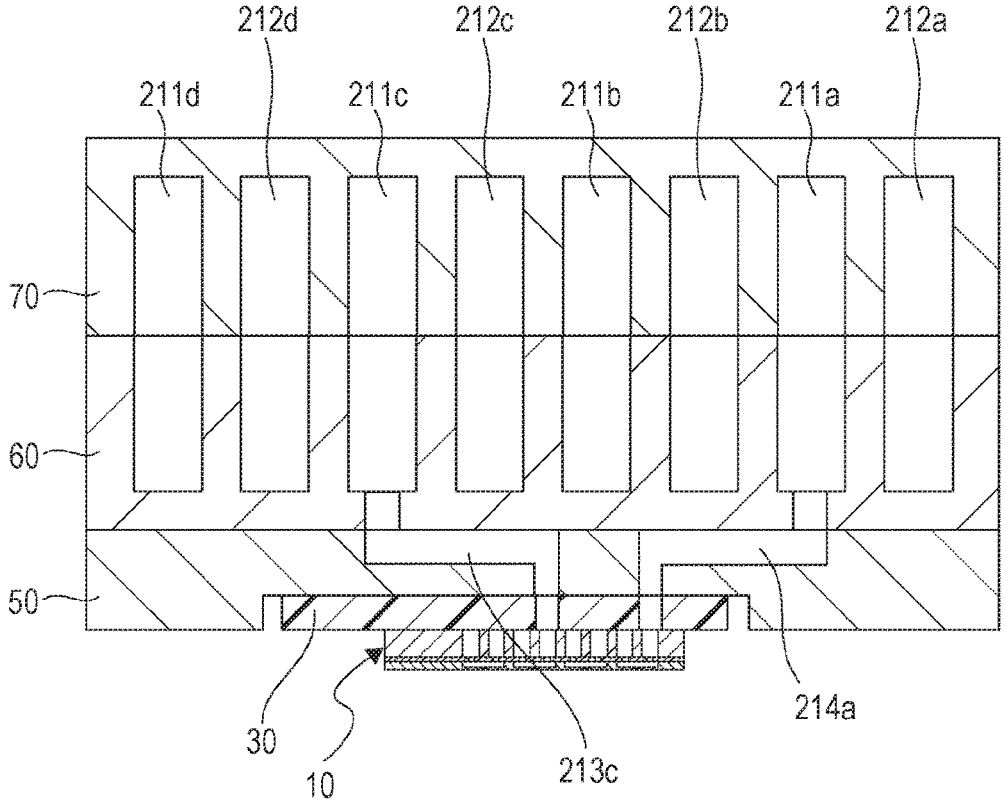
FIG. 24 is a cross-sectional view illustrating a modification of the channel structure of the liquid discharge head in FIG. 22.

FIG. 24 illustrates a modification of the first example. Although FIGS. 23A and 23B illustrated a case where the common channel grooves 62 are formed only in the second channel member 60, an arrangement may be made where grooves to serve as common channels are also formed in the third channel member 70, as illustrated in FIG. 24. Forming multiple grooves in a part of the members forms grooves that have the same variation tendency, in the same way as with the arrangement described above. Accordingly, the relative difference in groove dimensions is small, and the common channels can have a large cross-sectional area without increasing the size of the liquid discharge head 3. This reduces pressure drop of the channels, enables smaller pumps to be applied, and size and electric power consumption of the recording apparatus can be reduced. Although a configuration has been described in the first example where the difference in pressure drop is created by difference in the length of the individual supply channels 213 and individual recovery channels 214, difference in pressure drop may be created by changing the height or width of the channels.

Second Example of Liquid Discharge Head 3

Figure 25:
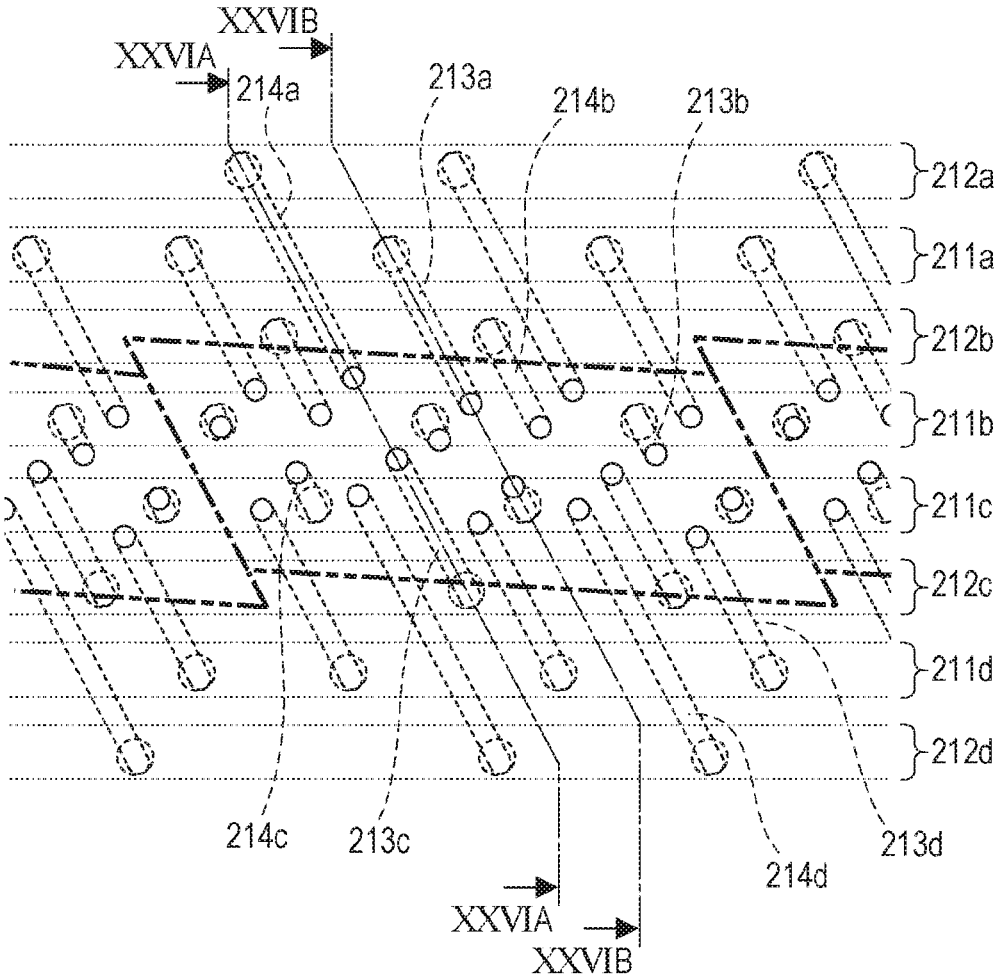
FIG. 25 is a transparent view illustrating channel structures in a second example of a liquid discharge head.
Figure 26A:
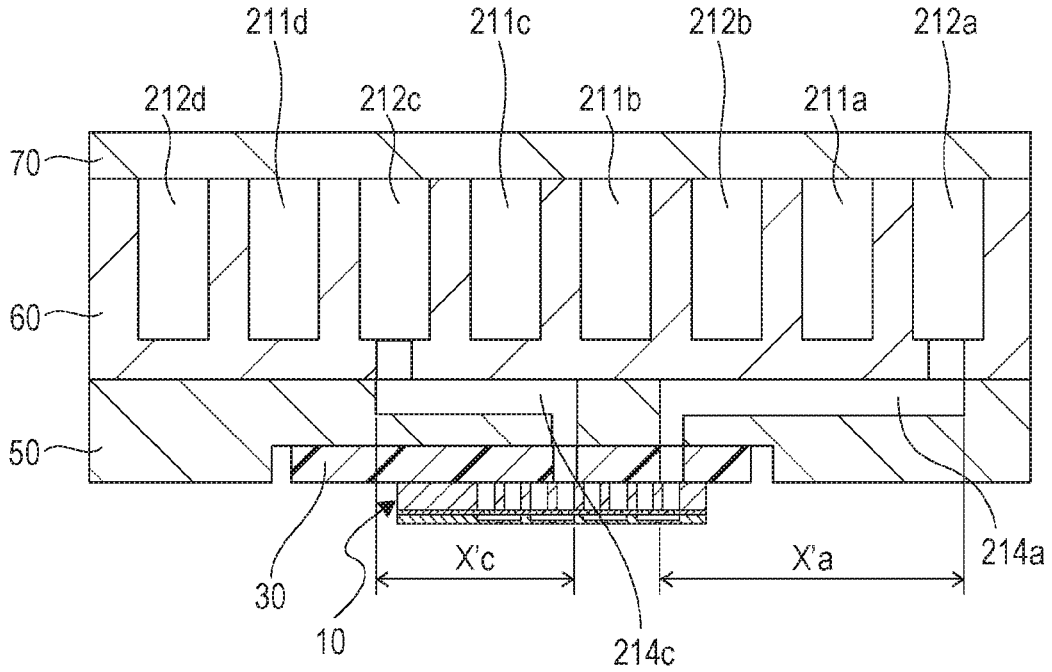
FIGS. 26A and 26B are cross-sectional view illustrating the channel structure of the liquid discharge head in FIG. 25.
Figure 26B:
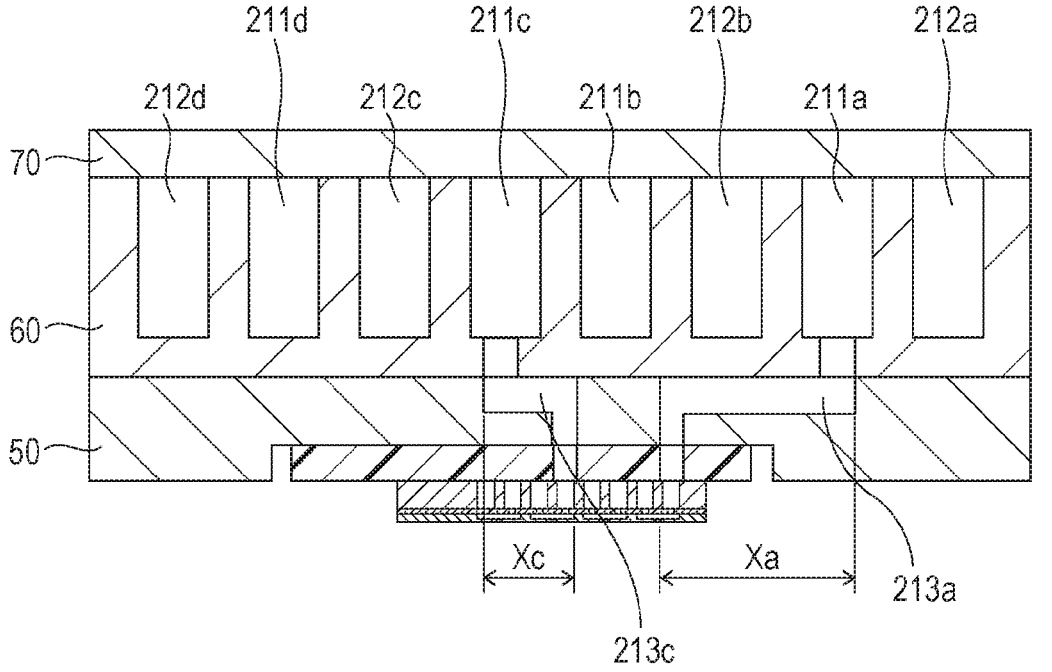

Next, a channel configuration according to a second example of the present invention will be described with reference to FIGS. 25 through 26B. FIG. 25 is a partial enlarged transparent view of channels within the channel member 210 formed by joining the first through third channel members 50, 60, and 70, from the side of the first channel member 50 where the discharge modules 200 are mounted. FIG. 26A is a cross-section taken along XXVIA-XXVIA in FIG. 25, and FIG. 26B is a cross-section taken along XXVIB-XXVIB, schematically illustrating the liquid discharge unit 300.

The present example is a configuration where the relationship in length between the individual supply channels 213 and individual recovery channels 214 (X<X') described in the first example has been applied to all four colors. Of one pair of a common supply channel 211 and a common recovery channel 212, the common recovery channel 212 is disposed on the outer side from the common supply channel 211, in a first direction in which the multiple common supply channels 211 and multiple common recovery channels 212 have been arrayed. According to this configuration, circulation stability is higher at all discharge orifice rows regardless of the type of ink, and high image quality recording can be obtained.

Also, the liquid discharge head 3 according to the present example has three supply openings 21*a* and two recovery openings 21*b* provided to each discharge orifice row of the recording element board 10. Accordingly, three individual supply channels 213 and two individual recovery channels 214 are provided to each discharge module 200. Disposing the connection portion as to the individual recovery channels 214, of which the number of relatively smaller, at the outermost portions of the discharge module 200 (the top and bottom in FIG. 25) reduces the risk of ink leaking from the joined portion.

Third Example of Liquid Discharge Head 3

Figure 27:
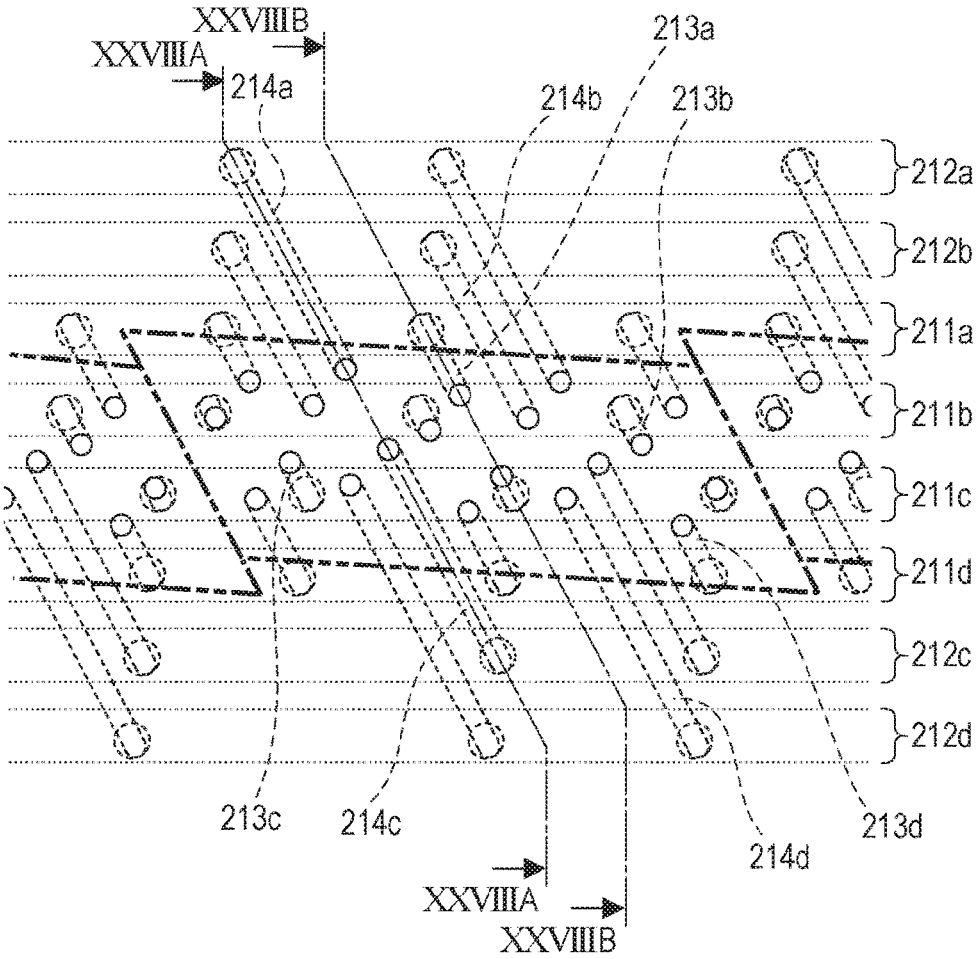
FIG. 27 is a transparent view illustrating channel structures in a third example of a liquid discharge head.
Figure 28A:
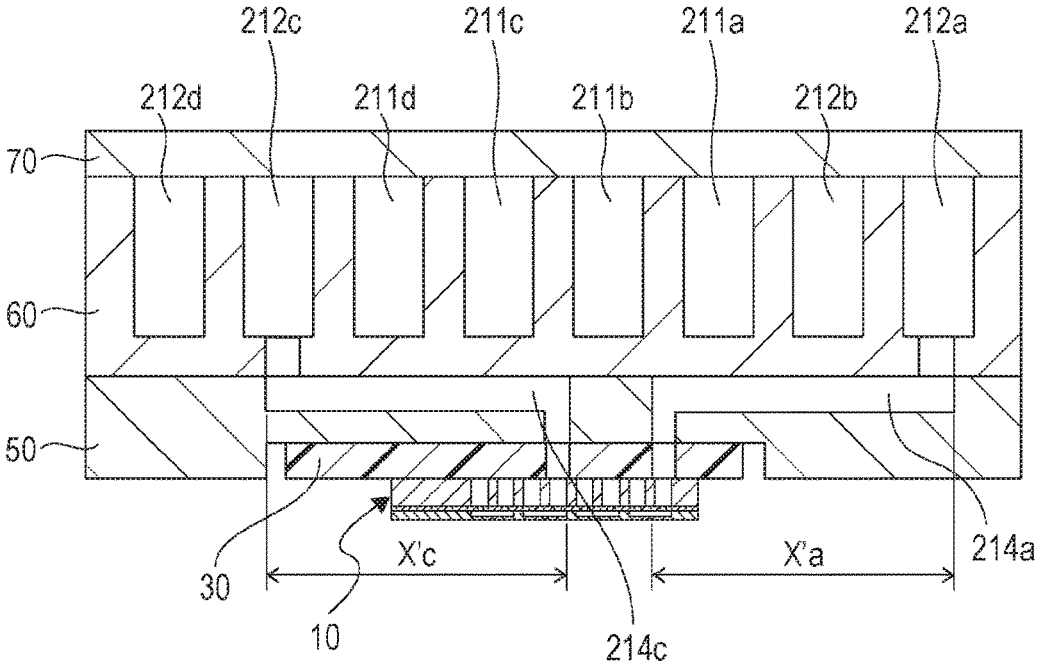
FIGS. 28A and 28B are cross-sectional view illustrating the channel structure of the liquid discharge head in FIG. 27.
Figure 28B:
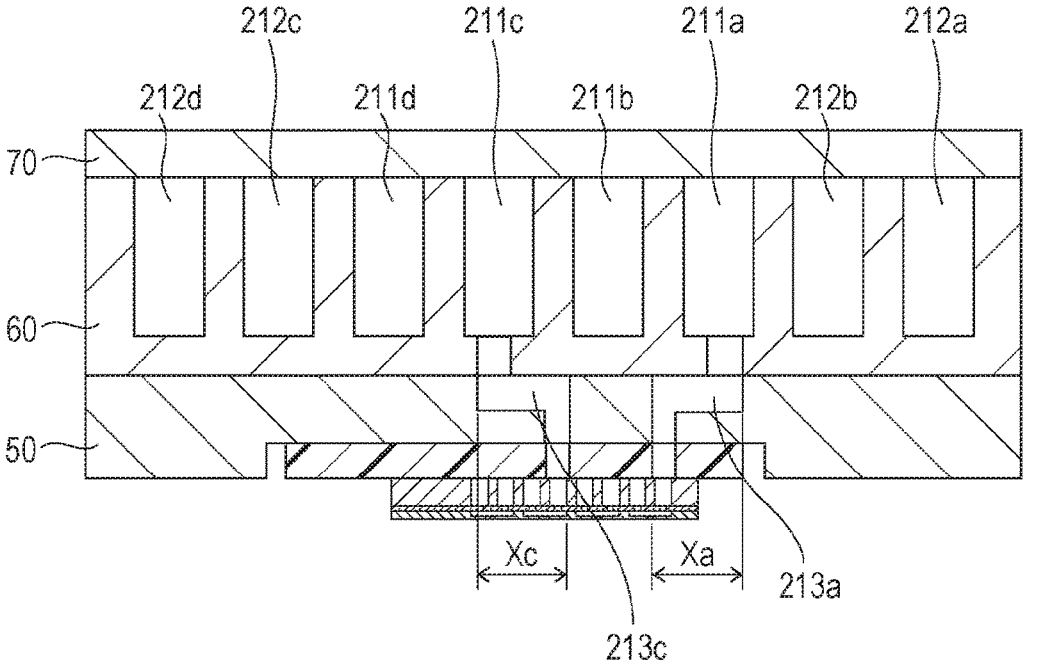

Next, a channel configuration according to a third example of the present invention will be described with reference to FIGS. 27 through 28B. FIG. 27 is a partial enlarged transparent view of channels within the channel member 210 formed by joining the first through third channel members 50, 60, and 70, from the side of the first channel member 50 where the discharge modules 200 are mounted. FIG. 28A is a cross-section taken along XXVIIIA-XXVIIIA in FIG. 27, and FIG. 28B is a cross-section taken along XXVIIIB-XXVIIIB, schematically illustrating the liquid discharge unit 300. Common supply channels 211 for four colors are grouped together at the middle, with two colors each of common recovery channels 212 being disposed on both sides thereof in the present embodiment, as illustrated in FIGS. 28A and 28B. That is to say, the multiple common recovery channels 212 are all situated on the outer side from all common supply channels 211. This enables the difference between the length X of the individual supply channels 213 and the length X' of the individual recovery channels 214 to be increased, thereby increasing the difference in pressure drop. Accordingly, even in a case where multiple discharge orifices 13 discharge ink at the same time, the possibility of backflow occurring is further suppressed, and stability of circulation can be improved.

Also, the individual supply channels 213, of which the number is greater, are arrayed so the length is the shortest, so the area occupied by the channels can be minimized, as illustrated in FIG. 27. A wider region can be set aside where channels are not formed, which can be effectively utilized, such as accommodating other parts therein. Accordingly, functions can be increased without increasing the size of the liquid discharge head.

Further, the cooler common channels are disposed directly above the recording element boards 10 that generate heat when performing recording operations, and ink is more readily supplied in this configuration. Accordingly, the temperature of the recording element board 10 does not readily rise, and consequently recording can be performed with less unevenness of density.

Although the present invention has been described by way of embodiments, the present invention is not restricted to the above embodiments. Various modifications can be made to the configurations and details of the present invention within the scope of the technical idea of the present invention that one skilled in the art can comprehend.

For example, forms where one liquid discharge head discharges multiple types of ink have been described above as the first through third examples of the liquid discharge head 3, but the present invention is not restricted to these examples. The technical idea of the present invention can be applied to the arrangement described in the second embodiment where one discharge head for each liquid discharges one type of liquid, and multiple liquid discharge heads are arrayed.

According to the present invention, variance in circulatory flow of liquid nearby discharge orifices can be reduced among recording element boards in a liquid discharge head having multiple recording element boards.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002952 filed Jan. 8, 2016 and No. 2016-236638 filed Dec. 6, 2016, which are hereby incorporated by reference herein in their entirety.

What is claimed is:

1. A page-wide liquid discharge head that discharges liquid, comprising:

a plurality of recording element boards including a plurality of discharge orifice rows arrayed in parallel in a second direction that intersects a first direction, in which direction the discharge orifice rows have discharge orifices configured to discharge liquid arrayed, a plurality of recording elements configured to generate energy used to discharge liquid, a plurality of pressure chambers having the recording elements within, supply openings configured to supply liquid to the pressure chamber, and recovery openings configured to recover liquid from the pressure chamber; and a support member configured to support the plurality of recording element boards, the plurality of recording element boards being arrayed on the support member, the support member including a common supply channel extending in the first direction and configured to supply liquid to the supply openings of the plurality of recording element boards, and a common recovery channel extending in the first direction and configured to recover liquid from the recovery openings of the plurality of recording element boards.

2. The liquid discharge head according to claim 1, wherein the recording element boards include a laminated structure of a discharge orifice forming member having the discharge orifices, a substrate having the recording elements, and a film member having the supply openings and the recovery openings.

3. The liquid discharge head according to claim 2, wherein the substrate has a supply port extending in the thickness direction of the substrate and facilitating communication of the pressure chambers and the supply openings, and a recovery port extending in the thickness direction of the substrate and facilitating communication of the pressure chambers and the recovery openings.

4. The liquid discharge head according to claim 3, wherein the substrate has a liquid supply channel extending in the first direction and facilitating communication of the supply port and the supply openings, and a liquid recovery channel extending in the first direction and facilitating communication of the recovery port and the recovery openings.

5. The liquid discharge head according to claim 4, wherein each of the plurality of recording element boards are supported by the support member via a plurality of individual support members having a supply liquid communication port facilitating communication of the common supply channel and the liquid supply channel, and a recovery liquid communication port facilitating communication of the common recovery channel and the liquid recovery channel.

6. The liquid discharge head according to claim 5, wherein a linear thermal expansion coefficient of the individual support members is smaller than the linear thermal expansion coefficient of the support member.

7. The liquid discharge head according to claim 3, wherein a pressure drop of the individual supply channels is smaller than a pressure drop of the individual recovery channels.

8. The liquid discharge head according to claim 1, wherein the common supply channel and the common recovery channel are provided in accordance with a length of a region where the plurality of recording element boards are arrayed.

9. The liquid discharge head according to claim 1, wherein a plurality of common supply channels and a plurality of common recovery channels are provided to the support member, and the common supply channels and common recovery channels are provided alternately in the second direction.

10. The liquid discharge head according to claim 1, wherein the liquid discharge head includes a plurality of the common supply channels configured to supply different types of liquid, and a plurality of the common recovery channels configured to recover different types of liquid.

11. The liquid discharge head according to claim 1, wherein the support member includes a plurality of individual supply channels extending in the second direction, configured to supply liquid from the common supply channel to the recording element board, and a plurality of individual recovery channels extending in the second direction, configured to recover liquid from the recording element board to the common recovery channel.

12. The liquid discharge head according to claim 11, wherein a length of the individual supply channels is shorter than a length of the individual recovery channels.

13. The liquid discharge head according to claim 11, wherein a height of the common supply channels, in a direction perpendicular to a face on which the recording elements are provided on the recording element board, is greater than a height of the individual supply channels, and a height of the common recovery channels is greater than a height of the individual recovery channels.

14. The liquid discharge head according to claim 13, wherein a height of the common supply channels, in a direction perpendicular to a face on which the recording elements are provided on the recording element board, is twice or more a height of the individual supply channels, and a height of the common recovery channels is twice or more a height of the individual recovery channels.

15. The liquid discharge head according to claim 13, wherein a cross-sectional area of the common supply channels, in a direction perpendicular to a face on which the recording elements are provided on the recording element board, is four times or more a cross-sectional area of the individual supply channels, and a cross-sectional area of the common recovery channels is four times or more a cross-sectional area of the individual recovery channels.

16. The liquid discharge head according to claim 11, wherein the support member includes a first member on which is formed at least part of the common supply channels and the common recovery channels, and a second member on which is formed at least part of the individual supply channels and the individual recovery channels.

17. The liquid discharge head according to claim 16, wherein the first member and the second member are resin members.

18. The liquid discharge head according to claim 1, wherein the plurality of common recovery channels are disposed on the other side from the plurality of common supply channels in the second direction.

19. The liquid discharge head according to claim 1, wherein the liquid discharge head includes a plurality of the common supply channels, and wherein the plurality of common supply channels include common supply channels of which the direction in which liquid flows differ from each other.

20. The liquid discharge head according to claim 1, wherein the plurality of recording element boards are arrayed in a straight line.

21. The liquid discharge head according to claim 1, wherein the liquid within the pressure chamber is circulated between the inside of the pressure chamber and the outside of the pressure chamber.

22. A recording apparatus comprising:

a page-wide liquid discharge head including a plurality of recording element boards including a plurality of discharge orifice rows arrayed in parallel in a second direction that intersects a first direction, in which first direction the discharge orifice rows have discharge orifices configured to discharge liquid arrayed, a plurality of recording elements configured to generate energy used to discharge liquid, a plurality of pressure chambers having the recording elements within, supply openings configured to supply liquid to the pressure chamber, and recovery openings configured to recover liquid from the pressure chamber; and a support member configured to support the plurality of recording element boards, the plurality of recording element boards being arrayed on the support member, the support member including a common supply channel extending in the first direction and configured to supply liquid to the supply openings of the plurality of recording element boards, and a common recovery channel extending in the first direction and configured to recover liquid from the recovery openings of the plurality of recording element boards;

a liquid container configured to hold liquid; and a supply unit configured to supply liquid within the liquid container to the liquid discharge head.

* * * * *